US006737390B2

(12) United States Patent
Sunder et al.

(10) Patent No.: US 6,737,390 B2
(45) Date of Patent: May 18, 2004

(54) MULTIPHASE LAUNDRY DETERGENT AND CLEANING PRODUCT SHAPED BODIES HAVING NONCOMPRESSED PARTS

(75) Inventors: Matthias Sunder, Duesseldorf (DE); Rolf Bayersdoerfer, Duesseldorf (DE); Bernd Richter, Leichlingen (DE); Hans-Friedrich Kruse, Korschenbroich (DE); Markus Semrau, Timmaspe (DE); Thomas Holderbaum, Monheim (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/799,976

(22) Filed: Mar. 5, 2001

(65) Prior Publication Data

US 2002/0006890 A1 Jan. 17, 2002

(30) Foreign Application Priority Data

Mar. 4, 2000 (DE) ..... 100 10 760

(51) Int. Cl.[7] ..... C11D 17/00

(52) U.S. Cl. ..... 510/298; 510/392; 510/445; 510/446; 510/449; 510/475

(58) Field of Search ..... 510/294, 298, 510/445, 446, 449, 392, 475

(56) References Cited

U.S. PATENT DOCUMENTS

| | | | | |
|---|---|---|---|---|
| 3,234,258 A | | 2/1966 | Morris | 260/460 |
| 4,237,253 A | | 12/1980 | Jacquet et al. | 526/75 |
| 4,814,101 A | | 3/1989 | Schieferstein | 525/174.23 |
| 5,075,041 A | | 12/1991 | Lutz | 252/548 |
| 5,360,567 A | * | 11/1994 | Fry et al. | 510/446 |
| 5,759,974 A | * | 6/1998 | Menke et al. | 510/191 |
| 5,972,870 A | * | 10/1999 | Anderson | 510/298 |
| 6,075,001 A | | 6/2000 | Wilde | 510/376 |
| 6,340,664 B1 | * | 1/2002 | Gassenmeier et al. | 510/441 |
| 6,391,845 B1 | * | 5/2002 | Speed et al. | 510/446 |

FOREIGN PATENT DOCUMENTS

| | | | |
|---|---|---|---|
| DE | 2 150 557 | | 6/1972 |
| DE | 28 17 369 | | 10/1978 |
| DE | 37 08 451 | | 10/1988 |
| DE | 39 29 973 | | 3/1991 |
| DE | 196 16 767 | | 6/1997 |
| DE | 196 16 693 | | 11/1997 |
| DE | 197 09 991 | | 9/1998 |
| DE | 197 10 254 | | 9/1998 |
| FR | 1156513 | | 5/1958 |
| GB | 839 407 | | 6/1960 |
| GB | 873 214 | | 7/1961 |
| GB | 1307387 A | * | 2/1973 |
| GB | 1368495 | | 9/1974 |
| JP | 09175992 A2 | * | 7/1997 |
| WO | WO 98/40463 | | 9/1998 |
| WO | WO 99/06522 | | 2/1999 |
| WO | WO 99/24550 A1 | * | 5/1999 |
| WO | WO 99/27063 | | 6/1999 |
| WO | WO 99/27064 A1 | * | 6/1999 |
| WO | WO 99/27067 | | 6/1999 |
| WO | WO 99/27069 A1 | * | 6/1999 |

OTHER PUBLICATIONS

Eduard Smudgers, "Laundry Detergents," pp. 132–135 (Wiley–VCH 2002).

Breck, D., "Zeolite Molecular Sieves," pp. 92, 45, 176, 177, John Wiley & Sons, New York, London, Sydney, Toronto, 1974.

Falbe, et al., "Römpp Chemie Lexikon," 9th Edition, p. 4440, Georg Thieme Verlag, Stuttgart, New York, 1992.

Voight, et al., "Textbook of Pharmaceutical Technology," 6$^{th}$ Edition, pp. 182–184, VEB Verlag Volk und Gesundheit, Berlin, 1987.

Jakobi, et al., "Detergents and Textile Washing," pp. 94–100, VCH–Verlag, Weinheim, 1987.

Domininghaus, H., "Die Kunststoffe und ihre Eigenschaften," 3$^{rd}$ Edition, pp. 94–100, VDI Verlag, Düsseldorf, 1988.

"Testing of Rubber Films, Plastics Films, Paper, Board and Other Sheet Materials; Determination of Water Vapour Transmission; Gravimetric Method," (DIN 53 122 Blatt 1), DIN Deutsche Institut für Normung e.V., Blatt 1), pp. 1–4, Berlin, (Nov. 1974).

"Testing of Plastic and Elastomer Films, Paper, Board and Other Sheet Materials– Determination of Water Vapour Transmission– Part 1: Gravimetric Method," (DIN 53122–1), DIN Deutsche Institut für Normung e.V., pp. 1–9, Berlin, (Feb. 2000).

* cited by examiner

*Primary Examiner*—Lorna M. Douyon
(74) *Attorney, Agent, or Firm*—Stephen D. Harper; Glenn E. J. Murphy

(57) ABSTRACT

Laundry detergent or cleaning product shaped bodies which comprise two or more noncompressed parts.

74 Claims, No Drawings

MULTIPHASE LAUNDRY DETERGENT AND CLEANING PRODUCT SHAPED BODIES HAVING NONCOMPRESSED PARTS

This application claims priority under 35 U.S.C. § 119 of DE 100 10 760.5, filed Mar. 4, 2000 in the German Patent Office.

BACKGROUND OF THE INVENTION

The present invention relates to laundry detergent and cleaning product shaped bodies that have two or more noncompressed parts.

Laundry detergent or cleaning product shaped bodies are widely described in the prior art and, because of their advantages, have also been accepted commercially and by the consumer.

The customary way of preparing laundry detergent or cleaning product shaped bodies involves preparing particulate premixes that are compressed into tablet form using tableting processes known to the person skilled in the art. However, these methods of preparation have significant disadvantages since pressure-sensitive ingredients may become damaged during the preparation. It has hitherto not been possible to incorporate these ingredients, such as, for example, encapsulated enzymes etc., into tablets without loss of activity. In some cases, even instability or complete inactivity had to be accepted.

In addition, the form of the compressed tablet requires that the ingredients are in direct physical proximity to one another, which in the case of substances that are incompatible, leads to undesired reactions, instabilities, inactivities or loss of active substance.

To solve the abovementioned problems, the prior art has proposed multiphased tablets in which two or more layers are pressed one on top of the other. However, this has the disadvantage that the lower layers are subjected to repeated pressure loading, which leads to impaired solubility. Moreover, said problems were not completely solved thereby since it is not possible to prepare more than three-layer tablets with reasonable technical expenditure.

Further solutions are given in international patent applications WO99/06522, WO99/27063 and WO99/27067, which disclose tablets comprising compressed and noncompressed parts, in which pressure-sensitive substances are incorporated into the noncompressed parts. However, the problems associated with the simultaneous incorporation and separation of two or more pressure-sensitive ingredients are not solved here either. There was therefore still a need to provide improved laundry detergent or cleaning product shaped bodies which combine the highest degree of mechanical stability with good solubility and which, even in the case of design forms having more than three phases, permit economic preparation and the incorporation of pressure-sensitive ingredients.

DESCRIPTION OF THE INVENTION

According to a first embodiment, the present invention relates to laundry detergent or cleaning product shaped bodies that comprise:

(a) a first noncompressed part comprising an active substance; and (b) a further noncompressed part comprising an active substance, wherein the shaped body further comprises one or more enzymes.

Further embodiments of the present invention are laundry detergent or cleaning product shaped bodies that comprise:

(a) a first noncompressed part comprising an active substance; and (b) a further noncompressed part comprising an active substance, wherein the shaped body further comprises one or more builders.

Also provided by the present invention are laundry detergent or cleaning product shaped bodies comprising:

(a) a first noncompressed part comprising an active substance; and (b) a further noncompressed part comprising an active substance, wherein the noncompressed part (b) dissolves later or more slowly than the first noncompressed part (a) under use conditions.

The present invention further provides laundry detergent or cleaning product shaped bodies comprising:

(a) a first noncompressed part comprising an active substance; and (b) a further noncompressed part comprising an active substance, wherein the weight ratio of the first noncompressed part (a) to the second noncompressed part (b) is 50:1 to 1:1.

Last but not least, the present invention also provides laundry detergent or cleaning product shaped bodies that comprise:

(a) a first noncompressed part comprising an active substance; and (b) a further noncompressed part comprising an active substance, wherein the first noncompressed part (a) includes a cavity, and the second noncompressed part (b) is present at least in part in this cavity.

The present invention is not limited with regard to the arrangement of the individual noncompressed parts. Nevertheless, for application reasons, it has proven advantageous if the second noncompressed part (b) does not completely surround the first noncompressed part (a).

The present invention is not of course limited to two-phase shaped bodies. Laundry detergent or cleaning product shaped bodies that comprise a first noncompressed part (a), a second noncompressed part (b), and additionally further noncompressed parts are preferred embodiments of the present invention. Mention is made explicitly here of three-, four-, five- and six-phase shaped bodies of the corresponding number of noncompressed parts.

The shaped bodies of the invention comprising at least two noncompressed parts can of course also be designed such that they comprise further compressed parts, if desired. A combination of a two-part tablet according to the invention comprising two noncompressed parts with a single-phase or multiphase, for example two-layer, conventionally compressed tablet is therefore also possible. In this way, the advantages of the present invention, for example as a result of pasting noncompressed shaped bodies according to the invention to compressed shaped bodies, can likewise be utilized.

In the case of multiphase shaped bodies, particular preference is given to embodiments in which the first noncompressed part (a) has a large number of cavities, and each further noncompressed part is present at least in part in a cavity.

The noncompressed part (a) can assume any geometric shape, preference being given in particular to concave, convex, biconcave, biconvex, cubic, tetragonal, orthorhombic, cylindrical, spherical, cylinder-segment-like, discoid, tetrahedral, dodecahedral, octahedral, conical, pyramidal, ellipsoid, pentagon-, heptagon- and octagon-prismatic, and rhombohedral shapes. It is also possible to realize entirely irregular areas, such as arrow or animal shapes, trees, clouds, etc. If the base shaped body has corners and edges, then these are preferably rounded off. As additional visual differentiation, an embodiment having rounded corners and beveled ("chamfered") edges is preferred.

The shape of the cavity(ies) can also be freely chosen, preference being given to shaped bodies in which at least one cavity can assume a concave, convex, cubic, tetragonal, orthorhombic, cylindrical, spherical, cylinder-segment-like, discoid, tetrahedral, dodecahedral, octahedral, conical, pyramidal, ellipsoid, pentagon-, heptagon- and octagon-prismatic and also rhombohedral shape. Entirely irregular cavity shapes, such as arrow or animal shapes, trees, clouds etc. can also be realized. As with the noncompressed parts (a), cavities with rounded corners and edges or with rounded corners and chamfered edges are preferred.

The size of the cavity relative to the entire shaped body is governed by the desired intended use of the shaped bodies. The size of the cavity can vary. Depending on whether a smaller or larger amount of active substance is to be present in the second measured-out amount. Irrespective of the intended use, preference is given to laundry detergent and cleaning product shaped bodies in which the weight ratio of noncompressed part (a) to noncompressed part (b) is in the range from 1:1 to 100:1, preferably from 2:1 to 80:1, particularly preferably from 3:1 to 50:1, and in particular from 4:1 to 30:1.

Similar remarks may also be made with regard to the surface area proparts which the first and second noncompressed parts constitute relative to the total surface area of the shaped bodies. Preference is given here to laundry detergent and cleaning product parts in which the surface area of the second noncompressed part constitutes 1 to 25%, preferably 2 to 20%, particularly preferably 3 to 15%, and in particular 4 to 10% of the total surface area of the shaped body. If, for example, the total shaped body has dimensions of 20×220×40 mm and thus a total surface area of 40 cm, then preference is given to second noncompressed parts (b) which have a surface area of from 0.4 to 10 cm preferably 0.8 to 8 $cm^2$, particularly preferably from 1.2 to 6 $cm^2$ and in particular from 1.6 to 4 $cm^2$.

The second noncompressed part (b) and the "basic shaped body" (a) are preferably colored so as to be visually distinguishable. In addition to visual differentiation, performance advantages may result therefrom.

The different phase nature of the shaped bodies can be used to separate active ingredients. Preference is given here in particular to laundry detergent or cleaning product shaped bodies according to the invention in which the first noncompressed part (a) and the second noncompressed part (b) comprise at least one different active substance.

In particular, laundry detergent or cleaning product shaped bodies in which the first noncompressed part (a) or the second noncompressed part (b) comprises bleaches, while the other part comprises bleach activators, and also laundry detergent and cleaning product shaped bodies in which the first noncompressed part (a) or the second noncompressed part (b) comprises bleaches, while the other part comprises enzymes, and also laundry detergent and cleaning product shaped bodies in which the first noncompressed part (a) or the second noncompressed part (b) comprises bleaches, while the other part comprises corrosion inhibitors, are preferred embodiments of the present invention.

Preference is also given to laundry detergent and cleaning product shaped bodies wherein the first noncompressed part (a) or the second noncompressed part (b) comprises bleaches, while the other part comprises surfactants, preferably nonionic surfactants, particularly preferably alkoxylated alcohols having 10 to 24 carbon atoms and 1 to 5 alkylene oxide units.

Laundry detergent and cleaning product shaped bodies as claimed in any of claims 1 to 13, wherein the first noncompressed part (a) and the second noncompressed part (b) comprise the same active substance in different amounts are preferred. Examples of ingredients for which partitioning into the different regions has advantages are disintegration auxiliaries, dyes and fragrances, optical brighteners, polymers, silver protectants, surfactants and enzymes. The term "different amounts" signifies here the content of the substance in question in the individual shaped body region, based on the shaped body region, and is thus a percentage by weight which does not refer to the absolute amounts of the ingredient.

For the purposes of the present invention, particular preference is given to laundry detergent or cleaning product shaped bodies in which at least one noncompressed part, preferably noncompressed part (b), is surrounded by a coating layer.

This coating layer can be used for controlling the solubility kinetics of the further noncompressed part, but it can also serve to attach the further noncompressed part to another noncompressed part by, for example, placing an noncompressed part (b) onto or into the cavity of an noncompressed part (a) and fixing by applying a coating layer. Corresponding laundry detergent or cleaning product shaped bodies in which the noncompressed part (b) is attached to or within the noncompressed part (a) by the coating layer are likewise preferred.

If the entire shaped bodies according to the invention or individual noncompressed parts are coated, then preference is given to those laundry detergent or cleaning product shaped bodies in which the coating layer comprises one or more substances from the groups of fatty acids, fatty alcohols, diols, esters, ethers, carboxylic acids, dicarboxylic acids, polyvinyl acetate (PVA), polyvinylpyrrolidone (PVP), polyvinyl alcohol (PVAl), polyethylene glycol (PEG), polypropylene glycol (PPG) and mixtures thereof.

Polypropylene glycols (abbreviation PPG) which can be used according to the invention are polymers of propylene glycol which satisfy the general formula I

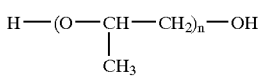

(I)

where n can assume values between 10 and 2 000. Preferred PPG have molar masses between 1 000 and 10 000, corresponding to n values between 17 and about 170.

Polyethylene glycols (abbreviation PEG) which are preferred according to the invention are polymers of ethylene glycol which satisfy the general formula II

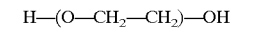

(II)

where n can assume values between 20 and about 1 000. The preferred molecular weight ranges given above correspond to preferred ranges of the value n in formula IV of from about 30 to about 820 (exactly: from 34 to 818), particularly preferably from about 40 to about 150 (exactly: from 45 to 136) and in particular from about 70 to about 120 (exactly: from 68 to 113).

Preferred coating materials are also carboxylic or dicarboxylic acids, preferably those with an even number of carbon atoms. Particularly preferred carboxylic or dicarboxylic acids are those having at least 4, preferably having at least 6, particularly preferably having at least 8, and in particular those having 8 to 13 carbon atoms. Particularly preferred dicarboxylic acids are, for example, adipic acid, pimelic acid, suberic acid, azelaic acid, sebacic acid, undecanoic acid, dodecanoic acid, brassylic acid and mixtures thereof. However, tetradecanoic acid, pentadecanoic acid and thapsic acid are also suitable coating materials. Particularly preferred carboxylic acids are those having 12 to 22 carbon atoms, particular preference being given to those having 18 to 22 carbon atoms.

Thus, laundry detergent or cleaning product shaped bodies in which the coating comprises carboxylic acids, those having 12 to 22, preferably having 18 to 22, carbon atoms being preferred and, of these, the species having an even number of carbon atoms being particularly preferred, are a further preferred embodiment of the present invention. A likewise preferred embodiment are laundry detergent or cleaning product shaped bodies wherein the coating comprises dicarboxylic acids, those having at least 4, preferably having at least 6, particularly preferably having at least 8 and in particular those having 8 to 13 carbon atoms being preferred and, of these, the species having an even number of carbon atoms being particularly preferred. As regards the particularly preferred individual compounds from said groups of carboxylic and dicarboxylic acids, reference may be made to the above statements.

Further suitable coating materials are film-forming substances. Of these in turn, preference is given to polyalkylene glycols, specifically polyethylene and polypropylene glycols, polymers and copolymers of (meth)acrylic acid, in particular copolymers of acrylic acid and maleic acid, and sugars.

Polyethylene and polypropylene glycols are described below. The polymers of (meth)acrylic acid, in particular the copolymers of acrylic acid and maleic acid, are known as cobuilders for laundry detergents or cleaning products. They are described below.

For the purposes of the present invention, the term "sugars" signifies simple sugars and polysugars, i.e. monosaccharides and oligosaccharides in which 2 to 6 monosaccharides are joined together in the form of an acetal. For the purposes of the present invention, "sugars" are thus monosaccharides, disaccharides, trisaccharides, tetrasaccharides, pentasaccharides and hexasaccharides.

Monosaccharides are linear polyhydroxy aldehydes (aldoses) or polyhydroxy ketones (ketoses). They mostly have a chain length of five (pentoses) or six (hexoses) carbon atoms. Monosaccharides with more (heptoses, octoses etc.) or fewer (tetroses) carbon atoms are relatively rare. Some monosaccharides have a large number of asymmetrical carbon atoms. For a hexose having four asymmetric carbon atoms there are in total 24 stereoisomers.

The orientation of the OH group on the highest-numbered asymmetrical carbon atom in the Fischer projection divides the monosaccharides into D- and L-configured series. In the case of the naturally occurring monosaccharides, the D configuration is considerably more common. Monosaccharides form, where possible, intramolecular hemiacetals, giving ring structures of the pyran (pyranoses) and furan type (furanoses). Smaller rings are unstable, and larger rings are only stable in aqueous solutions. Cyclization produces a further asymmetrical carbon atom (the so-called anomeric carbon atom), which again doubles the number of possible stereoisomers. This is expressed by the prefixes α- and β-. The formation of the hemiacetals is a dynamic process which depends on a variety of factors, such as temperature, solvents, pH etc. In most cases, mixtures of the two anomeric forms are present, sometimes also as mixtures of the furanose and pyranose forms.

Monosaccharides which can be used for the purposes of the present invention are, for example, the tetroses D(−)-erythrose and D(−)-threose, and D(−)-erythrulose, the pentoses D(−)-ribose, D(−)-ribulose, D(−)-arabinose, D(+)-xylose, D(−)-xylulose, and D(−)-lyxose and the hexoses D(+)-allose, D(+)-altrose, D(+)-glucose, D(+)-mannose, D(−)-gulose, D(−)-idose, D(+)-galactose, D(+)-talose, D(+)-psicose, D(−) fructose, D(+)-sorbose and D(−)-tagatose. The most important and most widespread monosaccharides are: D-glucose, D-galactose, D-mannose, D-fructose, L-arabinose, D-xylose, D-ribose and 2-deoxy-D-ribose.

Disaccharides are constructed of two simple monosaccharide molecules (D-glucose, D-fructose etc.) linked by a glycosidic bond. If the glycosidic bond is between the acetalic carbon atoms (1 in the case of aldoses and 2 in the case of ketoses) of the two monosaccharides, then the ring form is fixed therewith for both; the sugars do not exhibit mutarotation, do not react with ketone reagents and no longer have a reducing action (Fehling negative: trehalose or sucrose type). If, by contrast, the glycosidic bond links the acetalic carbon atom of a monosaccharide with any of the second, then this can also assume the open-chain form, and the sugar still has a reducing action (Fehling positive: maltose type). The most important disaccharides are sucrose (raw sugar, saccharose), trehalose, lactose (milk sugar), lactulose, maltose (malt sugar), cellobiose (degradation product of cellulose), gentobiose, melibiose, turanose and others.

Trisaccharides are carbohydrates constructed of 3 monosaccharides linked together glycosidically and which are sometimes also incorrectly referred to as trioses. Trisaccharides occur relatively seldomly in nature, examples are gentianose, kestose, maltotriose, melecitose, raffinose, and as an example of trisaccharides containing amino sugars, streptomycin and validamycin.

Tetrasaccharides are oligosaccharides having 4 monosaccharide units. Examples of this class of compound are stachyose, lychnose (galactose-glucose-fructose-galactose) and secalose (comprising 4 fructose units).

For the purposes of the present invention, preferred sugars are saccharides from the group glucose, fructose, sucrose, cellobiose, maltose, lactose, lactulose, ribose and mixtures thereof. Particular preference is given to laundry detergent or cleaning product shaped bodies whose coatings comprise glucose and/or sucrose.

Preferred laundry detergent or cleaning product shaped bodies for the purposes of the present invention are those wherein the coating comprises film-forming substances, in particular from the groups of polyethylene and/or polypropylene glycols, of copolymers of acrylic and maleic acid or of sugars.

Polymers other than those mentioned can also be used with particular preference as coating materials. In this connection, preference is given to laundry detergent or cleaning product shaped bodies according to the invention in which the coating comprises a polymer or polymer mixture chosen from:

a) water-soluble nonionic polymers from the group
  a1) polyvinylpyrrolidones,
  a2) vinylpyrrolidone/vinyl ester copolymers,
  a3) cellulose ethers
b) water-soluble amphoteric polymers from the group of
  b1) alkylacrylamide/acrylic acid copolymers
  b2) alkylacrylamide/methacrylic acid copolymers
  b3) alkylacrylamide/methylmethacrylic acid copolymers
  b4) alkylacrylamide/acrylic acid/alkylaminoalkyl-(meth) acrylic acid copolymers
  b5) alkylacrylamide/methacrylic acid/alkylaminoalkyl-(meth) acrylic acid copolymers
  b6) alkylacrylamide/methylmethacrylic acid/alkylamino-alkyl (meth)acrylic acid copolymers
  b7) alkylacrylamide/alkyl methacrylate/alkylaminoethyl methacrylate/alkyl methacrylate copolymers
  b8) copolymers of
    b8i) unsaturated carboxylic acids
    b8ii) cationically derivatized unsaturated carboxylic acids
    b8iii) optionally further ionic or nonionogenic monomers
c) water-soluble zwitterionic polymers from the group of
  c1) alkylacrylamidoalkyltrialkylammonium chloride/acrylic acid copolymers and alkali metal and ammonium salts thereof
  c2) acrylamidoalkyltrialkylammonium chloride/methacrylic acid copolymers and alkali metal and ammonium salts thereof
  c3) methacroylethylbetaine/methacrylate copolymers
d) water-soluble anionic polymers from the group of
  d1) vinyl acetate/crotonic acid copolymers
  d2) vinylpyrrolidone/vinyl acrylate copolymers
  d3) acrylic acid/ethyl acrylate/N-tert-butylacrylamide terpolymers
  d4) graft polymers of vinyl esters, esters of acrylic acid or methacrylic acid alone or in a mixture, copolymerized with crotonic acid, acrylic acid or methacrylic acid with polyalkylene oxides and/or polyalkylene glycols
  d5) grafted and crosslinked copolymers from the copolymerization of
    d5i) at least one monomer of the nonionic type,
    d5ii) at least one monomer of the ionic type,
    d5iii) of polyethylene glycol and
    5iv) a crosslinker
  d6) copolymers obtained by polymerization of at least one monomer from each of the three following groups:
    d6i) esters of unsaturated alcohols and short-chain saturated carboxylic acids and/or esters of short-chain saturated alcohols and unsaturated carboxylic acids,
    d6ii) unsaturated carboxylic acids,
    d6iii) esters of long-chain carboxylic acids and unsaturated alcohols and/or esters of the carboxylic acids of group
    d6ii) with saturated or unsaturated, straight-chain or branched $C_{8-18}$-alcohols
  d7) terpolymers of crotonic acid, vinyl acetate and an allyl or methallyl ester
  d8) tetra- and pentapolymers of
    d8i) crotonic acid or allyloxyacetic acid
    d8ii) vinyl acetate or vinyl propionate
    d8iii) branched allyl or methallyl esters
    d8iv) vinyl ethers, vinyl esters or straight-chain allyl or methallyl esters
  d9) crotonic acid copolymers containing one or more monomers from the group ethylene, vinylbenzene, vinyl methyl ether, acrylamide and water-soluble salts thereof
  d10) terpolymers of vinyl acetate, crotonic acid and vinyl esters of a saturated aliphatic monocarboxylic acid branched in the α-position
e) water-soluble cationic polymers from the group of
  e1) quaternized cellulose derivatives
  e2) polysiloxanes containing quaternary groups
  e3) cationic guar derivatives
  e4) polymeric dimethyldiallylammonium salts and copolymers thereof with esters and amides of acrylic acid and methacrylic acid
  e5) copolymers of vinylpyrrolidone with quaternized derivatives of dialkyl aminoacrylate and -methacrylate
  e6) vinylpyrrolidone/methoimidazolinium chloride copolymers
  e7) quaternized polyvinyl alcohol
  e8) polymers given under the INCI names Polyquaternium 2, Polyquaternium 17, Polyquaternium 18 and Polyquaternium 27.

Water-soluble polymers for the purposes of the invention are polymers which are soluble at room temperature in water to more than 2.5% by weight.

These preferred laundry detergent or cleaning product shaped bodies according to the invention are coated partially (only one or a few noncompressed parts) or entirely with a polymer or polymer mixture, the polymer (and accordingly the entire coating or the partial coating) or at least 50% by weight of the polymer mixture (and thus at least 50% of the coating/partial coating) being chosen from certain polymers. Here, the partial coating consists entirely or to at least 50% of its weight of water-soluble polymers from the group of nonionic, amphoteric, zwitterionic, anionic and/or cationic polymers. These polymers are described in more detail below.

Water-soluble polymers preferred according to the invention are nonionic. Suitable nonionic polymers are, for example:

polyvinylpyrrolidones, as are sold, for example, under the name Luviskol® (BASF). Polyvinyl-pyrrolidones are preferred nonionic polymers for the purposes of the invention. Polyvinylpyrrolidones [poly(1-vinyl-2-pyrrolidinones)], abbreviation PVP, are polymers of the general formula below:

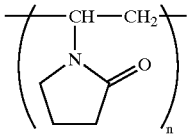

which are prepared by free-radical polymerization of 1-vinylpyrrolidone by processes of solution or suspension polymerization using free-radical formers (peroxides, azo compounds) as initiators. The ionic polymerization of the monomers produces only products with low molar masses. Commercially available polyvinylpyrrolidones have molar masses in the range from about 2 500–750 000 g/mol, which are characterized by stating the K values and have glass transition temperatures of 130–175°, depending on the K value. They are supplied as white, hygroscopic powders or as aqueous solutions. Polyvinylpyrrolidones are readily soluble in water and a large number of organic solvents (alcohols, ketones, glacial acetic acid, chlorinated hydrocarbons, phenols etc.).

Vinylpyrrolidone/vinyl ester copolymers, as are sold, for example, under the trade name Luviskol® (BASF). Luviskol® VA 64 and Luviskol® VA 73, in each case vinylpyrrolidone/vinyl acetate copolymers, are particularly preferred nonionic polymers.

The vinyl ester polymers are polymers obtainable from vinyl esters and having a group of the formula

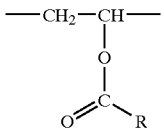

as a characteristic building block of the macromolecules. Of these, the vinyl acetate polymers ($R{=}CH_3$) with polyvinyl acetates as by far the most important representatives are of greatest industrial importance.

The polymerization of the vinyl esters is carried out free-radically by various processes (solution polymerization, suspension polymerization, emulsion polymerization, bulk polymerization).

Cellulose ethers, such as hydroxypropylcellulose, hydroxyethylcellulose and methylhydroxypropylcellulose, as are sold, for example, under the trade names Culminal® and Benecel® (AQUALON) Cellulose ethers can be described by the following general formula

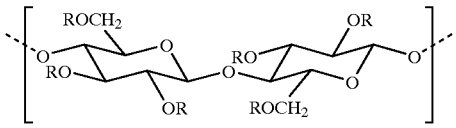

in which R is H or an alkyl, alkenyl, alkynyl, aryl or alkylaryl radical. In preferred products, at least one R in the above formula is $—CH_2CH_2CH_2—OH$ or $—CH_2CH_2—OH$. Cellulose ethers are prepared industrially by etherification of alkali cellulose (e.g. with ethylene oxide). Cellulose ethers are characterized by the average degree of substitution DS or the molar degree of substitution MS which indicate how many hydroxyl groups of an anhydroglucose unit of the cellulose have reacted with the etherification reagent, or how many moles of the etherification agent have been added, on average, to one anhydroglucose unit, respectively. Hydroxyethylcelluloses are soluble in water from a DS of about 0.6 or a MS of about 1. Commercially available hydroxyethyl- or hydroxypropylcelluloses have degrees of substitution in the range 0.85–1.35 (DS) or 1.5–3 (MS). Hydroxyethylcelluloses and hydroxypropylcelluloses are marketed as yellowish-white, odorless and tasteless powders in widely varying degrees of polymerization. Hydroxyethylcelluloses and hydroxypropylcelluloses are soluble in cold and hot water and in a number of (hydrous) organic solvents, but are insoluble in most (anhydrous) organic solvents; their aqueous solutions are relatively insensitive toward changes in pH or addition of electrolyte.

Further polymers suitable according to the invention are water-soluble amphopolymers. The generic term amphopolymers includes amphoteric polymers, i.e. polymers which contain both free amino groups and also free —COOH or $SO_3H$ groups in the molecule and are capable of forming internal salts, zwitterionic polymers which contain quaternary ammonium groups and $—COO^-$ or $—SO_3^-$ groups in the molecule, and those polymers which contain —OOH or $SO_3H$ groups and quaternary ammonium groups. One example of an amphopolymer which can be used according to the invention is the acrylic resin obtainable under the name Amphomer®, which represents a copolymer of tert-butylaminoethyl methacrylate, N-(1,1,3-3-tetramethyl-butyl) acrylamide and two or more monomers from the group acrylic acid, methacrylic acid and monoesters thereof. Likewise preferred amphopolymers are made up of unsaturated carboxylic acids (e.g. acrylic and methacrylic acids), cationically derivatized unsaturated carboxylic acids (e.g. acrylamido-propyltrimethylammonium chloride) and optionally further ionic or nonionogenic monomers. Terpolymers of acrylic acid, methyl acrylate and methacrylamido-propyltriammonium chloride, as are commercially available under the name Merquat®2001 N are particularly preferred amphopolymers according to the invention. Further suitable amphoteric polymers are, for example, the octylacrylamide/methyl methacrylate/tert-butylaminoethyl methacrylate/2-hydroxypropyl methacrylate copolymers obtainable under the names Amphomer® and Amphomer® LV-71 (DELFT NATIONAL).

Suitable zwitterionic polymers are, for example, the polymers disclosed in German patent applications DE 39 29 973, DE 21 50 557, DE 28 17 369 and DE 37 08 451. Acrylamidopropyltrimethylammonium chloride/acrylic acid or methacrylic acid copolymers and the alkali metal and ammonium salts thereof are preferred zwitterionic polymers. Further suitable zwitterionic polymers are methacroylethylbetaine/methacrylate copolymers, which are available commercially under the name Amersette® (AMERCHOL).

Anionic polymers suitable according to the invention are, inter alia:

vinyl acetate/crotonic acid copolymers, as are commercially available, for example, under the names Resyn® (NATIONAL STARCH), Luviset® (BASF) and Gafset (GAF).

In addition to having the monomer units of the formula given above, these polymers also have monomer units of the general formula given below:

$$[—CH(CH_3)—CH(COOH)—]_n$$

Vinylpyrrolidone/vinyl acrylate copolymers, obtainable, for example, under the trade name Luviflex® (BASF). A preferred polymer is the vinylpyrrolidone/acrylate terpolymers obtainable under the trade name Luviflex® VBM-35 (BASF).

Acrylic acid/ethyl acrylate/N-tert-butylacrylamide terpolymers, which are sold, for example, under the name Ultrahold® strong (BASF).

Graft polymers of vinyl esters, ester of acrylic acid or methacrylic acid alone or in a mixture, copolymerized with crotonic acid, acrylic acid or methacrylic acid with polyalkylene oxides and/or polyalkylene glycols.

Such grafted polymers of vinyl esters, esters of acrylic acid or methacrylic acid alone or in a mixture with other copolymerizable compounds onto polyalkylene glycols are obtained by polymerization at elevated temperature in the homogeneous phase by stirring the polyalkylene glycols into the monomers of the vinyl esters, esters of acrylic acid or methacrylic acid, in the presence of free-radical formers. Suitable vinyl esters have proven to be, for example, vinyl acetate, vinyl propionate, vinyl butyrate, vinyl benzoate, and suitable esters of acrylic acid or methacrylic acid have proven to be those obtainable with aliphatic alcohols having a low molecular weight, i.e. in particular ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-l-butanol; 3-methyl-2-butanol, 2-methyl-2-butanol, 2-methyl-1-butanol, 1-hexanol.

In particular, the vinyl acetate copolymers grafted onto polyethyene glycols and the polymers of vinyl acetate and crotonic acid grafted onto polyethylene glycols may be used.

Grafted and crosslinked copolymers from the copolymerization of i) at least one monomer of the nonionic type,
ii) at least one monomer of the ionic type,
iii) of polyethylene glycol and
iv) a crosslinker.

The polyethylene glycol used has a molecular weight between 200 and several million, preferably between 300 and 30 000.

The nonionic monomers can be of very different types and, of these, preference is given to the following: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether and 1-hexene.

The nonionic monomers can equally be of very different types, where, of these, crotonic acid, allyloxy acetic acid, vinyl acetic acid, maleic acid, acrylic acid and methacrylic acid are particularly preferably present in the graft polymers.

Preferred crosslinkers are ethylene glycol dimethacrylate, diallyl phthalate, ortho-, meta- and para-divinylbenzene, tetraallyloxyethane and polyallylsucroses having 2 to 5 allyl groups per molecule of saccharin.

The grafted and crosslinked copolymers described above are preferably formed from:

i) 5 to 85% by weight of at least one monomer of the nonionic type,
ii) 3 to 80% by weight of at least one monomer of the ionic type,
iii) 2 to 50% by weight, preferably 5 to 30% by weight, of polyethylene glycol and
iv) 0.1 to 8% by weight of a crosslinker, the percentage of the crosslinker being formed by the ratio of the total weights of i), ii) and iii).

Copolymers obtained by copolymerization of at least one monomer from each of the three following groups:

i) esters of unsaturated alcohols and short-chain saturated carboxylic acids and/or esters of short-chain saturated alcohols and unsaturated carboxylic acids,
ii) unsaturated carboxylic acids,
iii) esters of long-chain carboxylic acids and unsaturated alcohols and/or esters of the carboxylic acids of group ii) with saturated or unsaturated, straight-chain or branched $C_{8-18}$-alcohols Short-chain carboxylic acids and alcohols are understood as meaning here those having 1 to 8 carbon atoms, it being possible for the carbon chains of these compounds to be optionally interrupted by divalent hetero groups such as —O—, —NH—, —S—.

Terpolymers of crotonic acid, vinyl acetate and an allyl or methallyl ester

These terpolymers contain monomer units of the abovementioned general formulae for crotonic acid or vinyl acetate (see above), and monomer units of one or more allyl or methallyl esters of the formula

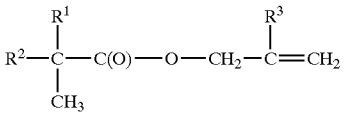

in which $R^3$ is —H or —$CH_3$, $R^2$ is —$CH_3$ or —CH$(CH_3)_2$, and $R^1$ is —$CH_3$ or a saturated straight-chain or branched $C_{1-6}$-alkyl radical, and the sum of carbon atoms in the radicals $R^1$ and $R^2$ is preferably 7, 6, 5, 4, 3 or 2.

The abovementioned terpolymers preferably result from the copolymerization of from 7 to 12% by weight of crotonic acid, 65 to 86% by weight, preferably 71 to 83% by weight, of vinyl acetate and 8 to 20% by weight, preferably 10 to 17% by weight, of allyl or methallyl radicals of the formula given above.

Tetra- and pentapolymers of i) crotonic acid or allyloxy acetic acid
ii) vinyl acetate or vinyl propionate
iii) branched allyl or methally esters
iv) vinyl ethers, vinyl esters or straight-chain allyl or methallyl esters crotonic acid copolymers with one or more monomers from the group ethylene, vinylbenzene, vinyl methyl ether, acrylamide and water-soluble salts thereof terpolymers of vinyl acetate, crotonic acid and vinyl esters of a saturated aliphatic mononcarboxylic acid branched in the α-position.

Further polymers which can preferably be used as a constituent of the coating are cationic polymers. Of the cationic polymers, preference is given here to the permanently cationic polymers. "Permanently cationic" is the term used according to the invention to describe those polymers which have a cationic group irrespective of the pH of the composition (i.e. both of the coating and also of the shaped body). These are usually polymers which contain a quaternary nitrogen atom, for example in the form of an ammonium group.

Preferred cationic polymers are, for example, quaternized cellulose derivatives, as are commercially available under the name Celquat® and Polymer JR®. The compounds Celquat® H 100, Celquat® 200 and Polymer JR® 400 are preferred quaternized cellulose derivatives.

Polysiloxanes containing quaternary groups, such as, for example, the commercially available products Q2-7224 (manufacturer: Dow Corning; a stabilized trimethylsilylamodimethicone), Dow Corning® 929 emulsion (comprising an hydroxyl-amino-modified silicone, which is also referred to as amodimethicone), SM-2059 (manufacturer: General Electric), SLM-55067 (manufacturer: Wacker) and also Abil®-Quat 3270 and 3272 (manufacturer: Th. Goldschmidt; diquaternary polydimethylsiloxanes, quaternium-80), cationic guar derivatives, such as, in particular, the products sold under the trade names Cosmedia® guar and Jaguar®, polymeric dimethyldiallylammonium salts and copolymers thereof with esters and amides of acrylic acid and methacrylic acid. The products commercially available under the names Merquat® 100 (poly (dimethyldiallylammonium chloride)) and Merquat® 550 (dimethyldiallyl-ammonium chloride/acrylamide copolymer) are examples of such cationic polymers.

Copolymers of vinylpyrrolidone with quaternized derivatives of dialkyl aminoacrylate and methacrylate, such as, for example, vinylpyrrolidone/dimethyl aminomethacrylate copolymers quaternized with diethyl sulfate. Such compounds are available commercially under the names Gafquat® 734 and Gafquat® 755.

Vinylpyrrolidone/methoimidazolinium chloride copolymers, as are offered under the name Luviquat®.

Quaternized polyvinyl alcohol and also the polymers known under the names polyquaternium 2, polyquaternium 17, polyquaternium 18 and polyquaternium 27 having quaternary nitrogen atoms in the polymer main chain. Said polymers are referred to here in accordance with INCI nomenclature; detailed information can be found in the CFTA International Cosmetic Ingredient Dictionary and Handbook, 5th Edition, The Cosmetic, Toiletry and Fragrance Association, Washington, 1997, to which reference is expressly made here.

Cationic polymers preferred according to the invention are quaternized cellulose derivatives and polymeric dimethyldiallylammonium salts and copolymers thereof. Cationic cellulose derivatives, in particular the commercial product Polymer® JR 400, are very particularly preferred cationic polymers.

In order, where appropriate, to make the coating even more resistant to mechanical stress, it is possible to incorporate polyurethanes into the coating. These give the coating elasticity and stability and can, in accordance with the amount, given above, of water-soluble polymers, constitute up to 50% by weight of the coating.

For the purposes of the invention, polyurethanes are water-insoluble if they are soluble in water at room temperature to an extent of less than 2.5% by weight.

The polyurethanes consist of at least two different types of monomer:

a compound (A) having at least 2 active hydrogen atoms per molecule and a di- or polyisocyanate (B).

The compounds (A) may, for example, be diols, triols, diamines, triamines, polyetherols and polyesterols. Here, compounds having more than 2 active hydrogen atoms are usually used only in small amounts in combination with a large excess of compounds having 2 active hydrogen atoms.

Examples of compounds (A) are ethylene glycol, 1,2- and 1,3-propylene glycol, butylene glycols, di-, tri-, tetra- and polyethylene and -propylene glycols, copolymers of lower alkylene oxides, such as ethylene oxide, propylene oxide and butylene oxide, ethylenediamine, propylenediamine, 1,4-diaminobutane, hexamethylenediamine, and $\alpha,\Omega$-diamines based on long-chain alkanes or polyalkylene oxides.

Polyurethanes in which the compounds (A) are diols, triols and polyetherols may be preferred according to the invention. In particular, polyethylene glycols and polypropylene glycols having molar masses between 200 and 3 000, in particular between 1 600 and 2 500, have proven particularly suitable in individual cases. Polyesterols are usually obtained by modification of the compound (A) with dicarboxylic acids, such as phthalic acid, isophthalic acid and adipic acid.

Compounds (B) are predominantly hexamethylene diisocyanate, 2,4- and 2,6-toluene diisocyanate, 4,4'-methylenedi(phenyl isocyanate) and, in particular, isophorone diisocyanate. These compounds can be described by the following general formula:

$$O{=}C{=}N{-}R^4{-}N{=}C{=}O,$$

in which $R^4$ is a connecting group of carbon atoms, for example a methylene, ethylene, propylene, butylene, pentylene, hexylene etc. group. In the abovementioned hexamethylene diisocyanate (HMDI), which is the one most frequently used in industry, $R^4{=}(CH_2)_6$; in 2,4- and 2,6-toluene diisocyanate (TDI), $R^4$ is $C_6H_3{-}CH_3$); in 4,4'-methylenedi(phenyl isocyanate) (MDI), $R^4$ is $C_6H_4{-}CH_2{-}C_6H_4$ and in isophorone diisocyanate, $R^4$ is the isophorone radical (3,5,5-trimethyl-2-cyclohexenone).

Furthermore, the polyurethanes used according to the invention may also contain building blocks such as, for example, diamines, as chain extenders, and hydroxycarboxylic acids. Dialkylolcarboxylic acids, such as, for example, dimethylol-propionic acid, are particularly suitable hydroxycarboxylic acids. With regard to the further building blocks, there is no fundamental restriction as to whether the building blocks are nonionic, anionic or cationic.

For further information regarding the structure and the preparation of the polyurethanes, reference is made expressly to the articles in the relevant overview works, such as Römpps Chemie-Lexikon and Ullmanns Encyclopedia of Industrial Chemistry.

Polyurethanes which have proven particularly suitable according to the invention in many cases are those which may be characterized as follows:

exclusively aliphatic groups in the molecule no free isocyanate groups in the molecule polyether and polyester polyurethanes anionic groups in the molecule.

Furthermore, it has proven advantageous for the preparation of the coated laundry detergent and cleaning product shaped bodies according to the invention if the polyurethanes have not been mixed directly with the further components of the partial coating, but have been introduced in the form of aqueous dispersions. Such dispersions usually have a solids content of about 20–50%, in particular about 35–45%, and are also commercially available.

As well as comprising the coating materials, the coating can comprise further ingredients which improve the physical properties of the coating or which impart advantageous properties to the coated shaped body. It is, for example, possible to incorporate so-called minor components, such as, for example, dyes or optical brighteners or foam inhibitors, into the coating. If coating materials which are only poorly or slowly soluble in water are used, then disintegration auxiliaries can be incorporated into the coating. Such laundry detergent or cleaning product shaped bodies according to the invention in which the coating additionally comprises a disintegration auxiliary in amounts of from 0.1 to 10% by weight, preferably from 0.2 to 7.5% by weight and in particular from 0.25 to 5% by weight, in each case based on the coating layer, are preferred within the context of the present invention.

The use of the disintegration auxiliaries described below in detail is advisable particularly in the case of acid coating layers, customary use concentrations for the disintegration auxiliaries in the coating layers being 0.1 to 5% by weight, based on the coating layer.

For the purposes of the present invention, it is additionally preferred to provide the second noncompressed part with a coating in order to protect it from dissolution during an earlier washing or cleaning operation. Here, the pH-dependent solubility of the coating is a particularly preferred control mechanism.

The principle of pH-dependent solubility in water is usually based on a protonation or deprotonation of functional side groups of the polymer molecules, as a result of which their charge state changes accordingly. The polymer must then be in a state such that it dissolves in water in the charged state stable at a certain pH, but precipitates out in the uncharged state at a different pH. For the purposes of the present invention, it is preferred that the polymers used according to the invention have a lower solubility in water at a higher pH than at a lower pH, or are even insoluble in water at a relatively high pH.

Polymers with pH-dependent solubility are known in particular from the pharmaceutical sector. Here, use is made, for example, of acid-insoluble polymers in order to give tablets a coating which is resistant to gastric juices, but is soluble in intestinal fluid. Such acid-insoluble polymers are mostly based on derivatives of polyacrylic acid, which is present in the acidic range in undissociated and thus insoluble form, but in the alkaline range, typically at pH 8, is neutralized and goes into solution as polyanion.

Examples are also known in the prior art for the converse case: soluble in the acid range, insoluble in the alkaline range. These substances, in which the polymer molecules mostly carry amino-substituted side chains, are used, for example, for the manufacture of tablet coatings which are soluble in gastric juices. They usually dissolve at a pH below 5. Polymers in which the change in solubility from soluble to insoluble occurs at a relatively high pH are not known from the pharmaceutical sector since this pH range is of no importance from a physiological viewpoint.

Particularly preferred suitable substances are basic (co) polymers which have amino groups or aminoalkyl groups. Comonomers can, for example, be customary acrylates, methacrylates, maleates or derivatives of these compounds. A particularly suitable aminoalkyl/methacrylate copolymer is sold by Röhm (Eudragit®).

Particularly preferred laundry detergent or cleaning product shaped bodies are notable for the fact that the second noncompressed part (b) is coated with a polymer which contains amino groups, preferably a copolymer of basic monomers, such as dialkylaminoalkyl (meth)acrylates with acrylic esters.

Laundry detergents or cleaning product shaped bodies in which the second noncompressed part (b) is coated with an ampholytic polymer, preferably a copolymer of basic monomers, such as dialkylaminoalkyl (meth)acrylates, with substituted or unsubstituted acrylic acids and/or (meth) acrylic acids, can also be used and are preferred according to the invention.

For use, however, as well as the thermodynamic solubility, the dissolution kinetics of a filmed substance or the reduction in its mechanical stability may also be of importance. The dissolution kinetics of the switch substances used according to the invention are pH-dependent at room temperature into the alkaline range, i.e. the films are stable for considerably longer at pH 10 than at a pH of 8.5, although they are thermodynamically soluble at both pHs.

In a further embodiment of the present invention, polymers are therefore used whose solubility in water fluctuates between pH 6 and 7 and which are less readily soluble at a higher pH than at a lower pH. As already described above, suitable polymers contain basic groups, for example primary, secondary or tertiary amino groups, imino groups, amido groups or pyridine groups, in general those which have a quaternizable nitrogen atom. At a relatively low pH, these are in protonated form, as a result of which the polymer is soluble. At a relatively high pH, the molecule converts to the uncharged state and becomes insoluble. As a rule, the transition, called the "switch point" hereinafter, takes place irrespective of the $pK_B$ value of the basic groups and of their density along the polymeric chains in the acidic pH range. The present invention therefore also provides a polymer in which the switch point is in a range between pH 6 and 7.

This shifting of the switch point is in principle possible in the following way:

depending on the $pK_B$ value, only a very slight pH-dependent change in the charge state of the polymer in solution takes place in the higher pH range. Therefore, it must be possible to decisively influence the solubility through this slight change in the charge state. The polymer must thus have precisely a hydrophilicity such that it is insoluble in the completely uncharged state, but becomes soluble even in the case of slight charging.

To adjust the hydrophilicity, it is possible to use the following methods:

Copolymerization of a monomer having a basic function with a more hydrophilic monomer. The switch point is influenced by the incorporation ratio of the respective comonomer.

Hydrophilicization of the polymer carrying basic groups by a polymer-analogous reaction. The switch point is influenced by the degree of modification.

In addition to a simple hydrophilicization, it is also possible to introduce basic functions having different $pK_B$ values. The switch point can be influenced by the ratio of the two groups and the resulting hydrophilicity of the molecule. A particularly preferred polymer of this class of substance is a N-oxidized polyvinylpyridine.

The pH-shift-sensitive switches according to the invention and use according to the invention can be used for all applications, in particular in the laundry detergent, rinse or cleaning product sector in which an active substance is to be released when the pH is reduced from alkaline to neutral. This may be the case either within the scope of washing in the washing machine and also in the case of machine dishwashing. In particular, it is the intention to claim the use to formulate parts of a cleaning formulation for machine dishwashing (e.g. surfactants, perfume, soil repellant, acid, complexing agents, builder substances etc., or preparations which comprise these active substances) with the polymer according to the invention such that said parts are not released in the main rinse cycle at a high pH, but are released in the subsequent clear-rinse cycle at a lower pH.

The polymer can be used according to the invention either as a coating material, or also as a matrix material, binder or disintegrant. Here, it is not necessary for the polymer to dissolve completely under the corresponding pH conditions to release the active substance. Instead, it suffices if, for example, the permeability of a polymer film changes, allowing, for example, water to penetrate into the active substance formulation. As a result, a secondary effect, e.g. the activation of a sprinkler system or the swelling of a water-swellable disintegrant, which are known in particular from the pharmaceutical sector, can provide for the complete liberation of the active substance.

In a further preferred embodiment of the invention, in addition to the abovementioned switches, pH-shift boosters are used. These prevent, at least largely, residues which consist in particular of the pH-dependent soluble substance itself from being found after the clear-rinse cycle. For the purposes of this invention, suitable pH-shift boosters are all substances and formulations which are able to increase the extent of the pH shift either locally, i.e. in the direct environment of the pH-shift-sensitive substance used in each case, or else generally, i.e. within the whole rinse liquor. These include all organic and/or inorganic water-soluble acids or acidic salts, in particular at least one substance from the group of alkylbenzenesulfonic acids, alkylsulfuric acids, citric acid, oxalic acid and/or alkaline metal hydrogensulfate.

The pH-shift booster can be incorporated into the laundry detergent, rinse composition or cleaning product composition. In a further embodiment of the invention, it is, however, also possible to introduce the pH-shift booster, either when the cleaning cycle has finished or at the start of the clear-rinse cycle, externally to the machine, or to release it by means of a special delivery system (by coating with a coating composition which dissolves slowly) or by diffusion from a matrix material.

The coated second measured-out amount can have a further coating in order, for example, to permit a release only in the final wash or cleaning cycle. In this way, the first coating with pH-dependent solubility can, for example, be protected against ambient influences.

Laundry detergent or cleaning product shaped bodies in which the coated second noncompressed part (b) has a further coating, which is preferably chosen from polyvinyl acetate and/or polyvinyl alcohol and also the substances melting at >50° C., preferably paraffins and/or polyethylene glycols, are preferred. It is also possible to use polyvinylpyrrolidone (PVP).

Polyvinyl alcohols (abbreviated to PVAL) are polymers of the general structure:

$$[—CH_2—CH(OH)—]_n$$

which also contain structural units of the type:

$$[—CH_2—CH(OH)—CH(OH)—CH_2—]$$

in small amounts. Since the corresponding monomer (vinyl alcohol) is not stable in free form, polyvinyl alcohols are obtained via polymer-analogous reactions by hydrolysis, industrially in particular by alkaline-catalyzed transesterification of polyvinyl acetates with alcohols, preferably with methanol. By means of these industrial processes, PVAL are also accessible which contain a predetermined residual content of acetate groups.

Commercially available PVAL (e.g. Mowiol® products from Hoechst) are available as white-yellowish powders or granulates having degrees of polymerization in the range from about 500 to 2 500 (corresponding to molar masses of about 20 000 to 100 000 g/mol) and have varying degrees of hydrolysis from 98 to 99 or 87 to 89 mol %. They are thus partially hydrolyzed polyvinyl acetates having a residual content of acetyl groups of from about 1 to 2 or 11 to 13 mol %.

The solubility in water of PVAL can be lowered by aftertreatment with aldehydes (acetalation), by complexation with Ni or Cu salts or by treatment with dichromates, boric acid, borax, and in this way be adjusted to desired values in a targeted manner. Films made of PVAL are largely impenetrable for gases such as oxygen, nitrogen, helium, hydrogen, carbon dioxide, but allow water vapor to pass through.

Examples of suitable water-soluble PVAL films are the PVAL films obtainable under the name "SOLUBLON®" from Syntana Handelsgesellschaft E. Harke GmbH & Co. The temperature-dependent solubility in water thereof can be adjusted precisely, and films of this product series are available which are soluble in the aqueous phase in all temperature ranges relevant for application.

Polyvinylpyrrolidones, referred to in short as PVP, can be described by the following general formula:

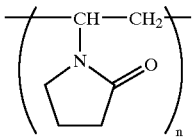

PVP are prepared by free-radical polymerization of 1-vinylpyrrolidone. Commercially available PVP have molar masses in the range from about 2 500 to 750 000 g/mol and are supplied as white, hygroscopic powders or as aqueous solutions.

In establishing the solubility kinetics of the second noncompressed part (b), preference is given to laundry detergent or cleaning product shaped bodies wherein at least the second noncompressed part (b) is surrounded by a material which is water-soluble at a pH below the pH of the earlier washing or cleaning cycle.

Particular preference is given here to laundry detergent or cleaning product shaped bodies in which the second noncompressed part (b) is coated with a material which protects the noncompressed part (b) at a pH above 11, preferably above 10 and in particular above 9, against dissolution during an earlier washing or cleaning cycle, particularly preferred laundry detergent and cleaning product shaped bodies being those wherein the coating does not protect the second noncompressed part (b) against dissolution at a pH below 6, preferably below 7 and in particular below 8.

The noncompressed shaped body parts are produced by processes known to the person skilled in the art, in which it is not necessary to have recourse to the use of high pressures. For the purposes of the present invention, "noncompressed" means "not prepared by tableting". According to the invention, pressures of more than 5 kN/cm$^2$, preferably of more than 2.5 kN/cm$^2$, particularly preferably of more than 1 kN/cm$^2$ and in particular of more than 0.1 kN/cm, should be avoided. End-products of processes in which particulate premixes are compacted using pressures above 5 kN/cm$^2$ by reducing the intra- and interparticular spaces to give shaped bodies are not, according to the invention, to be referred to as "noncompressed part". The use of lower pressures, for example for shaping shapeable masses or heaps of particles, without achieving a composite which sticks together by itself (a tablet), may, however, be advantageous in individual cases.

Particularly preferred preparation variants for noncompressed shaped body parts are sintering, casting, the hardening of shapeable masses, and the preparation of particles, e.g. by granulation, pelleting, extrusion, agglomeration etc.

Preferred laundry detergent or cleaning product shaped bodies according to the invention are those wherein the noncompressed part (a) has been prepared by sintering.

Sintering represents here the provision of an optionally preformed particle pile which, under the action of external conditions (temperature, radiation, reactive gases, liquids etc.), is converted into a compact shaped body part. Examples of sintering processes are the preparation, known from the prior art, of shaped bodies by microwaves or radiation hardening.

A further preferred sintering process for the preparation of noncompressed shaped body parts is reactive sintering. Here, the starting components are shaped and then solidified by reacting a component A and a component B together, the components A and B being mixed with the starting component, being applied thereto or being added after shaping.

As this process is being carried out, the components A and B react, with solidification of the individual ingredients with one another. The reaction product formed from the components A and B combines the individual starting components such that a solid, relatively fracture-stable shaped body is obtained.

Using this process, shaped bodies with good disintegration are obtained. Since the binding of the individual ingredient takes place by reactive sintering and is not brought about by the "stickiness" of the granulates of the premix, it is not necessary to adapt the formulation to the binding properties of the individual ingredient. These can be adapted as desired depending on their effectiveness.

In order to react the components A and B with one another, it has proven advantageous if the starting components are mixed with component A or are coated therewith before being shaped. Examples of compounds of component A are the alkali metal hydroxides, in particular NaOH and KOH, alkaline earth metal hydroxides, in particular $Ca(OH)_2$, alkali metal silicates, organic or inorganic acids, such as citric acid, or acidic salts, such as hydrogensulfate, anhydrous hydratable salts or salts containing water of hydration, such as sodium carbonate, acetates, sulfates, alkali metal metallates, it also being possible to use the compounds mentioned above, wherever possible, in the form of their aqueous solutions.

Component B is chosen such that it reacts with component A without exercising relatively high pressures or significantly increasing the temperature to form a solid, with solidification of the other starting components present. Examples of compounds of component A are $CO_2$, $NH_3$, water vapor or spray mist, salts containing water of hydration, which may react with the anhydrous salts present as component A as the result of hydrate migration, anhydrous salts which form hydrates which react with the salts of component A which contain water of hydration with hydrate migration, $SO_2$, $SO_3$, HCl, HBr, silicon halides, such as $SiCl_4$ or silicates $S(OR)_xR'_{4-x}$.

The abovementioned components A and B are interchangeable, provided two components are used which react together under sintering.

In a preferred embodiment of this preparation method, the starting components are mixed or coated with compounds of component A, and then the compounds of component B are added. It has proven particularly suitable if the compounds of component B are gaseous. The shaped starting components (referred to below as preforms) can then either be gassed in simple form or introduced into a gas atmosphere. A particularly preferred combination of components A and B are concentrated solutions of the alkali metal hydroxides, in particular NaOH and KOH, and alkaline earth metal hydroxides, such as $Ca(OH)_2$, or alkali metal silicates as component A, and $CO_2$ as component B.

To carry out the process according to the invention, the starting components are firstly shaped, i.e. they are usually poured into a die which has the outer shape of the shaped body to be produced. The starting components are preferably in pulverulent to granular form. They are firstly mixed or coated with component A. After being introduced into the die or tablet mold, it has proven preferable to slightly press down on the starting components in the die, e.g. using the hand or using a stamp at a pressure below the abovementioned values, in particular below 100 $N/cm^2$. It is also possible to compact the premix by vibration (tapping compaction).

They are then, if component A is not already present in the mixture with the starting components, coated therewith, and component B is added. When the reaction is complete, a fracture-stable shaped body is obtained without the action of pressure or temperature.

If one of the components A or B is a gas, then this can, for example, be added to a preform, such that the gas flows through it. This procedure permits a uniform hardening of the shaped bodies within a short time.

In a further preferred variant, a preform is introduced into an atmosphere of the reactive gas. This variant is easy to carry out. It is possible to prepare shaped bodies which have a high degree of hardness, i.e. shaped bodies which have only a hardened surface to shaped bodies which are completely hardened through.

A preform or the premix can also be reacted with the reactive gas under a pressure above atmospheric. This process variant has the advantage that the surface hardens rapidly to form a hard shell, the hardening process being stopped here or, as described above, completely hardened-through shaped bodies can also be produced by increasing hardening stages.

The above process variants can also be combined by firstly passing reactive gas through the preform in order to expel air. The preform is then exposed to a gas atmosphere at atmospheric pressure. As a result of the reaction between the gas and the second component, gas is automatically sucked into the preform.

In one possible embodiment of the present invention, it is not the starting mixture which is coated with the component A, but a preshaped preform, which is then reacted with the component B. It hardens the layer on the surface of the preform, while the loose or slightly compacted structure in the core is retained. Such shaped bodies are notable for particularly good disintegration behavior.

The individual noncompressed shaped body part can also be prepared by casting. This can be influenced either through the choice of the starting materials, or can be achieved by suspending the desired ingredients in a fusible matrix. Preferred laundry detergent or cleaning product shaped bodies are those wherein the noncompressed part (a) has been prepared by casting.

The solidification of solutions which are at ambient temperature is also a method of producing noncompressed parts. Aqueous solutions can be thickened according to processes known in the prior art up to firm-consistency shaped body ranges by adding thickeners. Examples of such thickeners which form solid gelatinous masses are alginates, pectins, gelatins etc. Accordingly, preference is also given to laundry detergent or cleaning product shaped bodies wherein the noncompressed part (a) has been prepared by solidification of solutions ("gelatinization").

Polymeric thickeners are preferably suitable for the preparation of gelatinous, shape-stable noncompressed parts of aqueous or nonaqueous solutions. These organic high molecular weight substances, also called swell(ing) agents, which absorb liquids, swell up as a result and finally convert to high-viscosity true or colloidal solutions, originate from the groups of natural polymers, modified natural polymers and completely synthetic polymers.

Polymers originating from nature which can be used as thickeners are, for example, agar agar, carrageen, tragacanth, gum arabic, alginates, pectins, polyoses, guar flour, carob seed grain flow, starch, dextrins, gelatin and casein.

Modified natural substances originate primarily from the group of modified starches and celluloses, examples which may be mentioned here being carboxymethylcellulose and other cellulose ethers, hydroxyethyl-cellulose and hydroxypropylcellulose, and seed grain ethers.

A large group of thickeners which are used widely in a very wide variety of fields of use are the completely synthetic polymers, such as polyacrylic and polymethacrylic compounds, vinyl polymers, polycarboxylic acids, polyethers, polyimines, polyamides and polyurethanes.

Thickeners from said classes of substance are widely available commercially and are obtainable, for example, under the trade names Acusol®-820 (methacrylic (stearyl alcohol 20-EO)ester/acrylic acid copolymer, 30% strength in water, Rohm & Haas), Dapral®-GT-282-S (alkyl polyglycol ether, Akzo), Deuterol®-Polymer-11 (dicarboxylic acid copolymer, Schöner GmbH), Deuteron®-XG (anionic heteropolysaccharide based on β-D-glucose, D-mannose, D-glucuronic acid, Schöner GmbH), Deuteron®-XN (nonionogenic polysaccharide, Schöner GmbH), Dicrylan®-Verdicker [thickener]-O (ethylene oxide adduct, 50% strength in water/isopropanol, Pfersee Chemie), EMA®-81 and EMA®-91 (ethylene/maleic anhydride copolymer, Monsanto), Verdicker [thickener]-QR-1001 (Polyurethane Emulsion 19–21% strength in water/diglycol ether, Rohm & Haas), Mirox®-AM (anionic acrylic acid/acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell), and Shellflo®-XA (xanthan biopolymer, stabilized with formaldehyde, Shell).

Preferred noncompressed parts (a) comprise, as thickeners, 0.2 to 4% by weight, preferably 0.3 to 3% by weight and in particular 0.4 to 1.5% by weight, of a polysaccharide.

A preferred polymeric thickener is xanthan, a microbial anionic heteropolysaccharide which is produced by Xanthomonas campestris and a few other species under aerobic conditions and have a molar mass of from 2 to 15 million daltons. Xanthan is formed from a chain having β-1,4-bonded glucose (cellulose) with side chains. The structure of the subgroups consists of glucose, mannose, glucuronic acid, acetate and pyruvate, the number of pyruvate units determining the viscosity of the xanthan.

Xanthan can be described by the following formula:

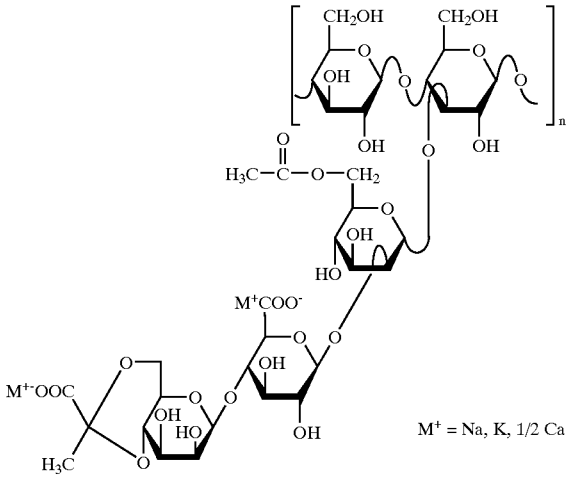

Basic unit of xanthan

Preferred noncompressed parts (a) contain, as thickeners, in each case based on the total composition, 0.2 to 4% by weight, preferably 0.3 to 3% by weight and in particular 0.4 to 1.5% by weight, of xanthan.

Further suitable thickeners are polyurethanes or modified polyacrylates which are usually used, based on the total noncompressed part, in amounts of from 0.2 to 5% by weight.

Polyurethanes (PUR) are prepared by polyaddition from di- and polyhydric alcohols and isocyanates and can be described by the general formula III:

$$[-O-R^1-O-\underset{\underset{O}{\|}}{C}-NH-R^2-NH-\underset{\underset{O}{\|}}{C}-]_n, \quad \text{(III)}$$

in which $R^1$ is a low molecular weight or polymeric diol radical, $R^2$ is an aliphatic or aromatic group and n is a natural number. $R^1$ is preferably a linear or branched $C_{1-12}$-alk(en)yl group, but can also be a radical of a polyhydric alcohol, as a result of which crosslinked polyurethanes are formed which differ from the formula (III) given above by virtue of the fact that further —O—CO—NH groups are bonded to the radical $R^1$.

Industrially important PUR are prepared from polyesterdiols and/or polyetherdiols and, for example, from 2,4- or 2,6-toluene diisocyanate (TDI, $R^2=C_6H_3—CH_3$), 4,4'-methylenedi(phenyl isocyanate) (MDI, $R^2=C_6H_4—CH_2—C_6H_4$) or hexamethylene diisocyanate [HMDI, $R^2=(CH_2)_6$].

Commercially available thickeners based on polyurethane are obtainable, for example, under the names Acrysol®PM 12 V (mixture of 3–5% modified starch and 14–16% PUR resin in water, Rohm & Haas), Borchigel® L75-N (nonionogenic PUR dispersion, 50% strength in water, Borchers), Coatex® BR-100-P (PUR dispersion, 50% strength in water/butyl glycol, Dimed), Nopco® DSX-1514

(PUR dispersion, 40% strength in water/butyl triglycol, Henkel-Nopco), Verdicker [thickener] QR 1001 (20% strength PUR emulsion in water/diglycol ether, Rohm & Haas) and Rilanit® VPW-3116 (PUR dispersion, 43% strength in water, Henkel).

Preferred noncompressed parts (a) comprise 0.2 to 4% by weight, preferably 0.3 to 3% by weight and in particular 0.5 to 1.5% by weight, of a polyurethane.

Modified polyacrylates which can be used for the purposes of the present invention are derived, for example, from acrylic acid or from methacrylic acid and can be described by the general formula IV (IV)

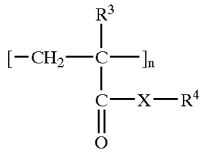

in which $R^3$ is H or a branched or unbranched $C_{1-4}$-alk(en)yl radical, X is N—$R^5$ or O, $R^4$ is an optionally alkoxylated branched or unbranched, optionally substituted $C_{8-22}$-alk(en)yl radical, $R^5$ is H or $R^4$ and n is a natural number. In general, such modified polyacrylates are esters or amides of acrylic acid or of an α-substituted acrylic acid. Of these polymers, preference is given to those in which $R^3$ is H or a methyl group. In the case of the polyacrylamides (X=N—$R^5$), both mono-N-substituted ($R^5$=H) and also di-N-substituted ($R^5$=$R^4$) amide structures are possible, it being possible to choose the two hydrocarbon radicals which are boned to the N atom independently of one another from optionally alkoxylated branched or unbranched $C_{8-22}$-alk(en)yl radicals. Of the polyacrylic esters (X=O), preference is given to those in which the alcohol has been obtained from natural or synthetic fats or oils and has additionally been alkoxylated, preferably ethoxylated. Preferred degrees of alkoxylation are between 2 and 30, particular preference being given to degrees of alkoxylation between 10 and 15.

Since the polymers which can be used are technical-grade compounds, the designation of the radicals bonded to X is a statistical average which can vary in individual cases with regard to chain length and degree of alkoxylation. Formula II merely indicates formulae for idealized homopolymers. However, for the purposes of the present invention, it is also possible to use copolymers in which the part of monomer units which satisfy the formula II is at least 30% by weight. Thus, for example, it is also possible to use copolymers of modified polyacrylates and acrylic acid or salts thereof which still have acidic H atoms or basic —$COO^-$groups.

Modified polyacrylates which are preferred for the purposes of the present invention are polyacrylate/polymethacrylate copolymers which satisfy the formula IVa:

(IVa)

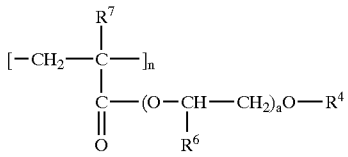

in which $R^4$ is a preferably unbranched, saturated or unsaturated $C_{8-22}$-alk(en)yl radical, $R^6$ and $R^7$ independently of one another are H or $CH_3$, the degree of polymerization n is a natural number and the degree of alkoxylation a is a natural number between 2 and 30, preferably between 10 and 20. $R^4$ is preferably a fatty alcohol radical which has been obtained from natural or synthetic sources, the fatty alcohol in turn preferably being ethoxylated (R=H).

Products of the formula IVa are commercially available, for example under the name Acusol® 820 (Rohm & Haas) in the form of 30% strength by weight dispersions in water. In the case of said commercial product, $R^4$ is a stearyl radical, $R^6$ is a hydrogen atom, $R^7$ is H or $CH_3$ and the degree of ethoxylation a is 20.

Preferred noncompressed parts (a) comprise, based on the total composition, 0.2 to 4% by weight, preferably 0.3 to 3% by weight and in particular 0.5 to 1.5% by weight of a modified polyacrylate of the formula IV.

In a further preferred embodiment of the present invention, the noncompressed shaped body part (a) is produced by hardening reshapable masses which have been converted to the desired shape beforehand by shaping processes. Laundry detergent and cleaning product shaped bodies in which the noncompressed part (a) has been prepared by hardening are, accordingly, likewise preferred.

The hardening of the shapeable mass(es) can be carried out by a variety of mechanisms, delayed water-binding, cooling below the melting point, evaporation of solvents, crystallization, chemical reaction(s), in particular polymerization, and changing the rheological properties e.g. as a result of a changed shearing of the mass(es) being stated as the most important hardening mechanisms in addition to the already mentioned radiation hardening by UV, alpha, beta or gamma rays or microwaves.

In this preferred embodiment, a shapeable, preferably plastic, mass is prepared which can be shaped without considerable pressures. Following the shaping, the hardening is then carried out by suitable initiation or by waiting for a certain period. If masses which have self-hardening properties without further initiation are processed, then this is to be taken into consideration during processing in order to avoid instances of complete hardening during shaping and, consequently, blockages and disruptions to the process sequences.

In laundry detergent or cleaning product shaped bodies preferred for the purposes of the present invention, the complete hardening of the noncompressed part (a) takes place by means of time-delayed water-binding.

Time-delayed water-binding in the masses can in turn be realized in different ways. Appropriate here are, for example, masses which comprise hydratable, anhydrous raw materials or raw materials in low states of hydration which are able to undergo transition to stable higher hydrates, and also water. The formation of the hydrates, which does not take place spontaneously, then leads to the binding of free water, which in turn leads to a hardening of the masses. Low-pressure shaping is subsequently no longer possible, and the shaped bodies formed are stable to handling and may be treated further and/or packaged.

The time-offset water-binding may, for example, also take place by incorporating salts containing water of hydration, which when the temperature is increased dissolve in their own water of crystallization, into the masses. If the temperature subsequently drops, then the water of crystallization is bound again, leading to a loss of the shapeability by simple means and to a solidification of the masses.

The swelling of natural or synthetic polymers is also a time-delayed water-binding mechanism which can be used for the purposes of the process according to the invention. Here, mixtures of unswollen polymer and suitable swelling agent, e.g. water, diols, glycerol etc., can be incorporated into the masses, with swelling and hardening taking place after shaping.

The most important mechanism of hardening by time-delayed water-binding is the use of a combination of water and anhydrous or low-water raw materials which slowly hydrate. Particularly appropriate for this purpose are substances which contribute to the washing performance in the washing or cleaning process. Ingredients of the shapeable masses preferred for the purposes of the present invention are, for example, phosphates, carbonates, silicates and zeolites.

It is particularly preferred if the resulting hydrate forms have low melting points since in this way a combination of the hardening mechanisms by internal drying and cooling is achieved. Preferred processes are those wherein the shapeable mass(es) comprise(s) 10 to 95% by weight, preferably 15 to 90% by weight, particularly preferably 20 to 85% by weight and in particular 25 to 80% by weight, of anhydrous substances which convert, as a result of hydration, to a hydrate form having a melting point below 120° C., preferably below 100° C. and in particular below 80° C.

The shapeable properties of the masses may be influenced by adding plasticizers, such as polyethylene glycols, polypropylene glycols, waxes, paraffins, nonionic surfactants etc. Further details of said classes of substances are given below.

A further mechanism for hardening the masses processed in the process according to the invention is cooling during the processing of the masses above their softening point. Processes in which the hardening of the shapeable mass(es) by cooling below the melting point are, accordingly, preferred.

Masses which can be softened under the effect of temperature can be formulated easily by mixing the desired further ingredients with a meltable or softenable substance, and heating the mixture to temperatures within the softening range of this substance and shaping the mixture at these temperatures. Particular preference is given here to using waxes, paraffins, polyalkylene glycols etc. as meltable or softenable substances. These are described below.

The meltable or softenable substances should have a melting range (solidification range) within a temperature range in which the other ingredients of the masses to be processed are not subjected to excessive thermal stress. On the other hand, however, the melting range must be sufficiently high still to provide a handlable shaped body at at least slightly elevated temperature. In masses preferred according to the invention, the meltable or softenable substances have a melting point above 30° C.

It has proven advantageous if the meltable or softenable substances do not exhibit a sharply defined melting point, as usually occurs in the case of pure, crystalline substances, but instead have a melting range which covers, under certain circumstances, several degrees Celsius. The meltable or softenable substances preferably have a melting range between about 45° C. and about 75° C. In the present case, this means that the melting range is within the given temperature interval, and does not define the width of the melting range. The width of the melting range is preferably at least 1° C., preferably about 2 to about 3° C.

The abovementioned properties are usually satisfied by so-called waxes. "Waxes" is understood as meaning a series of natural or artificially obtained substances which generally melt above 40° C. without decomposition, and are of relatively low-viscosity and are non-stringing at just a little above the melting point. They have a highly temperature-dependent consistency and solubility.

According to their origin, the waxes are divided into three groups: natural waxes, chemically modified waxes and synthetic waxes.

Natural waxes include, for example, plant waxes, such as candelilla wax, carnauba wax, Japan wax, esparto grass wax, cork wax, guaruma wax, rice germ oil wax, sugarcane wax, ouricury wax, or montan wax, animal waxes, such as beeswax, shellac wax, spermaceti, lanolin (wool wax), or uropygial grease, mineral waxes, such as ceresin or ozokerite (earth wax), or petrochemical waxes, such as petrolatum, paraffin waxes or microcrystalline waxes.

Chemically modified waxes include, for example, hard waxes, such as montan ester waxes, sassol waxes or hydrogenated jojoba waxes.

Synthetic waxes are generally understood as meaning polyalkylene waxes or polyalkylene glycol waxes. Meltable or softenable substances which can be used for the masses hardenable by cooling are also compounds from other classes of substance which satisfy said requirements with regard to the softening point. Synthetic compounds which have proven suitable are, for example, higher esters of phthalic acid, in particular dicylcohexyl phthalate, which is commercially available under the name Unimoll® 66 (Bayer AG). Also suitable are synthetically prepared waxes from lower carboxylic acids and fatty alcohols, for example dimyristyl tartrate, which is available under the name Cosmacol® ETLP (Condea). Conversely, synthetic or partially synthetic esters of lower alcohols with fatty acids from native sources may also be used. This class of substance includes, for example, Tegin® 90 (Goldschmidt), a glycerol monostearate palmitate. Shellac, for example Shellack-KPS-Dreiring-SP (Kalkhoff GmbH) can also be used according to the invention as meltable or softenable substances.

Also covered by waxes for the purposes of the present invention are, for example, so-called wax alcohols. Wax alcohols are relatively high molecular weight, water-insoluble fatty alcohols having on average about 22 to 40 carbon atoms. The wax alcohols occur, for example, in the form of wax esters of relatively high molecular weight fatty acids (wax acids) as the major constituent of many natural waxes. Examples of wax alcohols are lignoceryl alcohol (1-tetracosanol), cetyl alcohol, myristyl alcohol or melissyl alcohol. The coating of the solid particles coated in accordance with the invention can optionally also comprise wool wax alcohols, which is understood as meaning triterpenoid and steroid alcohols, for example lanolin, which is available, for example, under the trade name Argowax® (Pamentier & Co). As a constituent of the meltable or softenable substances, it is also possible to use, at least propartately, for the purposes of the present invention, fatty acid glycerol esters or fatty acid alkanolamides, but also, if desired, water-insoluble or only sparingly water-soluble polyalkylene glycol compounds.

Particularly preferred meltable or softenable substances in the masses to be processed are those from the group of polyethylene glycols (PEG) and/or polypropylene glycols (PPG), preference being given to polyethylene glycols having molar masses between 1 500 and 36 000, particular preference being given to those having molar masses from 2 000 to 6 000 and special preference being given to those having molar masses from 3 000 to 5 000. Corresponding processes which are notable for the fact that the plastically shapeable mass(es) comprise(s) at least one substance from the group of polyethylene glycols (PEG) and/or polypropylene glycols (PPG) are also preferred. Here, particular preference is given to masses to be processed according to the invention which contain, as the sole meltable or softenable substances, propylene glycols (PPG) and/or polyethylene glycols (PEG). These substances have been described in detail above.

In a further preferred embodiment, the masses to be processed according to the invention comprise paraffin wax as the major fraction. This means that at least 50% by weight of the total meltable or softenable substances present, preferably more, consist of paraffin wax. Particularly suitable paraffin wax contents (based on the total amount of meltable or softenable substances) are about 60% by weight, about 70% by weight or about 80% by weight, particular preference being given to even higher proparts of, for example, more than 90% by weight. In a particular embodiment of the invention, the total amount of the meltable or softenable substances at least of one mass consists exclusively of paraffin wax.

Compared with the other natural waxes mentioned, paraffin waxes have the advantage for the purposes of the present invention that in an alkaline cleaning product environment no hydrolysis of the waxes takes place (as is to be expected, for example, in the case of wax esters), since paraffin wax does not contain hydrolyzable groups.

Paraffin waxes consist primarily of alkanes, and low fractions of iso- and cycloalkanes. The paraffin to be used according to the invention preferably essentially has no constituents having a melting point of more than 70° C., particularly preferably of more than 60° C. Below this melting temperature in the cleaning product liquor, fractions of high-melting alkanes in the paraffin may leave behind undesired wax residues on the surfaces to be cleaned or on the ware to be cleaned. Such wax residues generally lead to an unattractive appearance of the cleaned surface and should therefore be avoided.

Preferred masses to be processed comprise, as meltable or softenable substances, at least one paraffin wax having a melting range from 50° C to 60° C, preferred processes being those wherein the shapeable mass(es) comprise(s) a paraffin wax having a melting range of from 50° C. to 55° C.

Preferably, the content of alkanes, isoalkanes and cycloalkanes which are solid at ambient temperature (generally about 10 to about 30° C.) in the paraffin wax used is as high as possible. The larger the amount of solid wax constituents in a wax at room temperature, the more useful the wax for the purposes of the present invention. As the propart of solid wax constituents increases, so does the resistance of the process end-products toward impacts or friction on other surfaces, resulting in relatively long-lasting protection. High proparts of oils or liquid wax constituents can lead to a weakening of the shaped bodies or shaped body regions, as a result of which pores are opened and the active substances are exposed to the ambient influences mentioned at the beginning.

As well as comprising paraffin as the main constituent, the meltable or softenable substances may also comprise one or more of the abovementioned waxes or wax-like substances. In a further preferred embodiment of the present invention, the mixture forming the meltable or softenable substances should be such that the mass and the shaped bodies or shaped body constituent formed therefrom are at least largely water-insoluble. At a temperature of about 30° C., the solubility in water should not exceed about 10 mg/l and should preferably be below 5 mg/l.

In such cases, however, the meltable or softenable substances should have the lowest possible solubility in water, even in water at elevated temperature, in order, as far as possible, to avoid temperature-dependent release of the active substances.

The principle described above is used for the delayed release of ingredients at a particular timepoint in the cleaning operation and can be used particularly advantageously if rinsing is carried out in the main rinse cycle at a relatively low temperature (for example 55° C.), so that the active substance is only released from the rinse aid particles in the rinse cycle at higher temperatures (approximately 70° C.).

Preferred masses to be processed according to the invention are those which comprise, as meltable or softenable substances, one or more substances having a melting range of from 40° C. to 75° C. in amounts of from 6 to 30% by weight, preferably from 7.5 to 25% by weight and in particular from 10 to 20% by weight, in each case based on the weight of the mass.

A further mechanism by which the hardening of the masses can take place is the evaporation of solvents. For this, it is possible to prepare solutions or dispersions of the desired ingredients in one or more suitable, readily volatile solvents which give off this/these solvent(s) after the shaping step and, in so doing, harden. Appropriate solvents are, for example, lower alkanols, aldehydes, ethers, esters etc, which are chosen depending on the further composition of the masses to be processed. Particularly suitable solvents for such processes in which the shapeable mass(es) harden(s) by evaporation of solvents are ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol; 3-methyl-2-butanol, 2-methyl-2-butanol, 2-methyl-1-butanol, 1-hexanol, and the acetic esters of the above alcohols, in particular ethyl acetate.

The evaporation of the abovementioned solvents may be accelerated by heating after shaping, or by air movement. Combinations of the measures specified are also suitable for this purpose, for example, the blowing of the cut-to-length shaped bodies with warm or hot air.

A further mechanism which may form the basis for the hardening of the masses shaped to shaped body parts (a) is that of crystallization. Processes wherein the shapeable mass(es) harden(s) by crystallization are likewise preferred.

Crystallization, as a mechanism on which the hardening is based, may be utilized by using, for example, melts of crystalline substances as the basis of one or more shapable masses. Following processing, systems of this kind undergo transition to a higher state of order, which in turn leads to hardening of the overall shaped body formed. Alternatively, crystallization may take place by crystallization from supersaturated solution. In the context of the present invention, supersaturation refers to a metastable state in which, in a closed system, more of one substance is present than is required for saturation. A supersaturated solution obtained, for example, by supercooling accordingly comprises more dissolved substance than it should contain in thermal equilibrium. The excess of dissolved substance may be brought to instantaneous crystallization by seeding with seed crystals or dust particles or by agitating the system. In the context of the present invention, the term "supersaturated" always refers to a temperature of 20° C. If x grams of a substance per liter dissolve in a defined solvent at a temperature of 20° C., then the solution, in the context of the present invention, may be referred to as "supersaturated" if it contains (x+y) grams of the substance per liter, y being >0. Consequently, in the context of the present invention, solutions referred to as "supersaturated" include those which at an elevated temperature are used as the basis of a mass to be processed and are processed at this temperature, in which more dissolved substance is present in the solution than would dissolve in the same amount of solvent at 20° C.

The term "solubility" is understood by the present invention as meaning the maximum amount of a substance which the solvent is able to accommodate at a certain temperature, i.e., the fraction of the dissolved substance in a solution saturated at the temperature in question. Where a solution contains more dissolved substance than it should contain in thermodynamic equilibrium at a given temperature (for example, in the case of supercooling), it is referred to as supersaturated. By seeding with seed crystals it is possible to cause the excess to precipitate as a sediment in the solution, which is now just saturated. A solution saturated in respect of a substance may, however, also dissolve other substances (for example, it is still possible to dissolve sugar in a saturated solution of common salt).

The state of supersaturation can be achieved, as described above, by slow cooling or by supercooling a solution, provided the dissolved substance is more soluble in the solvent at higher temperatures. Other ways of obtaining supersaturated solutions are, for example, the combination of two solutions whose ingredients react to form another substance which does not immediately precipitate out (hindered or retarded precipitation reactions). The latter mechanism is particularly suitable as a basis for the formation of masses for processing in accordance with the invention.

In principle, the state of supersaturation is achievable in any kind of solution, although the use of the principle described in the present specification finds its application, as already mentioned, in the production of laundry detergents and cleaning products. Accordingly, some systems, which in principle tend to form supersaturated solutions, are less suitable for use in accordance with the invention, since the substance systems on which they are based cannot be used, on ecological, toxicological, or economic grounds. In addition to nonionic surfactants or common nonaqueous solvents, therefore, particular preference is given to processes according to the invention with the last-mentioned hardening mechanism wherein a supersaturated aqueous solution is used as the basis of at least one mass to be processed.

As already mentioned above, the state of supersaturation in the context of the present invention refers to the saturated solution at 20° C. By using solutions which have a temperature above 20° C. it is easy to attain the state of supersaturation. Processes according to the invention wherein the crystallization-hardening mass during processing has a temperature of between 35 and 120° C., preferably between 40 and 110° C., particularly preferably between 45 and 90° C., and in particular between 50 and 80° C., are preferred in the context of the present invention.

Since the laundry detergent and cleaning product shaped bodies produced are generally neither stored at elevated temperatures nor later used at these elevated temperatures, the cooling of the mixture leads to the precipitation from the supersaturated solution of the fraction of dissolved substance which was present in the solution above the saturation limit at 20° C. Thus, on cooling, the supersaturated solution may be divided into a saturated solution and a sediment. It is, however, also possible that, owing to recrystallization and hydration phenomena, the supersaturated solution solidifies on cooling to form a solid. This is the case, for example, if certain salts containing water of hydration dissolve in their water of crystallization on heating. In this case, supersaturated solutions are often formed on cooling which, by mechanical action or addition of seed crystal solidify to a solid —the salt, containing water of crystallization, as the state which is thermodynamically stable at room temperature. This phenomenon is known, for example, for sodium thiosulfate pentahydrate and sodium acetate trihydrate, the latter salt in particular, containing water of hydration, being advantageously useful in the form of the supersaturated solution in the process according to the invention. Specific laundry detergent and cleaning product ingredients as well, such as phosphonates, for example, display this phenomenon and are outstandingly suitable in the form of the solutions as granulation auxiliaries. For this purpose the corresponding phosphonic acids (see below) are neutralized with concentrated alkali metal hydroxide solutions, the solution being heated by the heat of neutralization. On cooling, these solutions form solids of the corresponding alkali metal phosphonates. By incorporating further laundry detergent and cleaning product ingredients into the solutions while still warm, it is possible in accordance with the invention to prepare processable masses of different composition. Particularly preferred processes according to the invention are those wherein the supersaturated solution used as a basis of the hardening mass solidifies at room temperature to form a solid. It is preferred in this case that the formerly supersaturated solution, following solidification to form a solid, cannot be converted back into a supersaturated solution by heating to the temperature at which the supersaturated solution was formed. This is the case, for example, with the phosphonates mentioned.

As mentioned above, the supersaturated solution used as a basis of the hardening mass may be obtained in a number of ways and then processed in accordance with the invention following optional admixing of further ingredients. One simple way, for example, is to prepare the supersaturated solution which is used as a basis of the hardening mass by dissolving the dissolved substance in heated solvent. If the amounts of the dissolved substance that are dissolved in this way in the heated solvent are higher than those which would dissolve at 20° C., then a solution is present which is supersaturated within the meaning of the present invention and which, either hot (see above) or after cooling, and in the metastable state, may be introduced into the mixer.

It is also possible to remove the water from salts containing water of hydration by "dry" heating and to dissolve them in their own water of crystallization (see above). This too is a method of preparing super-saturated solutions that may be used in the context of the present invention.

Another way is to add a gas or other fluid or solution to a non-supersaturated solution, so that the dissolved substance reacts in the solution to form a less soluble substance or dissolves to a lesser extent in the mixture of the solvents. The combination of two solutions each containing two substances which react with one another to form a less soluble substance is likewise a method of preparing supersaturated solutions, provided the less-soluble substance does not precipitate out instantaneously. Processes which are likewise preferred in the context of the present invention are those wherein the supersaturated solution used as the basis of the hardening mass is prepared by combining two or more solutions. Examples of such ways of preparing supersaturated solutions are dealt with below.

Preferred processes according to the invention are those wherein the supersaturated aqueous solution is obtained by combining an aqueous solution of one or more acidic ingredients of laundry detergents and cleaning products, preferably from the group of the surfactant acids, the builder acids, and the complexing agent acids, and an aqueous alkali solution, preferably an aqueous alkali metal hydroxide solution, in particular an aqueous sodium hydroxide solution.

Among the representatives of said classes of compound that have already been mentioned above, the phosphonates in particular occupy an outstanding position in the context of the present invention. In preferred processes according to the invention, therefore, the supersaturated aqueous solution is obtained by combining an aqueous phosphonic acid solution with concentrations above 45% by weight, preferably above 50% by weight, and in particular above 55% by weight, based in each case on the phosphonic acid solution, and an aqueous sodium hydroxide solution with concentrations above 35% by weight, preferably above 40% by weight, and in particular above 45% by weight, based in each case on the sodium hydroxide solution.

The hardening of the shapeable mass(es) may, in accordance with the invention, also take place by means of chemical reaction(s), in particular polymerization. Suitable in this context, in principle, are all chemical reactions which, starting from one or more liquid to paste-like substances, lead, by reaction with (an) other substance(s), to solids. Especially suitable in this context are chemical reactions which do not lead suddenly to said change of state. From the multitude of chemical reactions which lead to solidification phenomena, suitable reactions are in particular those in which larger molecules are built up from smaller molecules. These reactions include, in turn, preferably reactions in which many small molecules react to form (one) larger molecule(s). These are so-called polyreactions (polymerization, polyaddition, polycondensation) and polymer-analogous reactions. The corresponding polymers, polyadducts (polyaddition products) or polycondensates (polycondensation products) then give the finished, cut-to-length shaped body its strength.

In view of the intended use of the products prepared in accordance with the invention it is preferred to utilize as hardening mechanism the formation of those solid substances from liquid or paste-like starting materials which are in any case to be used in the laundry detergent and cleaning product as ingredients, for example cobuilders, soil repellents, and soil release polymers. Such cobuilders may originate, for example, from the groups of the polycarboxylates/polycarboxylic acids, polymeric polycarboxylates, aspartic acid, polyacetals, dextrins etc. These classes of substance are described below.

A further mechanism by which the shapeable mass(es) may harden in the context of the present invention is that of hardening as a result of a change in rheological properties.

In this case, use is made of the property possessed by certain substances of changing—in some instances, drastically—their rheological properties under the action of shear forces. Examples of such systems, which are familiar to the person skilled in the art, are phyllosilicates, for example, which under shearing have a highly thickening action in appropriate matrices and may lead to masses of firm consistency.

It is of course possible for two or more hardening mechanisms to be combined with one another and/or used simultaneously in one mass. Appropriate in this case, for example, are crystallization with simultaneous solvent evaporation, cooling with simultaneous crystallization, water-binding ("internal drying") with simultaneous external drying, etc.

The noncompressed part (b) can also be prepared analogously to the preparation of the noncompressed part (a). Thus, preference is given here to laundry detergent or cleaning product shaped bodies in which the noncompressed part (b) has been prepared by sintering, and preference is likewise given to laundry detergent or cleaning product shaped bodies in which the noncompressed part (b) has been prepared by casting.

Laundry detergent or cleaning product shaped bodies wherein the noncompressed part (b) has been prepared by solidification of solutions ("gelatinization"), or laundry detergent or cleaning product shaped bodies in which the noncompressed part (b) has been prepared by hardening, are preferred embodiments of the present invention.

Last but not least, it is also possible to prepare laundry detergent or cleaning product shaped bodies in which the noncompressed part (b) is particulate. Details on this are given below.

For two-phase shaped bodies, there are therefore a multitude of possibilities according to the invention, depending on whether the parts (a) and (b) are prepared in different ways or in the same way. An overview of the genesis of the noncompressed shaped body parts (a) and (b) for a shaped body according to the invention comprising two regions/constituents is given in the table below, which can be expanded accordingly to three-phase, four-phase, five-phase, etc., shaped bodies.

| Noncompressed part (a) | Noncompressed part (b) |
|---|---|
| sintered | sintered |
| sintered | thermally sintered |
| sintered | sintered by irradiation |
| sintered | sintered by chemical reaction |
| sintered | cast |
| sintered | gelatinous |
| sintered | hardened |
| sintered | hardened by time-delayed water-binding |
| sintered | hardened by cooling below the melting point |
| sintered | hardened by evaporation of solvents |
| sintered | hardened by crystallization |
| sintered | hardened by chemical reaction(s), in particular polymerization |
| sintered | hardened by changing the rheological properties |
| sintered | particulate |
| sintered | particulate, attached using adhesion promoter |
| thermally sintered | sintered |
| thermally sintered | thermally sintered |
| thermally sintered | sintered by irradiation |
| thermally sintered | sintered by chemical reaction |
| thermally sintered | cast |
| thermally sintered | gelatinous |
| thermally sintered | hardened |
| thermally sintered | hardened by time-delayed water-binding |
| thermally sintered | hardened by cooling below the melting point |
| thermally sintered | hardened by evaporation of solvents |
| thermally sintered | hardened by crystallization |
| thermally sintered | hardened by chemical reaction(s), in particular polymerization |
| thermally sintered | hardened by changing the rheological properties |
| thermally sintered | particulate |
| thermally sintered | particulate, attached using adhesion promoter |
| sintered by irradiation | sintered |
| sintered by irradiation | thermally sintered |
| sintered by irradiation | sintered by irradiation |
| sintered by irradiation | sintered by chemical reaction |
| sintered by irradiation | cast |
| sintered by irradiation | gelatinous |
| sintered by irradiation | hardened |
| sintered by irradiation | hardened by time-delayed |

-continued

| Noncompressed part (a) | Noncompressed part (b) |
|---|---|
| | water-binding |
| sintered by irradiation | hardened by cooling below the melting point |
| sintered by irradiation | hardened by evaporation of solvents |
| sintered by irradiation | hardened by crystallization |
| sintered by irradiation | hardened by chemical reaction(s), in particular polymerization |
| sintered by irradiation | hardened by changing the rheological properties |
| sintered by irradiation | particulate |
| sintered by irradiation | particulate, attached using adhesion promoter |
| sintered by chemical reaction | sintered |
| sintered by chemical reaction | thermally sintered |
| sintered by chemical reaction | sintered by irradiation |
| sintered by chemical reaction | sintered by chemical reaction |
| sintered by chemical reaction | cast |
| sintered by chemical reaction | gelatinous |
| sintered by chemical reaction | hardened |
| sintered by chemical reaction | hardened by time-delayed water-binding |
| sintered by chemical reaction | hardened by cooling below the melting point |
| sintered by chemical reaction | hardened by evaporation of solvents |
| sintered by chemical reaction | hardened by crystallization |
| sintered by chemical reaction | hardened by chemical reaction(s), in particular polymerization |
| sintered by chemical reaction | hardened by changing the rheological properties |
| sintered by chemical reaction | particulate |
| sintered by chemical reaction | particulate, attached using adhesion promoter |
| cast | sintered |
| cast | thermally sintered |
| cast | sintered by irradiation |
| cast | sintered by chemical reaction |
| cast | cast |
| cast | gelatinous |
| cast | hardened |
| cast | hardened by time-delayed water-binding |
| cast | hardened by cooling below the melting point |
| cast | hardened by evaporation of solvents |
| cast | hardened by crystallization |
| cast | hardened by chemical reaction(s), in particular polymerization |
| cast | hardened by changing the rheological properties |
| cast | particulate |
| cast | particulate, attached using adhesion promoter |
| gelatinous | sintered |
| gelatinous | thermally sintered |
| gelatinous | sintered by irradiation |
| gelatinous | sintered by chemical reaction |
| gelatinous | cast |
| gelatinous | gelatinous |
| gelatinous | hardened |
| gelatinous | hardened by time-delayed water-binding |
| gelatinous | hardened by cooling below the melting point |
| gelatinous | hardened by evaporation of solvents |
| gelatinous | hardened by crystallization |
| gelatinous | hardened by chemical reaction(s), in particular polymerization |
| gelatinous | hardened by changing the rheological properties |
| gelatinous | particulate |
| gelatinous | particulate, attached using adhesion promoter |
| hardened | sintered |
| hardened | thermally sintered |
| hardened | sintered by irradiation |
| hardened | sintered by chemical reaction |
| hardened | cast |
| hardened | gelatinous |
| hardened | hardened |
| hardened | hardened by time-delayed water-binding |
| hardened | hardened by cooling below the melting point |
| hardened | hardened by evaporation of solvents |
| hardened | hardened by crystallization |
| hardened | hardened by chemical reaction(s), in particular polymerization |
| hardened | hardened by changing the rheological properties |
| hardened | particulate |
| hardened | particulate, attached using adhesion promoter |
| hardened by time-delayed water-binding | sintered |
| hardened by time-delayed water-binding | thermally sintered |
| hardened by time-delayed water-binding | sintered by irradiation |
| hardened by time-delayed water-binding | sintered by chemical reaction |
| hardened by time-delayed water-binding | cast |
| hardened by time-delayed water-binding | gelatinous |
| hardened by time-delayed water-binding | hardened |
| hardened by time-delayed water-binding | hardened by time-delayed water-binding |
| hardened by time-delayed water-binding | hardened by cooling below the melting point |
| hardened by time-delayed water-binding | hardened by evaporation of solvents |
| hardened by time-delayed water-binding | hardened by crystallization |
| hardened by time-delayed water-binding | hardened by chemical reaction(s), in particular polymerization |
| hardened by time-delayed water-binding | hardened by changing the rheological properties |
| hardened by time-delayed water-binding | particulate |
| hardened by time-delayed water-binding | particulate, attached using adhesion promoter |
| hardened by cooling below the melting point | sintered |
| hardened by cooling below the melting point | thermally sintered |
| hardened by cooling below the melting point | sintered by irradiation |
| hardened by cooling below the melting point | sintered by chemical |
| hardened by cooling below | cast |

-continued

| Noncompressed part (a) | Noncompressed part (b) |
|---|---|
| the melting point | |
| hardened by cooling below the melting point | gelatinous |
| hardened by cooling below the melting point | hardened |
| hardened by cooling below the melting point | hardened by time-delayed water-binding |
| hardened by cooling below the melting point | hardened by cooling below the melting point |
| hardened by cooling below the melting point | hardened by evaporation of solvents |
| hardened by cooling below the melting point | hardened by crystallization |
| hardened by cooling below the melting point | hardened by chemical reaction(s), in particular polymerization |
| hardened by cooling below the melting point | hardened by changing the rheological properties |
| hardened by cooling below the melting point | particulate |
| hardened by cooling below the melting point | particulate, attached using adhesion promoter |
| hardened by evaporation of solvents | sintered |
| hardened by evaporation of solvents | thermally sintered |
| hardened by evaporation of solvents | sintered by irradiation |
| hardened by evaporation of solvents | sintered by chemical reaction |
| hardened by evaporation of solvents | cast |
| hardened by evaporation of solvents | gelatinous |
| hardened by evaporation of solvents | hardened |
| hardened by evaporation of solvents | hardened by time-delayed water-binding |
| hardened by evaporation of solvents | hardened by cooling below the melting point |
| hardened by evaporation of solvents | hardened by evaporation of solvents |
| hardened by evaporation of solvents | hardened by crystallization |
| hardened by evaporation of solvents | hardened by chemical reaction(s), in particular polymerization |
| hardened by evaporation of solvents | hardened by changing the rheological properties |
| hardened by evaporation of solvents | particulate |
| hardened by evaporation of solvents | particulate, attached using adhesion promoter |
| hardened by crystallization | sintered |
| hardened by crystallization | thermally sintered |
| hardened by crystallization | sintered by irradiation |
| hardened by crystallization | sintered by chemical reaction |
| hardened by crystallization | cast |
| hardened by crystallization | gelatinous |
| hardened by crystallization | hardened |
| hardened by crystallization | hardened by time-delayed water-binding |
| hardened by crystallization | hardened by cooling below the melting point |
| hardened by crystallization | hardened by evaporation of solvents |
| hardened by crystallization | hardened by crystallization |
| hardened by crystallization | hardened by chemical reaction(s), in particular polymerization |
| hardened by crystallization | hardened by changing the rheological properties |
| hardened by crystallization | particulate |
| hardened by crystallization | particulate, attached using adhesion promoter |
| hardened by chemical | sintered |

-continued

| Noncompressed part (a) | Noncompressed part (b) |
|---|---|
| reaction(s), in particular polymerization | |
| hardened by chemical reaction(s), in particular polymerization | thermally sintered |
| hardened by chemical reaction(s), in particular polymerization | sintered by irradiation |
| hardened by chemical reaction(s), in particular polymerization | sintered by chemical reaction |
| hardened by chemical reaction(s), in particular polymerization | cast |
| hardened by chemical reaction(s), in particular polymerization | gelatinous |
| hardened by chemical reaction(s), in particular polymerization | hardened |
| hardened by chemical reaction(s), in particular polymerization | hardened by time-delayed water-binding |
| hardened by chemical reaction(s), in particular polymerization | hardened by cooling below the melting point |
| hardened by chemical reaction(s), in particular polymerization | hardened by evaporation of solvents |
| hardened by chemical reaction(s), in particular polymerization | hardened by crystallization |
| hardened by chemical reaction(s), in particular polymerization | hardened by chemical reaction(s), in particular polymerization |
| hardened by chemical reaction(s), in particular polymerization | hardened by changing the rheological properties |
| hardened by chemical reaction(s), in particular polymerization | particulate |
| hardened by chemical reaction(s), in particular polymerization | particulate, attached using adhesion promoter |
| hardened by changing the rheological properties | sintered |
| hardened by changing the rheological properties | thermally sintered |
| hardened by changing the rheological properties | sintered by irradiation |
| hardened by changing the rheological properties | sintered by chemical reaction |
| hardened by changing the rheological properties | cast |
| hardened by changing the rheological properties | gelatinous |
| hardened by changing the rheological properties | hardened |
| hardened by changing the rheological properties | hardened by time-delayed water-binding |
| hardened by changing the rheological properties | hardened by cooling below the melting point |
| hardened by changing the rheological properties | hardened by evaporation of solvents |
| hardened by changing the rheological properties | hardened by crystallization |
| hardened by changing the rheological properties | hardened by chemical reaction(s), in particular polymerization |
| hardened by changing the rheological properties | hardened by changing the rheological properties |
| hardened by changing the rheological properties | particulate |
| hardened by changing the rheological properties | particulate, attached using adhesion promoter |

There follows a description of the most important ingredients of the laundry detergent or cleaning product shaped bodies according to the invention, the general description of the ingredients being followed by the appartment of these substances to individual regions of the shaped bodies according to the invention.

Preferred laundry detergent or cleaning product shaped bodies according to the invention comprise one or more surfactant(s). Accordingly, it is preferred for at least one of the noncompressed parts to comprise surfactant(s) as active substance. In the laundry detergent and cleaning product shaped bodies of the invention it is possible to use anionic, nonionic, cationic and/or amphoteric surfactants, and/or mixtures thereof. From a performance viewpoint, preference is given to mixtures of anionic and nonionic surfactants. The total surfactant content of the shaped bodies is for laundry detergent shaped bodies from 5 to 60% by weight, based on the shaped body weight, preference being given to surfactant contents of more than 15% by weight, while cleaning product shaped bodies for machine dishwashing preferably contain less than 5% by weight of surfactant(s).

The anionic surfactants used are, for example, those of the sulfonate and sulfate type. Preferred surfactants of the sulfonate type are $C_{9-13}$ alkylbenzenesulfonates, olefinsulfonates, i.e., mixtures of alkenesulfonates and hydroxyalkanesulfonates, and also disulfonates, as are obtained, for example, from $C_{12-18}$ monoolefins having a terminal or internal double bond by sulfonating with gaseous sulfur trioxide followed by alkaline or acidic hydrolysis of the sulfonation products. Also suitable are alkanesulfonates, which are obtained from $C_{12-18}$ alkanes, for example, by sulfochlorination or sulfoxidation with subsequent hydrolysis or neutralization, respectively. Likewise suitable, in addition, are the esters of α-sulfo fatty acids (ester sulfonates), e.g., the α-sulfonated methyl esters of hydrogenated coconut, palm kernel or tallow fatty acids.

Further suitable anionic surfactants are sulfated fatty acid glycerol esters. Fatty acid glycerol esters are understood as meaning the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having 6 to 22 carbon atoms, examples being those of caproic acid, caprylic acid, capric acid, myristic acid, lauric acid, palmitic acid, stearic acid, or behenic acid.

Preferred alk(en)yl sulfates are the alkali metal salts, and especially the sodium salts, of the sulfuric monoesters of $C_{12}$–$C_{18}$ fatty alcohols, examples being those of coconut fatty alcohol, tallow fatty alcohol, lauryl, myristyl, cetyl or stearyl alcohol, or of $C_{10}$–$C_{20}$ oxo alcohols, and those monoesters of secondary alcohols of these chain lengths. Preference is also given to alk(en)yl sulfates of said chain length which contain a synthetic straight-chain alkyl radical prepared on a petrochemical basis, and which have degradation behavior similar to that of the corresponding compounds based on fatty-chemical raw materials. From a laundry detergents viewpoint, the $C_{12}$–$C_{16}$ alkyl sulfates and $C_{12}$–$C_{15}$ alkyl sulfates, and also $C_{14}$–$C_{15}$ alkyl sulfates, are preferred. In addition, 2,3-alkyl sulfates, which may for example be prepared in accordance with U.S. Pat. Nos. 3,234,258 or 5,075,041 and obtained as commercial products from Shell Oil Company under the name DAN®, are suitable anionic surfactants.

Also suitable are the sulfuric monoesters of the straight-chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO. Because of their high foaming behavior they are used in cleaning products only in relatively small amounts, for example, in amounts of from 1 to 5% by weight.

Further suitable anionic surfactants are also the salts of alkylsulfosuccinic acid, which are also referred to as sulfosuccinates or as sulfosuccinic esters and which represent monoesters and/or diesters of sulfosuccinic acid with alcohols, preferably fatty alcohols and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols which themselves represent nonionic surfactants (for description, see below). Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

The nonionic surfactants used are preferably alkoxylated, advantageously ethoxylated, especially primary, alcohols having preferably 8 to 18 carbon atoms and on average from 1 to 12 mol of ethylene oxide (EO) per mole of alcohol, in which the alcohol radical may be linear or, preferably, methyl-branched in position 2 and/or may comprise linear and methyl-branched radicals in a mixture, as are commonly present in oxo alcohol radicals. In particular, however, preference is given to alcohol ethoxylates containing linear radicals from alcohols of natural origin having 12 to 18 carbon atoms, e.g., from coconut, palm, tallow fatty or oleyl alcohol, and on average from 2 to 8 EO per mole of alcohol. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO, and mixtures thereof, such as mixtures of $C_{12-14}$ alcohol containing 3 EO and $C_{12-18}$ alcohol containing 5 EO. The stated degrees of ethoxylation represent statistical mean values, which for a specific product may be an integer or a fraction. Preferred alcohol ethoxylates have a narrowed homolog distribution (narrow range ethoxylates, NREs). In addition to these nonionic surfactants it is also possible to use fatty alcohols containing more than 12 EO. Examples thereof are tallow fatty alcohol containing 14 EO, 25 EO, 30 EO or 40 EO.

As further nonionic surfactants, furthermore, use may also be made of alkyl glycosides of the general formula $RO(G)_x$, where R is a primary straight-chain or methyl-branched aliphatic radical, especially an aliphatic radical methyl-branched in position 2, containing 8 to 22, preferably 12 to 18, carbon atoms, and G is the symbol representing a glycose unit having 5 or 6 carbon atoms, preferably glucose.

The degree of oligomerization, x, which indicates the distribution of monoglycosides and oligoglycosides, is any desired number between 1 and 10; preferably, x is from 1.2 to 1.4.

A further class of preferred nonionic surfactants, which are used either as sole nonionic surfactant or in combination with other nonionic surfactants, are alkoxylated, preferably ethoxylated, or ethoxylated and propoxylated, fatty acid alkyl esters, preferably having 1 to 4 carbon atoms in the alkyl chain, especially fatty acid methyl esters.

Nonionic surfactants of the amine oxide type, for example N-cocoalkyl-N,N-dimethylamine oxide and N-tallowalkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula V:

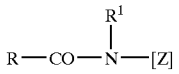

(V)

where RCO is an aliphatic acyl radical having 6 to 22 carbon atoms, $R^1$ is hydrogen or an alkyl or hydroxyalkyl radical having 1 to 4 carbon atoms, and [Z] is a linear or branched polyhydroxyalkyl radical having 3 to 10 carbon atoms and from 3 to 10 hydroxyl groups. The polyhydroxy fatty acid amides are known substances which are customarily obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula VI:

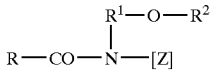

(VI)

where R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxyalkyl radical having 1 to 8 carbon atoms, preference being given to $C_{14}$ alkyl radicals or phenyl radicals, and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, e.g., glucose, fructose, maltose, lactose, galactose, mannose, or xylose. The N-alkoxy-or N-aryloxy-substituted compounds may then be converted to the desired polyhydroxy fatty acid amides, by reaction with fatty acid methyl esters in the presence of an alkoxide as catalyst.

In the context of the present invention, preference is given to producing laundry detergent and cleaning product shaped bodies comprising anionic and nonionic surfactant(s); performance advantages may result from certain quantitative ratios in which the individual classes of surfactant are used.

For example, particular preference is given to laundry detergent and cleaning product shaped bodies in which the ratio of anionic surfactant(s) to nonionic surfactant(s) is between 10:1 and 1:10, preferably between 7.5:1 and 1:5, and in particular between 5:1 and 1:2. Also preferred are laundry detergent and cleaning product shaped bodies comprising surfactant(s), preferably anionic and/or nonionic surfactant(s), in amounts of from 5 to 40% by weight, preferably from 7.5 to 35% by weight, particularly preferably from 10 to 30% by weight, and in particular from 12.5 to 25% by weight, based in each case on the weight of the shaped body.

From a performance viewpoint it may be advantageous if certain classes of surfactant are absent from some phases of the laundry detergent and cleaning product shaped bodies or from the shaped body as a whole, i.e., from all phases. A further important embodiment of the present invention therefore envisages that at least one phase of the shaped bodies is free from nonionic surfactants.

Conversely, however, the presence of certain surfactants in individual phases or in the whole shaped body, i.e., in all phases, may produce a positive effect. The incorporation of the above-described alkyl polyglycosides has been found advantageous, and so preference is given to laundry detergent and cleaning product shaped bodies in which at least one phase of the shaped bodies comprises alkyl polyglycosides.

Similarly to the case with the nonionic surfactants, the omission of anionic surfactants from certain phases or all phases may also result in laundry detergent and cleaning product shaped bodies better suited to certain fields of application. In the context of the present invention, therefore, it is also possible to conceive laundry detergent and cleaning product shaped bodies in which at least one phase of the shaped body is free from anionic surfactants.

As already mentioned, the use of surfactants in the case of cleaning product shaped bodies for machine dishwashing is preferably limited to the use of nonionic surfactants in small amounts. Laundry detergent and cleaning product shaped bodies preferred for use as cleaning product shaped bodies in the context of the present invention are those which have total surfactant contents of less than 5% by weight, preferably less than 4% by weight, particularly preferably less than 3% by weight, and in particular less than 2% by weight, based in each case on their total weight. Surfactants used in machine dishwashing compositions are usually only low-foaming nonionic surfactants. Representatives from the groups of the anionic, cationic and amphoteric surfactants, in contrast, are of relatively little importance. Particularly preferably, the cleaning product shaped bodies produced according to the invention for machine dishwashing comprise nonionic surfactants, especially nonionic surfactants from the group of the alkoxylated alcohols. Preferred nonionic surfactants used are alkoxylated, advantageously ethoxylated, especially primary, alcohols having preferably 8 to 18 carbon atoms and on average from 1 to 12 mol of ethylene oxide (EO) per mole of alcohol, in which the alcohol radical may be linear or, preferably, methyl-branched in position 2 and/or may contain a mixture of linear and methyl-branched radicals, as are customarily present in oxo alcohol radicals. Particular preference is given, however, to alcohol ethoxylates having linear radicals from alcohols of natural origin having 12 to 18 carbon atoms, e.g., from coconut, palm, tallow fatty or oleyl alcohol, and having on average from 2 to 8 EO per mole of alcohol. The preferred ethoxylated alcohols include, for example, $C_{12-14}$ alcohols having 3 EO or 4 EO, $C_{9-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures of these, such as mixtures of $C_{12-14}$ alcohol having 3 EO and $C_{12-18}$ alcohol having 5 EO. The stated degrees of ethoxylation are statistical means, which for a specific product may be an integer or a fraction. Preferred alcohol ethoxylates have a narrowed homolog distribution (narrow range ethoxylates, NREs). In addition to these nonionic surfactants, fatty alcohols having more than 12 EO may also be used. Examples thereof are tallow fatty alcohol having 14 EO, 25 EO, 30 EO, or 40 EO.

Particularly in the case of laundry detergent shaped bodies or cleaning product shaped bodies for machine dishwashing, it is preferred for the laundry detergent and cleaning product shaped bodies to comprise a nonionic surfactant which has a melting point above room temperature. Accordingly, at least one of the shapeable masses in the process according to the invention preferably comprises a nonionic surfactant having a melting point above 20° C. Preferred nonionic surfactants have melting points above 25° C., particularly preferably nonionic surfactants have melting points between 25 and 60° C., in particular between 26.6 and 43.3° C.

Suitable nonionic surfactants having melting or softening points within the stated temperature range are, for example, low-foaming nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Preference is also given to nonionic surfactants which possess a waxlike consistency at room temperature.

Preferred nonionic surfactants that are solid at room temperature originate from the groups of alkoxylated nonionic surfactants, especially ethoxylated primary alcohols, and mixtures of these surfactants with surfactants of more complex structure such as polyoxypropylene/polyoxyethylene/polyoxypropylene (PO/EO/PO) surfactants. Such (PO/EO/PO) nonionic surfactants are notable, furthermore, for good foam control.

In one preferred embodiment of the present invention, the nonionic surfactant having a melting point above room temperature is an ethoxylated nonionic surfactant originating from the reaction of a monohydroxy alkanol or alkylphenol having 6 to 20 carbon atoms with preferably at least 12 mol, particularly preferably at least 15 mol, in particular at least 20 mol, of ethylene oxide per mole of alcohol or alkylphenol, respectively.

A particularly preferred nonionic surfactant that is solid at room temperature is obtained from a straight-chain fatty alcohol having 16 to 20 carbon atoms ($C_{16-20}$ alcohol), preferably a $C_{18}$ alcohol, and at least 12 mol, preferably at least 15 mol, and in particular at least 20 mol of ethylene oxide. Of these, the so-called "narrow range ethoxylates" (see above) are particularly preferred.

The nonionic surfactant which is solid at room temperature preferably additionally has propylene oxide units in the molecule. Preferably, such PO units account for up to 25% by weight, particularly preferably up to 20% by weight, and in particular up to 15% by weight, of the overall molar mass of the nonionic surfactant. Particularly preferred nonionic surfactants are ethoxylated monohydroxy alkanols or alkylphenols, which additionally have polyoxyethylene/polyoxypropylene block copolymer units. The alcohol or alkylphenol moiety of such nonionic surfactant molecules in this case makes up preferably more than 30% by weight, particularly preferably more than 50% by weight, and in particular more than 70% by weight, of the overall molar mass of such nonionic surfactants.

Further particularly preferred nonionic surfactants having melting points above room temperature, contain from 40 to 70% of a polyoxypropylene/polyoxyethylene/polyoxypropylene block polymer blend which comprises 75% by weight of an inverted block copolymer of polyoxyethylene and polyoxypropylene containing 17 mol of ethylene oxide and 44 mol of propylene oxide and 25% by weight of a block copolymer of polyoxyethylene and polyoxypropylene, initiated with trimethylolpropane and containing 24 mol of ethylene oxide and 99 mol of propylene oxide per mole of trimethylolpropane.

Nonionic surfactants which may be used particularly preferably are, for example, obtainable under the name Poly Tergent® SLF-18 from the company Olin Chemicals.

A further preferred surfactant may be described by the formula:

$$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms, or mixtures thereof, $R^2$ is a linear or branched hydrocarbon radical having 2 to 26 carbon atoms, or mixtures thereof, and x is between 0.5 and 1.5, and y is at least 15.

Further preferred nonionic surfactants are the terminally capped poly(oxyalkylated) nonionic surfactants of the formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x is between 1 and 30, k and j are between 1 and 12, preferably between 1 and 5. Where x>2, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, —$CH_3$ or —$CH_2CH_3$ are particularly preferred. Particularly preferred values for x lie within the range from 1 to 20, in particular from 6 to 15.

As described above, each $R^3$ in the above formula may be different if x>2. By this means it is possible to vary the alkylene oxide unit in the square brackets. If x, for example, is 3, the radical $R^3$ may be selected in order to form ethylene oxide (R═H), or propylene oxide ($R^3$═$CH_3$) units, which may be added on to one another in any sequence, examples being (EO) (PO) (EO), (EO) (EO) (PO), (EO) (EO) (EO), (PO) (EO) (PO), (PO) (PO) (EO) and (PO) (PO) (PO). The value of 3 for x has been chosen by way of example in this case and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of k=1 and j=1, thereby simplifying the above formula to:

$$R^1O[CH_2CH(R^3)O]_xCH_2CH(OH)CH_2OR^2.$$

In the last-mentioned formula, $R^1$, $R^2$ and $R^3$ are as defined above and x stands for numbers from 1 to 30, preferably from 1 to 20, and in particular from 6 to 18. Particular preference is given to surfactants wherein the radicals $R^1$ and $R^2$ have 9 to 14 carbon atoms, $R^3$ is H, and x adopts values from 6 to 15.

The remarks above refer in part to the overall shaped bodies, which—as mentioned earlier on—may also be in the form of two-, three- or four-phase configurations. Based on the individual noncompressed part, which comprises surfactant(s), preference is given to cleaning product shaped bodies for machine dishwashing which have total surfactant contents of less than 5% by weight, preferably less than 4% by weight, particularly preferably less than 3% by weight, and in particular less than 2% by weight, based in each case on the noncompressed part.

The laundry detergent or cleaning product shaped bodies according to the invention preferably comprise builders which in turn preferably originate from the groups of zeolites, silicates, carbonates, hydrogencarbonates, phosphates and polymers. Particularly in the case of the noncompressed shaped body parts prepared by hardening, preferred ingredients originate from the group of phosphates, alkali metal phosphates being particularly preferred. For the preparation of the masses, the substances are used in anhydrous or low-water form, and the desired plastic properties of the masses are adjusted using water and also optional plasticizing auxiliaries. After shaping, the shaped and cut-to-length strands are then hardened by hydration of the phosphates. It is of course also possible for phosphates to be present in noncompressed parts which have been prepared in other ways, e.g. by sintering.

Alkali metal phosphates is the collective term for the alkali metal (especially sodium and potassium) salts of the various phosphoric acids, among which metaphosphoric acids $(HPO_3)_n$ and orthophosphoric acid $H_3PO_4$, in addition to higher molecular mass representatives, may be distinguished. The phosphates combine a number of advantages: they act as alkali carriers, prevent limescale deposits on machine components, and lime incrustations on fabrics, and additionally contribute to cleaning performance.

Sodium dihydrogen phosphate, $NaH_2PO_4$, exists as the dihydrate (density 1.91 $gcm^{-3}$, melting point 60°) and as the monohydrate (density 2.04 $gcm^{-3}$). Both salts are white powders of very ready solubility in water which lose the water of crystallization on heating and undergo transition at 200° C. to the weakly acidic diphosphate (disodium hydrogendiphosphate, $Na_2H_2P_2O_7$) and at the higher temperature to sodium trimeta-phosphate ($Na_3P_3O_9$) and Maddrell's salt (see below). $NaH_2PO_4$ reacts acidically; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt with a density of 2.33 $gcm^{-3}$, has a melting point of 253° [decomposition with formation of potassium polyphosphate $(KPO_3)_x$], and is readily soluble in water.

Disodium hydrogen phosphate (secondary sodium phosphate), $Na_2HPO_4$, is a colorless, crystalline salt which is very readily soluble in water. It exists in anhydrous form and with 2 mol (density 2.066 $gcm^{-3}$, water loss at 95°), 7 mol (density 1.68 $gcm^{-3}$, melting point 48° with loss of 5 $H_2O$), and 12 mol of water (density 1.52 $gcm^{-3}$, melting point 35° with loss of 5 $H_2O$), becomes anhydrous at 100°, and if heated more severely undergoes transition to the diphosphate $Na_4P_2O_7$. Disodium hydrogenphosphate is prepared by neutralizing phosphoric acid with sodium carbonate solution using phenolphthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, exists as colorless crystals which as the dodecahydrate have a density of 1.62 $gcm^{-3}$ and a melting point of 73–76° C. (decomposition), as the decahydrate (corresponding to 19–20% $P_2O_5$) have a melting point of 100° C., and in anhydrous form (corresponding to 39–40% $P_2O_5$) have a density of 2.536 $gcm^{-3}$. Trisodium phosphate is readily soluble in water, with an alkaline reaction, and is prepared by evaporative concentration of a solution of precisely 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1 340°, and is readily soluble in water with an alkaline reaction. It is produced, for example, when Thomas slag is heated with charcoal and potassium sulfate. Despite the relatively high price, the more readily soluble and therefore highly active potassium phosphates are frequently preferred in the cleaning products industry over the corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815–1.836 $gcm^{-3}$, melting point 94° with loss of water). Both substances are colorless crystals which dissolve in water with an alkaline reaction. $Na_4P_2O_7$ is formed when disodium phosphate is heated at >200° or by reacting phosphoric acid with sodium carbonate in stoichiometric ratio and dewatering the solution by spraying. The decahydrate complexes heavy metal salts and water hardeners and therefore reduces the hardness of the water. Potassium diphosphate (potassium pyrophosphate), $K_4P_2O_7$, exists in the form of the trihydrate and is a colorless, hygroscopic powder of density 2.33 $gcm^{-3}$ which is soluble in water, the pH of the 1% strength solution at 25° being 10.4.

Condensation of $NaH_2PO_4$ or of $KH_2PO_4$ gives rise to higher molecular mass sodium and potassium phosphates, among which it is possible to distinguish cyclic representatives, the sodium and potassium metaphosphates, and catenated types, the sodium and potassium polyphosphates. For the latter in particular a large number of names are in use: fused or calcined phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with 6 $H_2O$ and has the general formula NaO-[P(O)(ONa)—O]$_n$—Na where n=3. About 17 g of the salt which is free from water of crystallization dissolve in 100 g of water at room temperature, at 600 about 20 g, at 100° around 32 g; after heating the solution at 100° C. for two hours, about 8% orthophosphate and 15% diphosphate are produced by hydrolysis. For the preparation of pentasodium triphosphate, phosphoric acid is reacted with sodium carbonate solution or sodium hydroxide solution in stoichiometric ratio and the solution is dewatered by spraying. In a similar way to Graham's salt and sodium diphosphate, pentasodium triphosphate dissolves numerous insoluble metal compounds (including lime soaps, etc). Pentapotassium triphosphate, $K_5P_3O_{10}$ (potassium tripolyphosphate), is available commercially, for example, in the form of a 50% strength by weight solution (>23% $P_2O_5$, 25% $K_2O$). The potassium polyphosphates find broad application in the laundry detergents and cleaning products industry. There also exist sodium potassium tripolyphosphates, which may likewise be used for the purposes of the present invention. These are formed, for example, when sodium trimetaphosphate is hydrolyzed with KOH:

$$(NaPO_3)_3+2KOH \rightarrow Na_3K_2P_3O_{10}+H_2O$$

These phosphates can be used in accordance with the invention in precisely the same way as sodium tripolyphospate, potassium tripolyphosphate, or mixtures of these two; mixtures of sodium tripolyphosphate and sodium potassium tripolyphosphate, or mixtures of potassium tripolyphosphate and sodium potassium tripolyphosphate, or mixtures of sodium tripolyphosphate and potassium tripolyphosphate and sodium potassium tripolyphospate, may also be used in accordance with the invention.

In preferred laundry detergent or cleaning product shaped bodies, at least one noncompressed part comprises phosphate(s), preferably alkali metal phosphate(s), particularly preferably pentasodium or pentapotassium triphosphate (sodium or potassium tripolyphosphate), in amounts of from 20 to 80% by weight, preferably from 25 to 75% by weight, and in particular from 30 to 70% by weight, based in each case on the noncompressed part.

Where phosphates are used as sole hydratable substances in masses to be hardened, the amount of added water should not exceed the water-binding capacity thereof, in order to keep the free water content of the shaped bodies low. Overall, processes which have been found to be preferred for observing the abovementioned limits are those wherein the weight ratio of phosphate(s) to water in the shapeable mass is less than 1:0.3, preferably less than 1:0.25, and in particular less than 1:0.2.

Further ingredients, which may be present instead of or in addition to phosphates in the laundry detergent or cleaning product shaped bodies, are carbonates and/or hydrogen carbonates, preference being given to the alkali metal salts and, of these, particular preference to the potassium salts and/or sodium salts. Preferred laundry detergent and cleaning product shaped bodies comprise carbonate(s) and/or hydrogen carbonate(s), preferably alkali metal carbonate(s), particularly preferably sodium carbonate, in amounts of from 5 to 50% by weight, preferably from 7.5 to 40% by weight, and in particular from 10 to 30% by weight, based in each case on the noncompressed part.

The comments made above regarding the water content of the masses are also applicable in the case of the preparation via hardening. Processes which have been found to be preferred, in particular, are those wherein the weight ratio of carbonate(s) and/or hydrogen carbonate(s) to water in the shapeable mass is less than 1:0.2, preferably less than 1:0.15, and in particular less than 1:0.1.

Further ingredients which may be present instead of or in addition to the abovementioned phosphates and/or carbonates/hydrogen carbonates in the laundry detergent or cleaning product shaped bodies are silicates, preference being given to the alkali metal silicates and, of these, particular preference to the amorphous and/or crystalline potassium and/or sodium disilicates.

Suitable crystalline, layered sodium silicates have the general formula $NaMSi_xO_{2x-1}.yH_2O$, where M is sodium or hydrogen, x is a number from 1.9 to 4, y is a number from 0 to 20, and preferred values for x are 2, 3 or 4. Preferred crystalline phyllosilicates of the given formula are those in which M is sodium and x adopts the value 2 or 3. In particular, both β- and δ-sodium disilicates $Na_2Si_2O_5.yH_2O$ are preferred.

It is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-delayed and have secondary washing properties. The dissolution delay relative to conventional amorphous sodium silicates may have been brought about in a variety of ways for example, by surface treatment, compounding, compacting, or overdrying. In the context of this invention, the term "amorphous" also embraces "X-ray-amorphous". This means that in X-ray diffraction experiments the silicates do not yield the sharp X-ray reflections typical of crystalline substances but instead yield at best one or more maxima of the scattered X-radiation, having a width of several degree units of the diffraction angle. However, even particularly good builder properties may result, if the silicate particles in electron diffraction experiments yield vague or even sharp diffraction maxima. The interpretation of this is that the products have microcrystalline regions with a size of from 10 to several hundred nm, values up to max. 50 nm and in particular up to max. 20 nm being preferred. Particular preference is given to compacted amorphous silicates, compounded amorphous silicates, and overdried X-ray-amorphous silicates.

In the context of the present invention, preferred laundry detergent or cleaning product shaped bodies comprise silicate(s), preferably alkali metal silicates, particularly preferably crystalline or amorphous alkali metal disilicates, in amounts of from 10 to 60% by weight, preferably from 15 to 50% by weight, and in particular from 20 to 40% by weight, based in each case on the overall shaped body.

The comments made above regarding the water content of the masses are also applicable to the preparation via hardening. Processes which have been found to be preferred are, in particular, those wherein the weight ratio of silicates) to water in the shapeable mass is less than 1:0.25, preferably less than 1:0.2, and in particular less than 1:0.15.

Likewise suitable as an important component in the laundry detergent and cleaning product shaped bodies in accordance with the invention are substances from the group of the zeolites. These substances represent preferred builders especially in connection with laundry detergent tablets. Zeolites have the general formula $$M_{2/n}O.Al_2O_3.SiO_2.H_2O$$

in which M is a cation of valence n, x is greater than or equal to 2, and y may adopt values between 0 and 20. The zeolite structures are formed by linking of $AlO_4$ tetrahedra with $SiO_4$ tetrahedra, this network being occupied by cations and water molecules. The cations in these structures are relatively mobile and may be replaced to different degrees by other cations. The intercrystalline "zeolitic" water may be released, continuously and reversibly depending on zeolite type, while with certain types of zeolite structural changes are also associated with the release and/or uptake of water.

Within the structural subunits, the "primary binding units" ($AlO_4$ tetrahedra and $SiO_4$ tetrahedra) form so-called "secondary binding units", which have the form of single or multiple rings. For example, in various zeolites there are 4-, 6- and 8-membered rings (referred to as S4R, S6R and S8R), while other types are joined by way of four- and six-membered double-ring prisms (commonest types: D4R as a tetragonal and D6R as a hexagonal prism). These "secondary subunits" join different polyhedra, which are referred to using Greek letters. The most widespread in this context is a polyhedron composed of six squares and eight equilateral hexagons, which is referred to as "β". Using these building units, it is possible to produce many different zeolites. To date, 34 natural zeolite minerals and approximately 100 synthetic zeolites are known.

The best-known zeolite, zeolite 4 A, is a cubic assembly of β cages linked by D4R subunits. It belongs to the zeolite structural group 3 and its three-dimensional network has pores of 2.2 Å and 4.2 Å in size; the formula unit in the unit cell may be described by $Na_{12}[(AlO_2)_{12}(SiO_2)_{12}].27\ H_2O$.

In the laundry detergent and cleaning product shaped bodies of the invention it is preferred to use zeolites of the faujasite type. Together with the zeolites X and Y, the mineral faujasite belongs to the faujasite types within the zeolite structural group 4, which is characterized by the double-hexagon subunit D6R (compare Donald W. Breck: "Zeolite Molecular Sieves", John Wiley & Sons, New York, London, Sydney, Toronto, 1974, page 92). In addition to the above-mentioned faujasite types, the zeolite structural group 4 also includes the minerals chabazite and gmelinite and also the synthetic zeolite R (chabazite type), S (gmelinite type), L, and ZK-5. The two last-mentioned synthetic zeolites have no mineral analogs.

Zeolites of the faujasite type are composed of β cages linked tetrahedrally by way of D6R subunits, the β cages being arranged in a manner similar to the carbon atoms in diamond. The three-dimensional network of the faujasite-type zeolites used in the process according to the invention has pores of 2.2 and 7.4 Å; the unit cell includes, moreover, 8 cavities having a diameter of approximately 13 Å and may be described by the formula $Na_{86}[(AlO_2)_{86}(SiO_2)_{106}].264\ H_2O$. The network of zeolite X includes a cavity volume of approximately 50%, based on the dehydrated crystal, which constitutes the largest empty space of all known zeolites (zeolite Y: approximately 48% cavity volume, faujasite: approximately 47% cavity volume). (All data from: Donald W. Breck: "Zeolite Molecular Sieves", John Wiley & Sons, New York, London, Sydney, Toronto, 1974, pages 145, 176, 177.)

In the context of the present invention, the term "faujasite-type zeolite" denotes all three zeolites which form the faujasite subgroup of the zeolite structural group 4. In addition to zeolite X, therefore, zeolite Y and faujasite, and mixtures of these compounds, may be used in accordance with the invention, preference being given to pure zeolite X.

Mixtures or cocrystallizates of zeolites of the faujasite type with other zeolites, which need not necessarily belong to the zeolite structural group 4, may also be used in accordance with the invention, the advantages of the process according to the invention being manifested particularly if at least 50% by weight of the powdering agent consists of a faujasite-type zeolite. It is also conceivable, for example, to use the minimum amount of a faujasite-type zeolite (0.5% by weight, based on the weight of the shaped body being produced) and to use conventional zeolite A as the remaining powdering agent. In any case, however, it is preferred for the powdering agent to consist exclusively of one or more faujasite-type zeolites, with zeolite X again being preferred.

The aluminum silicates which are preferably used in the laundry detergent and cleaning product shaped bodies of the invention are commercially available, and the methods for their preparation are described in standard monographs.

Examples of commercially available zeolites of the X type may be described by the following formulae:

$$Na_{86}[(AlO_2)_{86}(SiO_2)_{106}].xH_2O,$$

$$K_{86}[(Al_2)_{86}(SiO_2)_{106}].xH_2O,$$

$$Ca_{40}Na_6[(Al_2)_{86}(SiO_2)_{106}].xH_2O,$$

$$Sr_{21}Ba_{22}[(AlO_2)_{86}(SiO_2)_{106}].xH_2O,$$

in which x may adopt values of between 0 and 276, and which have pore sizes of from 8.0 to 8.4 Å.

A product which is available commercially and preferred in the context of the process according to the present invention is, for example, a cocrystallizate of zeolite X and zeolite A (approximately 80% by weight zeolite X), which is sold by CONDEA Augusta S.p.A. under the trade name VEGOBOND AX® and may be described by the formula:

$$nNa_2O.(1-n)K_2O.Al_2O_3.(2-2.5)SiO_2.(3.5-5.5)H_2O.$$

Zeolites of the Y type are also commercially available and may be described, for example, by the formulae:

$$Na_{56}[(AlO_2)_{56}(SiO_2)_{136}].xH_2O,$$

$$K_{56}[(AlO_2)_{56}(SiO_2)_{136}].xH_2O,$$

in which x stands for numbers between 0 and 276, and which have pore sizes of 8.0 Å.

Preferred laundry detergent and cleaning product shaped bodies are those which comprise zeolite(s), preferably zeolite A, zeolite P, zeolite X and mixtures thereof, in amounts of from 10 to 60% by weight, preferably from 15 to 50% by weight, and in particular from 20 to 40% by weight.

The particle sizes of the preferred faujasite-type zeolites are preferably within the range from 0.1 up to 100 μm, more preferably between 0.5 and 50 μm, and in particular between 1 and 30 μm, in each case measured with standard particle size determination methods.

It is generally preferred in this context to use finely divided solids, irrespective of whether they are the above-mentioned zeolites or other builders or bleaches, bleach activators or other solids. Very generally, preference is given during the processing via hardening to process variants wherein the average particle size of the solids used is below 400 μm, preferably below 300 μm, and in particular below 200 μm.

The average particle size here is the arithmetic mean of the individual particle sizes, which may vary. Particularly preferred processes are those wherein less than 10% by weight, preferably less than 5% by weight, and in particular less than 1% by weight, of the solids used in the shapeable mass(es) have particle sizes above 1 000 μm. The upper particle size range may be narrowed even further, so that particularly preferred processes are those wherein less than 15% by weight, preferably less than 10% by weight, and in particular less than 5% by weight, of the solids used in the shapeable mass(es) have particle sizes above 800 μm.

In general, however, even narrower particle size distributions are preferred, where the breadth of fluctuation about the average particle size is not more than 50%, preferably not more than 40%, and in particular not more than 30%, of the average particle size; i.e., the particle sizes make up at least 0.7 times and at most 1.3 times the average particle size.

Above, the weight ratio of water to certain ingredients in masses preferred in accordance with the invention for processing has been specified for the preparation of the non-compressed proparts via hardening. After processing, this water is preferably bound in the form of water of hydration, so that the process end-products preferably have a significantly lower free water content. Preferred end-products of the process according to the invention are essentially water-free; i.e., in a state in which the amount of liquid water, i.e., water not present in the form of water of hydration and/or constitution water, is less than 2% by weight, preferably less than 1% by weight, and in particular even below 0.5% by weight, based in each case on the shaped bodies. Accordingly, preferred laundry detergent and cleaning product shaped bodies of the invention are those which comprise less than 10% by weight, preferably less than 5% by weight, particularly preferably less than 1% by weight, and in particular less than 0.5% by weight, of free water. Water may accordingly be present essentially only in chemically and/or physically bound form or as a constituent of the solid raw materials or compounds, but not as a liquid, solvent or dispersion, in the end-products. Advantageously, the shaped bodies at the end of the production process according to the invention have an overall water content of not more than 15% by weight, with this water, therefore, being present not in liquid, free form but instead in chemically and/or physically bound form, and it is particularly preferred for the content of water that is not bound to zeolite and/or to silicates in the solid premix to be not more than 10% by weight and in particular not more than 7% by weight.

In the context of the present invention, particularly preferred laundry detergent or cleaning product shaped bodies not only have an extremely small propart of free water but are preferably themselves still able to bind further free water. In preferred laundry detergent and cleaning product shaped bodies, the water content of the tablets is from 50 to 100% of the calculated water-binding capacity.

The water-binding capacity is the ability of a substance (in this case, of the laundry detergent or cleaning product shaped body) to absorb water in chemically stable form, and ultimately indicates the amount of water which can be bound in the form of stable hydrates by a substance or by a shaped body. The dimensionless value of the water-binding capacity (WBC) is calculated from:

$$WBC = \frac{n \cdot 18}{M}$$

where n is the number of water molecules in the corresponding hydrate of the substance and M is the molar mass of the unhydrated substance. For the water-binding capacity of anhydrous sodium carbonate (formation of sodium carbonate monohydrate), for example, this gives a value of $$WBC = \frac{1.18}{2 \cdot 23 + 12 + 3 \cdot 16} = 0.17.$$

The value WBC may be calculated for all hydrate-forming substances that are used in the masses for processing in accordance with the invention. The percentage proparts of these substances then give the overall water-binding capacity of the formulation. In preferred process end-products, then, the water content is between 50 and 100% of this calculated value.

In addition to the water content of the laundry detergent and cleaning product shaped bodies and the ratio of water to certain raw materials, it is also possible to make statements about the absolute water content of the masses for processing in accordance with the invention in the case of the preparation of the noncompressed shaped body. In particularly preferred processes, the shapeable mass(es) in the course of processing has (have) a water content of from 2.5 to 30% by weight, preferably from 5 to 25% by weight, and in particular from 7.5 to 20% by weight, based in each case on the mass.

In addition to the abovementioned constituents, builder and surfactant, the laundry detergent and cleaning product shaped bodies of the invention may comprise further customary laundry detergent and cleaning product ingredients from the group consisting of bleaches, bleach activators, disintegration auxiliaries, dyes, fragrances, optical brighteners, enzymes, foam inhibitors, silicone oils, antiredeposition agents, graying inhibitors, color transfer inhibitors, and corrosion inhibitors.

In order to facilitate the disintegration of highly compacted shaped bodies, it is possible to incorporate disintegration auxiliaries, known as tablet disintegrants, into the shaped bodies in order to reduce the disintegration times. These substances are suitable, for example, for accelerating the release of individual tablet regions relative to other regions. Tablet disintegrants, or disintegration accelerators, are understood in accordance with Römpp (9th Edition, Vol. 6, p. 4440) and Voigt *"Lehrbuch der pharmazeutischen Technologie"* [Textbook of pharmaceutical technology] (6th Edition, 1987, pp. 182–184) as meaning auxiliaries which ensure the rapid disintegration of tablets in water or gastric fluid and the release of the drugs in absorbable form.

These substances increase in volume on ingress of water, with on the one hand an increase in the intrinsic volume (swelling) and on the other hand, by way of the release of gases as well, the possiblity of generating a pressure which causes the tablets to disintegrate into smaller particles. Examples of established disintegration auxiliaries are carbonate/citric acid systems, with the use of other organic acids also being possible. Examples of swelling disintegration auxiliaries are synthetic polymers such as polyvinylpyrrolidone (PVP) or natural polymers and/or modified natural substances such as cellulose and starch and their derivatives, alginates, or casein derivatives.

Preferred laundry detergent and cleaning product shaped bodies comprise from 0.5 to 10% by weight, preferably from 3 to 7% by weight, and in particular from 4 to 6% by weight, of one or more disintegration auxiliaries, based in each case on the weight of the shaped body. If only one noncompressed part comprises disintegration auxiliaries, then these figures are based only on the weight of this noncompressed part.

Preferred disintegrants used in the context of the present invention are cellulose-based disintegrants and so preferred laundry detergent and cleaning product tablets comprise a cellulose-based disintegrant of this kind in amounts from 0.5 to 10% by weight, preferably from 3 to 7% by weight, and in particular from 4 to 6% by weight. Pure cellulose has the formal gross composition $(C_6H_{10}O_5)_n$ and, considered formally, is a β-1,4-polyacetal of cellobiose, which itself is constructed of two molecules of glucose. Suitable celluloses consist of from about 500 to 5 000 glucose units and, accordingly, have average molecular masses of from 50 000 to 500 000. Cellulose-based disintegrants which can be used also include, in the context of the present invention, cellulose derivatives obtainable by polymer-analogous reactions from cellulose. Such chemically modified celluloses include, for example, products of esterifications and etherifications in which hydroxy hydrogen atoms have been substituted. However, celluloses in which the hydroxy groups have been replaced by functional groups not attached via an oxygen atom may also be used as cellulose derivatives. The group of the cellulose derivatives embraces, for example, alkali metal celluloses, carboxymethylcellulose (CMC), cellulose esters and cellulose ethers and aminocelluloses. Said cellulose derivatives are preferably not used alone as cellulose-based disintegrants but instead are used in a mixture with cellulose. The cellulose derivative content of these mixtures is preferably less than 50% by weight, particularly preferably less than 20% by weight, based on the cellulose-based disintegrant. The particularly preferred cellulose-based disintegrant used is pure cellulose, free from cellulose derivatives.

The cellulose used as disintegration auxiliary is preferably not used in finely divided form but instead is converted to a coarser form, for example, by granulation or compaction, before being admixed to the premixes intended for compression. Laundry detergent and cleaning product shaped bodies comprising disintegrants in granular or optionally cogranulated form are described in German Patent Applications DE 197 09 991 (Stefan Herzog) and DE 197 10 254 (Henkel) and in International Patent Application WO 98/40463 (Henkel). These documents also provide further details on the production of granulated, compacted or cogranulated cellulose disintegrants. The particle sizes of such disintegrants are usually above 200 μm, preferably between 300 and 1 600 μm to the extent of at least 90% by weight, and in particular between 400 and 1 200 μm to the extent of at least 90% by weight. The abovementioned, relatively coarse disintegration auxiliaries, and those described in more detail in the cited documents, are preferred for use as cellulose-based disintegration auxiliaries in the context of the present invention and are available commercially, for example, under the name Arbocel® TF-30-HG from Rettenmaier.

As a further cellulose-based disintegrant or as a constituent of this component it is possible to use microcrystalline cellulose. This microcrystalline cellulose is obtained by partial hydrolysis of celluloses under conditions which attack only the amorphous regions (approximately 30% of the total cellulose mass) of the celluloses and break them up completely but leave the crystalline regions (approximately 70%) intact. Subsequent deaggregation of the microfine celluloses resulting from the hydrolysis yields the microcrystalline celluloses, which have primary particle sizes of approximately 5 μm and can be compacted, for example, to granulates having an average particle size of 200 μm.

Laundry detergent and cleaning product shaped bodies which are preferred in the context of the present invention additionally comprise a disintegration auxiliary, preferably a cellulose-based disintegration auxiliary, preferably in granular, cogranulated or compacted form, in amounts of from 0.5 to 10% by weight, preferably from 3 to 7% by weight, and in particular from 4 to 6% by weight, based in each case on the weight of the shaped body.

The laundry detergent and cleaning product shaped bodies of the invention may further comprise, incorporated into one or more of the masses for processing, a gas-evolving effervescent system. Said gas-evolving effervescent system may consist of a single substance which on contact with water releases a gas. Among these compounds mention may be made, in particular, of magnesium peroxide, which on contact with water releases oxygen. Normally, however, the gas-releasing effervescent system consists for its part of at least two constituents which react with one another and, in so doing, form gas. Although a multitude of systems which release, for example, nitrogen, oxygen or hydrogen are conceivable and implementable here, the effervescent system used in the laundry detergent and cleaning product shaped bodies of the invention will be selectable on the basis of both economic and ecological considerations. Preferred effervescent systems consist of alkali metal carbonate and/or alkali metal hydrogen carbonate and of an acidifier which is suitable for releasing carbon dioxide from the alkali metal salts in aqueous solution.

Among the alkali metal carbonates and/or alkali metal hydrogencarbonates, the sodium and potassium salts are much preferred over the other salts on grounds of cost. It is of course not mandatory to use the pure alkali metal carbonates or alkali metal hydrogencarbonates in question; rather, mixtures of different carbonates and hydrogencarbonates may be preferred from the viewpoint of washing performance.

In preferred laundry detergent and cleaning product shaped bodies, the effervescent system used comprises from 2 to 20% by weight, preferably from 3 to 15% by weight, and in particular from 5 to 10% by weight, of an alkali metal carbonate or alkali metal hydrogencarbonate, and from 1 to 15, preferably from 2 to 12, and in particular from 3 to 10, % by weight of an acidifier, based in each case on the overall shaped body. The amount of said substances in individual masses may very well be higher.

Examples of acidifiers which release carbon dioxide from the alkali metal salts in aqueous solution which may be used are boric acid and also alkali metal hydrogensulfates, alkali metal dihydrogenphosphates, and other inorganic salts. Preference is given, however, to the use of organic acidifiers, with citric acid being a particularly preferred acidifier. However, it is also possible, in particular, to use the other solid mono-, oligo- and polycarboxylic acids. Preferred among this group, in turn, are tartaric acid, succinic acid, malonic acid, adipic acid, maleic acid, fumaric acid, oxalic acid, and polyacrylic acid. Organic sulfonic acids such as amidosulfonic acid may likewise be used. A product which is commercially available and which can likewise preferably be used as acidifier in the context of the present invention is Sokalan® DCS (trademark of BASF), a mixture of succinic acid (max. 31% by weight), glutaric acid (max. 50% by weight), and adipic acid (max. 33% by weight).

In the context of the present invention, preference is given to laundry detergent and cleaning product shaped bodies where the acidifier used in the effervescent system comprises a substance from the group of the organic di-, tri- and oligocarboxylic acids, and mixtures thereof.

Among the compounds used as bleaches which yield $H_2O_2$ in water, sodium percarbonate is of particular importance. This "sodium percarbonate" is a term used unspecifically for sodium carbonate peroxohydrates, which strictly speaking are not "percarbonates" (i.e., salts of percarbonic acid) but rather hydrogen peroxide adducts with sodium carbonate. The commercial product has the average composition $2\ Na_2CO_3.3\ H_2O_2$ and is thus not a peroxycarbonate. Sodium percarbonate forms a white, water-soluble powder of density 2.14 $gcm^{-3}$ which breaks down readily into sodium carbonate and oxygen having a bleaching or oxidizing action.

Sodium carbonate peroxohydrate was first obtained in 1899 by precipitation with ethanol from a solution of sodium carbonate in hydrogen peroxide, but was mistakenly regarded as a peroxycarbonate. Only in 1909 was the compound recognized as the hydrogen peroxide addition compound; nevertheless, the historical name "sodium percarbonate" has persisted in the art.

Industrially, sodium percarbonate is produced predominantly by precipitation from aqueous solution (known as the wet process). In this process, aqueous solutions of sodium carbonate and hydrogen peroxide are combined and the sodium percarbonate is precipitated by means of salting agents (predominantly sodium chloride), crystallizing auxiliaries (for example poly-phosphates, polyacrylates), and stabilizers (for example, $Mg2^{+}$ions). The precipitated salt, which still contains from 5 to 12% by weight of the mother liquor, is subsequently centrifuged and dried in fluidized-bed driers at 90° C. The bulk density of the finished product may vary between 800 and 1 200 g/l according to the production process. Generally, the percarbonate is stabilized by an additional coating. Coating processes, and substances used for the coating, are widely described in the patent literature. Fundamentally, it is possible in accordance with the invention to use all commercially customary percarbonate types, as supplied, for example, by Solvay Interox, Degussa, Kemira or Akzo.

Further bleaches which may be used are, for example, sodium perborate tetrahydrate and sodium perborate monohydrate, peroxypyrophosphates, citrate perhydrates, and $H_2O_2$-donating peracidic salts or peracids, such as perbenzoates, peroxophthalates, diperazelaic acid, phthaloimino peracid or diperdodecanedioic acid. Also in the case of the use of the bleaches, it is possible to dispense with the use of surfactants and/or builders, thereby making it possible to produce pure bleach tablets. If such bleach tablets are to be used for textile laundry, preference is given to a combination of sodium percarbonate with sodium sesquicarbonate, irrespective of which other ingredients are present in the shaped bodies. If cleaning product tablets or bleach tablets for machine dishwashing are being produced, then the bleaches used may also be those from the group of organic bleaches. Typical organic bleaches are the diacyl peroxides, such as dibenzoyl peroxide, for example. Further typical organic bleaches are the peroxy acids, particular examples being the alkyl peroxy acids and the aryl peroxy acids. Preferred representatives are (a) peroxybenzoic acid and its ring-substituted derivatives, such as alkylperoxy-benzoic acids, and also peroxy-a-naphthoic acid and magnesium monoperphthalate, (b) aliphatic or substituted aliphatic peroxy acids, such as peroxylauric acid, peroxystearic acid, ϵ-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxy dicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid and N,N-terephthaloyldi (6-aminopercaproic acid) may be used.

Bleaches in shaped bodies for machine dishwashing may also be substances which release chlorine or bromine. Among suitable chlorine- or bromine-releasing materials, examples include heterocyclic N-bromoamides and N-chloroamides, examples being trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

In order to achieve an improved bleaching effect when washing or cleaning at temperatures of 60° C. and below, it is possible to incorporate bleach activators. Bleach activators, which boost the action of the bleaches, are for example, compounds containing one or more N-acyl and/or O-acyl groups, such as substances from the class of the anhydrides, esters, imides and acylated imidazoles or oximes. Examples are tetraacetylethylenediamine (TAED), tetra-acetylmethylenediamine (TAMD), and tetraacetylhexylenediamine (TAHD), and also pentaacetylglucose (PAG), 1,5-diacetyl-2,2-dioxohexahydro-1,3,5-triazine (DADHT), and isatoic anhydride (ISA).

Bleach activators which may be used are compounds which under perhydrolysis conditions give rise to aliphatic peroxo carboxylic acids having preferably 1 to 10 carbon atoms, in particular 2 to 4 carbon atoms, and/or substituted or unsubstituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, in particular tetraacetylethylenediamine (TAED), acylated triazine derivatives, in particular 1,5-diacetyl-2, 4-dioxohexahydro-1,3,5-triazine (DADHT), acylated glycolurils, in particular tetraacetylglycoluril (TAGU), N-acyl imides, in particular N-nonanoylsuccinimide (NOSI), acylated phenolsulfonates, in particular n-nonanoyl- or iso-nonanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran, n-methylmorpholiniumacetonitrile methylsulfate (MMA), and the enol esters known from German Patent Applications DE 196 16 693 and DE 196 16 767, and also acetylated sorbitol and mannitol and/or mixtures thereof (SORMAN), acylated sugar derivatives, in particular pentaacetylglucose (PAG), pentaacetyl-fructose, tetraacetylxylose and octaacetyllactose, and acetylated, optionally N-alkylated glucamine and gluconolactone, and/or N-acylated lactams, for example, N-benzoylcaprolactam. Hydrophilically substituted acylacetals and acyllactams are likewise used with preference. Combinations of conventional bleach activators may also be used.

In addition to the conventional bleach activators, or instead of them, it is also possible to incorporate so-called bleaching catalysts. These substances are bleach-boosting transition metal salts or transition metal complexes such as, for example, Mn-, Fe-, Co-, Ru- or Mo-salen complexes or -carbonyl complexes. Other bleaching catalysts which can be used include Mn, Fe, Co, Ru, Mo, Ti, V and Cu complexes with N-containing tripod ligands, and also Co-, Fe-, Cu- and Ru-ammine complexes.

Preference is given to the use of bleach activators from the group of polyacylated alkylenediamines, especially tetraacetylethylenediamine (TAED), N-acylimides, in particular N-nonanoylsuccinimide (NOSI), acylated phenolsulfonates, especially n-nonanoyl- or isononanoyloxybenzenesulfonate (n- or iso-NOBS), n-methylmorpholiniumacetonitrile methylsulfate (MMA), preferably in amounts of up to 10% by weight, in particular from 0.1% by weight to 8% by weight, more particularly from 2 to 8% by weight, and particularly preferably from 2 to 6% by weight, based on the overall composition.

Bleach-boosting transition metal complexes, in particular those with the central atoms Mn, Fe, Co, Cu, Mo, V, Ti and/or Ru, preferably selected from the group of manganese and/or cobalt salts and/or complexes, particularly preferably from cobalt ammine complexes, cobalt acetato complexes, cobalt carbonyl complexes, the chlorides of cobalt or manganese, and manganese sulfate, are used in customary amounts, preferably in an amount of up to 5% by weight, in particular from 0.0025% by weight to 1% by weight, and particularly preferably from 0.01% by weight to 0.25% by weight, based in each case on the overall composition. In specific cases, however, it is also possible to use a greater amount of bleach activator.

Further preferred laundry detergent or cleaning product shaped bodies are those in which at least one of the non-compressed parts contains silver protectants from the group of the triazoles, benzotriazoles, bisbenzotriazoles, aminotriazoles, alkylaminotriazoles and the transition metal salts or transition metal complexes, particularly preferably benzotriazole and/or alkylaminotriazole, in amounts of from 0.01 to 5% by weight, preferably from 0.05 to 4% by weight, and in particular from 0.5 to 3% by weight, based in each case on the mass.

Said corrosion inhibitors may likewise be incorporated into the masses for processing in order to protect the ware or the machine, particular importance in the field of machine dishwashing being attached to silver protectants. The known substances of the prior art may be used. In general it is possible to use, in particular, silver protectants selected from the group consisting of triazoles, benzotriazoles, bisbenzotriazoles, aminotriazoles, alkylamino-triazoles, and transition metal salts or transition metal complexes. Particular preference is given to the use of benzotriazole and/or alkylaminotriazole. Frequently encountered in cleaning formulations, furthermore, are agents containing active chlorine, which may significantly reduce corrosion of the silver surface. In chlorine-free cleaning products, use is made in particular of oxygen-containing and nitrogen-containing organic redox-active compounds, such as divalent and trivalent phenols, e.g. hydroquinone, pyrocatechol, hydroxyhydroquinone, gallic acid, phloroglucinol, pyrogallol, and derivatives of these classes of compound. Inorganic compounds in the form of salts and complexes, such as salts of the metals Mn, Ti, Zr, Hf, V, Co and Ce, also find frequent application. Preference is given in this context to the transition metal salts selected from the group consisting of manganese and/or cobalt salts and/or complexes, particularly preferably cobalt ammine complexes, cobalt acetato complexes, cobalt carbonyl complexes, the chlorides of cobalt or of manganese and manganese sulfate. Similarly, zinc compounds may be used to prevent corrosion on the ware.

If corrosion inhibitors are used in multiphase shaped bodies, it is preferred to separate them from the bleaches. Accordingly, laundry detergent or cleaning product shaped bodies wherein one of the noncompressed parts comprises bleaches while another one comprises corrosion inhibitors are preferred.

The separation of the bleaches from other ingredients may also be advantageous. Laundry detergent or cleaning product shaped bodies of the invention wherein noncompressed parts comprise bleaches while another comprises enzymes are likewise preferred. Suitable enzymes here include in particular those from the classes of the hydrolases such as the proteases, esterases, lipases or lipolytic enzymes, amylases, cellulases or other glycosyl hydrolases, and mixtures of said enzymes. In the washing, all of these hydrolases contribute to removing stains, such as proteinaceous, fatty or starchy marks and graying. Cellulases and other glycosyl hydrolases may, furthermore, contribute, by removing pilling and microfibrils, to the retention of color and to an increase in the softness of the textile. For bleaching, and/or for inhibiting color transfer it is also possible to use oxidoreductases. Especially suitable enzymatic active substances are those obtained from bacterial strains or fungi such as Bacillus subtilis, Bacillus licheniformis, Streptomyceus griseus, Coprinus cinereus and Humicola insolens, and also from genetically modified variants thereof. Preference is given to the use of proteases of the subtilisin type, and especially to proteases obtained from Bacillus lentus. Of particular interest in this context are enzyme mixtures, examples being those of protease and amylase or protease and lipase or lipolytic enzymes, or protease and cellulase or of cellulase and lipase or lipolytic enzymes or of protease, amylase and lipase or lipolytic enzymes, or protease, lipase or lipolytic enzymes and cellulase, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases. The cellulases used are preferably cellobiohydrolases, endoglucanases and endoglucosidases, which are also called cellobiases, and mixtures thereof. Because different types of cellulase differ in their CMCase and Avicelase activities, specific mixtures of the cellulases may be used to establish the desired activities.

In cleaning product shaped bodies for machine dishwashing, naturally, different enzymes are used in order to take account of the different substrates treated and different types of soiling. Suitable enzymes here include in particular those from the classes of the hydrolases such as the proteases, esterases, lipases or lipolytic enzymes, amylases, glycosyl hydrolases, and mixtures of said enzymes. All of these hydrolases contribute to removing stains, such as proteinaceous, fatty or starchy marks. For bleaching, it is also possible to use oxidoreductases. Especially suitable enzymatic active substances are those obtained from bacterial strains or fungi such as Bacillus subtilis, Bacillus licheniformis, Streptomyces griseus, Coprinus cinereus and Humicola insolens, and also from genetically modified variants thereof. Preference is given to the use of proteases of the subtilisin type, and especially to proteases obtained from Bacillus lentus. Of particular interest in this context are enzyme mixtures, examples being those of protease and amylase or protease and lipase or lipolytic enzymes, or of protease, amylase and lipase or lipolytic enzymes, or protease, lipase or lipolytic enzymes, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases.

The enzymes may be adsorbed on carrier substances or embedded in sheathing substances in order to protect them against premature decomposition. The propart of the enzymes, enzyme mixtures or enzyme granules may be, for example, from about 0.1 to 5% by weight, preferably from 0.5 to about 4.5% by weight, based in each case on the noncompressed part.

Further ingredients which may, in the context of the process according to the invention, be part of one or more noncompressed part(s) are, for example, cobuilders, dyes, optical brighteners, fragrances, soil release compounds, soil repellents, antioxidants, fluorescence agents, foam inhibitors, silicone fluids and/or paraffin oils, color transfer inhibitors, graying inhibitors, detergency boosters, etc. These substances are described below.

Organic builder substances which may be used are, for example, the polycarboxylic acids, usable in the form of their sodium salts, the term polycarboxylic acids meaning those carboxylic acids which carry more than one acid function. Examples of these are citric acid, adipic acid, succinic acid, glutaric acid, malic acid, tartaric acid, maleic acid, fumaric acid, sugar acids, amino carboxylic acids, nitrilotriacetic acid (NTA), provided such use is not objectionable on ecological grounds, and also mixtures thereof. Preferred salts are the salts of the polycarboxylic acids such as citric acid, adipic acid, succinic acid, glutaric acid, tartaric acid, sugar acids, and mixtures thereof.

The acids per se may also be used. In addition to their builder effect, the acids typically also possess the property of an acidifying component and thus also serve to establish a lower and milder pH of laundry detergents or cleaning products. In this context, mention may be made in particular of citric acid, succinic acid, glutaric acid, adipic acid, gluconic acid, and any desired mixtures thereof.

Also suitable as builders are polymeric poly-carboxylates; these are, for example, the alkali metal salts of polyacrylic acid or of polymethacrylic acid, examples being those having a relative molecular mass of from 500 to 70 000 g/mol.

The molecular masses reported for polymeric polycarboxylates, for the purposes of this document, are weight-average molecular masses, Mw, of the respective acid form, determined basically by means of gel permeation chromatography (GPC) using a UV detector. The measurement was made against an external polyacrylic acid standard, which owing to its structural similarity to the polymers under investigation provides realistic molecular weight values. These figures differ markedly from the molecular weight values obtained using poly-styrenesulfonic acids as the standard. The molecular masses measured against polystyrenesulfonic acids are generally much higher than the molecular masses reported in this document.

Suitable polymers are, in particular, polyacrylates, which preferably have a molecular mass of from 2 000 to 20 000 g/mol. Owing to their superior solubility, preference in this group may be given in turn to the short-chain polyacrylates, which have molar masses of from 2 000 to 10 000 g/mol, and particularly preferably from 3 000 to 5 000 g/mol.

Also suitable are copolymeric polycarboxylates, especially those of acrylic acid with methacrylic acid and of acrylic acid or methacrylic acid with maleic acid. Copolymers which have been found particularly suitable are those of acrylic acid with maleic acid which contain from 50 to 90% by weight acrylic acid and from 50 to 10% by weight maleic acid. Their relative molecular mass, based on free acids, is generally from 2 000 to 70 000 g/mol, preferably from 20 000 to 50 000 g/mol, and in particular from 30 000 to 40 000 g/mol.

The (co)polymeric polycarboxylates can be used either as powders or as aqueous solutions. The (co)polymeric polycarboxylate content of the compositions is preferably from 0.5 to 20% by weight, in particular from 3 to 10% by weight.

In order to improve the solubility in water, the polymers may also contain allylsulfonic acids, such as allyloxybenzenesulfonic acid and methallylsulfonic acid, for example, as monomers.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Further preferred copolymers are those whose monomers are preferably acrolein and acrylic acid/acrylic acid salts, and, respectively, acrolein and vinyl acetate.

Similarly, further preferred builder substances that may be mentioned include polymeric amino dicarboxylic acids, their salts or their precursor substances. Particular preference is given to polyaspartic acids and their salts and derivatives, which have not only cobuilder properties but also a bleach-stabilizing action.

Further suitable builder substances are polyacetals, which may be obtained by reacting dialdehydes with polyol carboxylic acids having 5 to 7 carbon atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, examples being oligomers and polymers of carbohydrates, which may be obtained by partial hydrolysis of starches. The hydrolysis can be conducted by customary processes, for example, acid-catalyzed or enzyme-catalyzed processes. The hydrolysis products preferably have average molar masses in the range from 400 to 500 000 g/mol. Preference is given here to a polysaccharide having a dextrose equivalent (DE) in the range from 0.5 to 40, in particular from 2 to 30, DE being a common measure of the reducing effect of a polysaccharide compared with dextrose, which has a DE of 100. It is possible to use maltodextrins having a DE of between 3 and 20 and dried glucose syrups having a DE of between 20 and 37, and also so-called yellow dextrins and white dextrins having higher molar masses, in the range from 2 000 to 30 000 g/mol.

The oxidized derivatives of such dextrins are their products of reaction with oxidizing agents which are able to oxidize at least one alcohol function of the saccharide ring to the carboxylic acid function. A product oxidized on $C_6$ of the saccharide ring may be particularly advantageous.

Oxydisuccinates and other derivatives of disuccinates, preferably ethylenediaminedisuccinate, are further suitable cobuilders. EthylenediamineN,N'-disuccinate (EDDS) is used preferably in the form of its sodium or magnesium salts. Further preference in this context is given to glycerol disuccinates and glycerol trisuccinates as well. Suitable use amounts in formulations containing zeolite and/or silicate are from 3 to 15% by weight.

Examples of further useful organic cobuilders are acetylated hydroxycarboxylic acids and their salts, which may also be present in lactone form and which contain at least 4 carbon atoms, at least one hydroxyl group, and not more than two acid groups.

A further class of substance having cobuilder properties is represented by the phosphonates. These are, in particular, hydroxyalkanephosphonates and aminoalkanephosphonates. Among the hydroxyalkane-phosphonates, 1-hydroxyethane-1,1-diphosphonate (HEDP) is of particular importance as a cobuilder. It is preferably used as the sodium salt, the disodium salt being neutral and the tetrasodium salt giving an alkaline (pH 9) reaction. Suitable aminoalkanephosphonates are preferably ethylenediaminetetramethylenephosphonate (EDTMP), diethylenetriaminepentamethylenephosphonate (DTPMP), and their higher homologs. They are preferably used in the form of the neutrally reacting sodium salts, e.g., as the hexasodium salt of EDTMP or as the hepta- and octa-sodium salt of DTPMP. As a builder in this case, preference is given to using HEDP from the class of the phosphonates. Furthermore, the aminoalkanephosphonates have a pronounced heavy-metal-binding capacity. Accordingly, and especially if the compositions also comprise bleach, it may be preferred to use aminoalkanephosphonates, especially DTPMP, or to use mixtures of said phosphonates.

Furthermore, all compounds capable of forming complexes with alkaline earth metal ions may be used as cobuilders.

In order to enhance the esthetic impression of the laundry detergent and cleaning product shaped bodies of the invention, they may in whole or in part be colored with appropriate dyes. Particular optical effects may be achieved if, where shaped bodies are produced from two or more masses, the masses for processing are differently colored. Preferred dyes, whose selection presents no difficulty whatsoever to the skilled worker, have a high level of storage stability and insensitivity toward the other ingredients of the compositions and to light and have no pronounced substantivity toward the substrates treated, such as textile fibers or parts of kitchen- or tableware, so as not to stain them.

Preference for use in the laundry detergent shaped bodies of the invention is given to all colorants which can be oxidatively destroyed in the wash process, and to mixtures thereof with suitable blue dyes, known as bluing agents. It has proven advantageous to use colorants which are soluble in water or at room temperature in liquid organic substances. Examples of suitable colorants are anionic colorants, e.g., anionic nitroso dyes. One possible colorant is, for example, naphthol green (Colour Index (CI) Part 1: Acid Green 1; Part 2: 10020) which as a commercial product is obtainable, for example, as Basacid® Green 970 from BASF, Ludwigshafen, and also mixtures thereof with suitable blue dyes. Further suitable colorants include Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-0, CI Acid Blue 183), Pigment Blue 15 (CI 74160), Supranol® Blue GLW (CAS 12219-32-8, CI Acid Blue 221), Nylosan® Yellow N-7GL SGR (CAS 61814-57-1, CI Acid Yellow 218) and/or Sandolan® Blue (CI Acid Blue 182, CAS 12219-26-0).

In the context of the choice of colorant it must be ensured that the colorants do not have too great an affinity toward the textile surfaces, and especially toward synthetic fibers. At the same time, it should also be borne in mind in choosing appropriate colorants that colorants have different stabilities with respect to oxidation. The general rule is that water-insoluble colorants are more stable to oxidation than water-soluble colorants. Depending on the solubility and hence also on the oxidation sensitivity, the concentration of the colorant in the laundry detergents and cleaning products varies. With readily water-soluble colorants, e.g., the abovementioned Basacid® Green, or the likewise abovementioned Sandolan® Blue, colorant concentrations chosen are typically in the range from a few $10^{-2}$ to $10^{-3}$% by weight. In the case of the pigment dyes, which are particularly preferred for reason of their brilliance but are less readily soluble in water, examples being the abovementioned Pigmosol® dyes, the appropriate concentration of the colorant in laundry detergents or cleaning products, in contrast, is typically from a few $10^{-3}$ to $10^{-4}$% by weight.

The laundry detergent and cleaning product shaped bodies of the invention may comprise one or more optical brighteners. These substances, which are also called "whiteners", are used in modern laundry detergents because even freshly washed and bleached white laundry has a slight yellow tinge. Optical brighteners are organic dyes which convert part of the invisible UV radiation of sunlight into longer-wave blue light. The emission of this blue light fills the "gap" in the light reflected by the textile, so that a textile treated with optical brightener appears whiter and brighter to the eye. Since the mechanism of action of brighteners necessitates their attachment to the fibers, a distinction is made in accordance with the fibers "to be dyed" between, for example, brighteners for cotton, nylon, or polyester fibers. The commercially customary brighteners suitable for incorporation into laundry detergents belong primarily to five structural groups: the stilbene group, the diphenylstilbene group, the coumarin-quinoline group, the diphenylpyrazoline group, and the group involving combination of benzoxazole or benzimidazole with conjugated systems. An overview of current brighteners can be found, for example, in G. Jakobi, A. Löhr, "*Laundry detergents and Textile Washing*", VCH-Verlag, Weinheim, 1987, pages 94 to 100. Examples of suitable brighteners are salts of 4,4'-bis[(4-anilino-6-morpholino-s-triazin-2-yl) amino]stilbene-2,2'-disul-fonic acid or compounds of similar structure which instead of the morphilino group carry a diethanolamino group, a methylamino group, an anilino group, or a 2-methoxyethylamino group. Furthermore, brighteners of the substituted diphenylstyryl type may be present, examples being the alkali metal salts of 4,4'-bis(2-sulfostyryl) biphenyl, 4,4'-bis(4-chloro-3-sulfostyryl)-biphenyl, or 4-(4-chlorostyryl)-4'-(2-sulfostyryl)-biphenyl. Mixtures of the abovementioned brighteners may also be used.

Fragrances are added to the compositions of the invention in order to improve the esthetic appeal of the products which are formed and to provide the consumer with not only the performance but also a visually and sensorially "typical and unmistakable" product. As perfume oils and/or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butyl-cyclohexyl acetate, linalyl acetate, dimethyl-benzylcarbinyl acetate, phenylethyl acetate, linalyl benzoate, benzyl formate, ethyl methylphenylglycinate, allyl cyclo-hexylpropionate, styrallyl propionate, and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol, and terpineol; the hydrocarbons include primarily the terpenes such as limonene and pinene. Preference, however, is given to the use of mixtures of different odorants, which together produce an appealing fragrance note. Such perfume oils may also contain natural odorant mixtures, as are obtainable from plant sources, examples being pine oil, citrus oil, jasmine oil, patchouli oil, rose oil or ylang—ylang oil. Likewise suitable are clary sage oil, camomile oil, clove oil, balm oil, mint oil, cinnamon leaf oil, lime blossom oil, juniperberry oil, vetiver oil, olibanum oil, galbanum oil and labdanum oil, and also orange blossom oil, neroliol, orange peel oil, and sandalwood oil.

The fragrance content of the laundry detergent and cleaning product shaped bodies prepared in accordance with the invention is usually up to 2% by weight of the overall formulation. The fragrances may be incorporated directly into the compositions of the invention; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be additionally coated with further auxiliaries.

In addition, the laundry detergent and cleaning product shaped bodies may also comprise components which have a positive influence on the ease with which oil and grease are washed off from textiles (so-called soil repellents). This effect becomes particularly marked when a textile is soiled that has already been laundered previously a number of times with a laundry detergent of the invention comprising this oil- and fat-dissolving component. The preferred oil- and fat-dissolving components include, for example, nonionic cellulose ethers such as methylcellulose and methylhydroxypropylcellulose having a methoxy group content of from 15 to 30% by weight and a hydroxypropyl group content of from 1 to 15% by weight, based in each case on the nonionic cellulose ether, and also the prior art polymers of phthalic acid and/or terephthalic acid, and/or derivatives thereof, especially polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

Foam inhibitors which may be used in the compositions produced in accordance with the invention are suitably, for example, soaps, paraffins or silicone oils, which may if desired have been applied to carrier materials.

Graying inhibitors have the function of keeping the dirt detached from the fiber in suspension in the liquor and so preventing the redeposition of the dirt. Suitable for this purpose are water-soluble colloids, usually organic in nature, examples being the water-soluble salts of polymeric carboxylic acids, glue, gelatin, salts of ethersulfonic acids of starch or of cellulose, or salts of acidic sulfuric esters of cellulose or of starch. Water-soluble polyamides containing acidic groups are also suitable for this purpose. Furthermore, soluble starch preparations and starch products other than those mentioned above may be used, examples being degraded starch, aldehyde starches, etc. Polyvinylpyrrolidone may also be used. Preference, however, is given to the use of cellulose ethers such as carboxymethylcellulose (Na salt), methylcellulose, hydroxyalkylcellulose, and mixed ethers such as methylhydroxyethylcellulose, methylhydroxypropylcellulose, methylcarboxymethylcellulose and mixtures thereof in amounts of from 0.1 to 5% by weight, based on the compositions.

Since sheetlike textile structures, especially those of filament rayon, viscose rayon, cotton and blends thereof, may tend to crease, because the individual fibers are susceptible to bending, buckling, compressing and pinching transverse to the fiber direction, the compositions produced in accordance with the invention may comprise synthetic crease control agents. These include, for example, synthetic products based on fatty acids, fatty acid esters, fatty acid amides, fatty acid alkylol esters, fatty acid alkylolamides, or fatty alcohols, which are usually reacted with ethylene oxide, or else products based on lecithin or on modified phosphoric esters.

In order to combat microorganisms, the compositions produced in accordance with the invention may comprise antimicrobial active substances. In this context a distinction is made, depending on antimicrobial spectrum and mechanism of action, between bacteriostats and bactericides, fungiostats and fungicides, etc. Examples of important substances from these groups are benzalkonium chlorides, alkylarylsulfonates, halophenols, and phenylmercuric acetate, it also being possible to dispense with these compounds entirely.

In order to prevent unwanted changes to the compositions and/or the treated textiles as a result of oxygen exposure and other oxidative processes, the compositions may comprise antioxidants. This class of compound includes, for example, substituted phenols, hydroquinones, pyrocatechols and aromatic amines, and also organic sulfides, polysulfides, dithiocarbamates, phosphites, and phosphonates.

Increased wear comfort may result from the additional use of antistats which are additionally added to the compositions produced in accordance with the invention. Antistats increase the surface conductivity and thus enable better dissipation of charges that are formed. External antistats are generally substances having at least one hydrophilic molecule ligand, and provide a more or less hygroscopic film on the surfaces. These antistats, which are usually interface-active, may be subdivided into nitrogen-containing (amines, amides, quaternary ammonium compounds), phosphorus-containing (phosphoric esters), and sulfur-containing (alkylsulfonates, alkyl sulfates) antistats. External antistats are described, for example, in Patent Applications FR 1,156,513, GB 873 214 and GB 839 407. The lauryl-(or stearyl-) dimethylbenzylammonium chlorides disclosed here are suitable as antistats for textiles and as additives to laundry detergents, in which case, additionally, a finishing effect is obtained.

In order to improve the water absorption capacity, the rewettability of the treated textiles, and to facilitate ironing of the treated textiles, silicone derivatives, for example, may be used in the compositions produced in accordance with the invention. These derivatives additionally improve the rinse-out behavior of the compositions, by virtue of their foam inhibiting properties. Examples of preferred silicone derivatives are polydialkylsiloxanes or alkylaryl-siloxanes where the alkyl groups have one to five carbon atoms and are totally or partially fluorinated. Preferred silicones are polydimethylsiloxanes, which may if desired have been derivatized and in that case are amino-functional or quaternized, or have Si—OH, Si—H and/or Si—Cl bonds. The viscosities of the preferred silicones at 25° C. are in the range between 100 and 100 000 centistokes, it being possible to use the silicones in amounts of between 0.2 and 5% by weight, based on the overall composition.

Finally, the compositions produced in accordance with the invention may also comprise UV absorbers, which attach to the treated textiles and improve the light stability of the fibers. Compounds which have these desired properties are, for example, the compounds which are active via radiationless deactivation, and derivatives of benzophenone having substituents in position(s) 2 and/or 4. Also suitable are substituted benzotriazoles, acrylates which are phenyl-substituted in position 3 (cinnamic acid derivatives), with or without cyano groups in position 2, salicylates, organic Ni complexes, and also natural substances such as umbelliferone and the endogenous urocanic acid.

With all of the abovementioned ingredients, advantageous properties may result from separating them from other ingredients and/or from formulating them together with certain other ingredients. In the case of multiphase shaped bodies, the individual phases may also differ in the amount they contain of the same ingredient, as a result of which advantages may be achieved.

In particular, preference is given here to laundry detergent or cleaning product shaped bodies according to the invention in which the noncompressed part (a) comprises builders in amounts from 1 to 100% by weight, preferably from 5 to 95% by weight, particularly preferably from 10 to 90% by weight and in particular from 20 to 85% by weight, in each case based on the weight of the noncompressed part (a).

Preference is also given to laundry detergent or cleaning product shaped bodies in which the noncompressed part (a) comprises phosphate(s), preferably alkali metal phosphate (s), particularly preferably pentasodium or pentapotassium triphosphate (sodium or potassium tripolyphosphate), in amounts of from 20 to 80% by weight, preferably from 25 to 75% by weight and in particular from 30 to 70% by weight, in each case based on the weight of the noncompressed part (a).

Preference is likewise given to laundry detergent or cleaning product shaped bodies in which the noncompressed part (a) comprises carbonate(s) and/or hydrogencarbonate (s), preferably alkali metal carbonates, particularly preferably sodium carbonate, in amounts of from 5 to 50% by weight, preferably from 7.5 to 40% by weight and in particular from 10 to 30% by weight, in each case based on the weight of the noncompressed part (a).

Laundry detergent or cleaning product shaped bodies in which the noncompressed part (a) comprises silicate(s), preferably alkali metal silicates, particularly preferably crystalline or amorphous alkali metal disilicates, in amounts of from 10 to 60% by weight, preferably from 15 to 50% by weight and in particular from 20 to 40% by weight, in each case based on the weight of the noncompressed part (a) are also preferred embodiments of the present invention.

Preference is likewise given to laundry detergent or cleaning product shaped bodies in which the noncompressed part (a) has total surfactant contents below 5% by weight, preferably below 4% by weight, particularly preferably below 3% by weight and in particular below 2% by weight, in each case based on the weight of the noncompressed part (a).

Further preferred laundry detergent or cleaning product shaped bodies are those in which the noncompressed part (a) comprises bleaches from the group of oxygen or halogen bleaches, in particular chlorine bleaches, particularly preferably sodium perborate and sodium percarbonate, in amounts of from 2 to 25% by weight, preferably from 5 to 20% by weight and in particular from 10 to 15% by weight, in each case based on the weight of the noncompressed part (a).

Furthermore, preference is given to laundry detergent or cleaning product shaped bodies in which the noncompressed part (a) comprises bleach activators from the groups of polyacylated alkylenediamines, in particular tetraacetylethylenediamine (TAED), of N-acylimides, in particular N-nonanoylsuccinimide (NOSI), of acylated phenolsulfonates, in particular n-nonanoyl- or isononanoyloxybenzenesulfonate (n- or iso-NOBS) and n-methylmorpholiniumacetonitrile methylsulfate (MMA), in amounts of from 0.25 to 15% by weight, preferably from 0.5 to 10% by weight and in particular from 1 to 5% by weight, in each case based on the weight of the noncompressed part (a).

Laundry detergent or cleaning product shaped bodies in which the noncompressed part (a) comprises silver protectants from the group of triazoles, of benzotriazoles, of bisbenzotriazoles, of aminotriazoles, of alkylaminotriazoles and of transition metal salts or complexes, particularly preferably benzotriazole and/or alkylaminotriazole, in amounts of from 0.01 to 5% by weight, preferably from 0.05 to 4% by weight and in particular from 0.5 to 3% by weight, in each case based on the weight of the noncompressed part (a), are preferred embodiments of the present invention.

A further preferred embodiment of the present invention are laundry detergent or cleaning product shaped bodies in which the noncompressed part (a) further comprises one or more substances from the group of enzymes, corrosion inhibitors, deposit inhibitors, cobuilders, dyes and/or fragrances in total amounts of from 6 to 30% by weight, preferably from 7.5 to 25% by weight and in particular from 10 to 20% by weight, in each case based on the weight of the noncompressed part (a).

Last but not least, particular preference is also given to the laundry detergent or cleaning product shaped bodies in which the second noncompressed part (b) is a coated, preferably multicoated shaped body which is stuck into the cavity of the noncompressed part (a).

The laundry detergent and cleaning product shaped bodies according to the invention dissolve completely in the wash or cleaning cycle, advantages possibly being afforded, as mentioned above, if the different regions have different solubility rates. As a result of the differing solubility rates, not only can the release of certain ingredients at certain timepoints be changed in a targeted manner, but also the properties of the wash or cleaning liquor. Thus, for example, preference is given to laundry detergent and cleaning product shaped bodies in which the pH of a 1% strength by weight solution of the basic shaped body in water is in the range from 8 to 12, preferably from 9 to 11 and in particular from 9.5 to 10.

In addition to this, preference is given to laundry detergent and cleaning product shaped bodies in which the pH of a 1% strength by weight solution of the total shaped body in water is in the range from 7 to 11, preferably from 7.5 to 10 and in particular from 8 to 9.5.

The laundry detergent or cleaning product shaped bodies according to the invention can be prepared in very different geometric shapes. For example, they can be prepared in predetermined three-dimensional shapes and predetermined sizes, suitable three-dimensional shapes being virtually all practicable designs, i.e., for example, in the form of bars, rods or ingots, cubes, blocks and corresponding three-dimensional elements having planar side faces, and in particular cylindrical designs with a circular or oval cross section. The latter design covers forms ranging from tablets through to compact cylinder lengths having a height to diameter ratio of more than 1.

The laundry detergent or cleaning product shaped bodies according to the invention can here be designed in each case as individual elements separate from one another, which corresponds to the predetermined dosing amount of the laundry detergent and/or cleaning product. However, it is likewise possible to design the individual noncompressed parts such that a majority of such mass units is combined in one compact, with, in particular, predefined intended breakage points providing for easy separation of smaller, parted units. For the use of textile laundry detergents in machines of the type customary in Europe, with a horizontally arranged mechanism, a design as tablets, in cylindrical or block form may be expedient, preference being given to a diameter/height ratio in the range from about 0.5:2 to 2:0.5.

The three-dimensional shape of another embodiment of the shaped body is adapted in its dimensions to the dispensing drawer of commercially available domestic washing machines so that the shaped bodies can be metered directly into the dispensing drawer without dosing aids, where they dissolve during the rinsing-in operation. It is, however, of course also possible to use the laundry detergent shaped bodies with a dosing aid without problems, and this is preferred in the context of the present invention.

A further preferred shaped body which can be produced has a platelike or barlike structure with alternating long thick and short thin segments, so that individual segments can be broken off from this "slab" at the intended breakage points, which represent the short thin segments, and introduced into the machine. This principle of the laundry detergent shaped body "slab" may also be realized in other geometric shapes, for example vertical triangles connected to one another only along one of their sides.

Such "slablike" strand sections may be produced after they have been cut to length by an aftertreatment step which comprises pressing a second blade or a second set of blades into the cut-to-length strand sections without dividing them. Superficial shaping or the production of positive or negative indicia may also take place according to the invention. Accordingly, preferred processes are those in which the cut-to-length shaped bodies are subjected to an aftertreatment step.

In addition to the impression of indicia, the aftertreatment step may also comprise the impression of patterns, shapes etc. In this way, it is possible, for example, to label universal laundry detergents produced in accordance with the invention with a t-shirt symbol, color laundry detergents produced according to the invention with a wool symbol, cleaning product shaped bodies for machine dishwashing produced according to the invention with symbols such as glasses, plates, pots, pans etc. No limits are imposed here on the creativity of product managers. Preferred processes according to the invention therefore comprise, as aftertreatment step, an additional shaping step, in particular impression.

A subsequent coating of the cut-to-length shaped bodies is also possible if the application of an additional coating is desired. Here, then, preference is given to processes in which the aftertreatment step involves the coating of the shaped bodies with a pourable material, preferably a pourable material with a viscosity of <5 000 mPas.

Irrespective of the number of phases and the type of aftertreatment, preference is generally given to laundry detergent or cleaning product shaped bodies which have a density of more than 800 $kgdm^{-3}$, preferably more than 900 $kgdm^{-3}$, particularly preferably more than 1 000 $kgdm^{-3}$ and in particular more than 1 100 $kgdm^{-3}$ In such shaped bodies, the advantages of the supply form of a compact laundry detergent or cleaning product become evident in a particularly clear manner.

The present invention further provides a process for the preparation of laundry detergent or cleaning product shaped bodies, comprising the steps (a) preparation of a first noncompressed part (a) which comprises active substance, (b) preparation of a second noncompressed part (b) which comprises active substance, (c) connecting of the two shaped body parts by joining or intermeshing them to give the shaped body.

The joining together can be a "pasting" known to the person skilled in the art, but it is also possible that the shaped body parts attach together merely as a result of their geometry. Processes according to the invention in which the adhesion between the shaped body parts (a) and (b) is aided by adhesion promoters are preferred.

Adhesion promoters which can be used are substances which give the shaped body surfaces to which they are applied sufficient adhesiveness ("stickiness") for the noncompressed parts applied in the subsequent process step to adhere permanently to the surface. Suitable in principle here are the substances mentioned in the relevant adhesives literature and, in particular, in the monographs thereto, where, in the context of the present invention, the application of melts which have an adhesion promoting action at elevated temperature, but are no longer sticky after cooling, but are solid, is of particular importance.

Processes according to the invention in which, as adhesion promoters, melts of one or more substances having a melting range of from 40° C. to 75° C. are applied to one or more surfaces of the shaped body part (a), after which (the) shaped body part(s) (b) is/are stuck on are, accordingly, preferred.

The adhesion promoters which are optionally applied are subjected to various requirements which relate firstly to the melt or solidification behavior, but secondly also to the material properties of the "bonding point" in the solidified range at ambient temperature. Since the layer of adhesion promoter applied to the shaped bodies must permanently hold the "stuck-on" noncompressed parts during transportation or storage, it must have high stability toward impact loading which arises, for example, during packaging or transportation. The adhesion promoters should therefore have either at least partial elastic or at least plastic properties in order to react to an impact loading which arises by elastic or plastic deformation, and not to break. The adhesion promoters should have a melting range in a temperature range in which the uncompresesd parts to be attached are not exposed to high thermal stress. On the other hand, however, the melting range must be sufficiently high in order still to provide effective adhesion of the attached noncompressed parts at at least slightly elevated temperature. According to the invention, the coating substances preferably have a melting point above 30° C. The breadth of the melting range of the adhesion promoters likewise has direct effects on the way the process is carried out: the shaped body provided with adhesion promoter must, in the process step which follows, be brought into contact with the noncompressed parts to be attached—in the interim, the adhesiveness must not be lost. After the incorporation of the active substances, the adhesiveness should be reduced as quickly as possible in order to avoid unnecessary time loss and to avoid caking and blockages in subsequent process steps or during handling and packaging. In the case of the use of melts, the reduction in the adhesiveness can be aided by cooling (for example by blowing with cold air).

It has proven advantageous if the adhesion promoters do not exhibit a sharply defined melting point, as usually arises in the case of pure, crystalline substances, but instead have a melting range which under certain circumstances spans several degrees Celsius.

The adhesion promoters preferably have a melting range between about 45° C. and about 75° C. This means in the present case that the melting range occurs within the given temperature interval and does not represent the breadth of the melting range. The breadth of the melting range is preferably at least 1° C., preferably about 2 to about 3° C.

The above-mentioned properties are usually satisfied by so-called waxes, which have already been described above in detail.

The adhesion promoters to be applied can be pure substances or mixtures of substances. In the latter case, the melt can comprise varying amounts of adhesion promoter and auxiliaries.

The principle described above serves for the delayed dissolution of the "stuck-on" noncompressed parts at a certain point in time, for example in the cleaning operation of a dishwashing machine, and can be used particularly advantageously if a low temperature (for example 55° C.) is used in the main rinse cycle, meaning that the active substance is released from the adhesive layer only in the clear-rinse cycle at higher temperatures (about 70° C.).

However, the stated principle can also be reversed in as much as the noncompressed part(s) is/are released from the adhesive layer not in a delayed manner, but in an accelerated manner. In the process according to the invention, this can be achieved in a simple manner by using as adhesion promoters, not dissolution-delaying agents, but dissolution-accelerating agents, such that the stuck-on noncompressed parts do not dissolve more slowly from the shaped body, but more rapidly. In contrast to the sparingly water-soluble adhesion promoters described above, adhesion promoters preferred for rapid dissolution are readily water-soluble. The solubility of the adhesion promoters in water can be significantly increased further by certain additives, for example by the incorporation of readily soluble salts or effervescent systems. Such dissolution-accelerated adhesion promoters (with or without additives of further solubility improvers) lead to rapid dissolution and release of the active substances at the start of the cleaning operation.

Dissolution acceleration can also be achieved or aided by certain geometric factors. Details on this are given below.

Apart from melts, it is also possible to apply other substances as adhesion promoters in the process according to the invention. Suitable for this purpose are, for example, concentrated salt solutions which, after application of the active substances by crystallization or vaporization/evaporation, are converted to an adhesion-promoting salt crust. It is, of course, also possible to use supersaturated solutions or solutions of salts in solvent mixtures.

As adhesion promoters, it is also possible to use solutions or suspensions of water-soluble or water-dispersible polymers, preferably polycarboxylates. Said substances have already been described above on the basis of their cobuilder properties.

Further particularly suitable adhesion promoters are solutions of water-soluble substances from the group of (acetylated) polyvinyl alcohol, polyvinylpyrrolidone, gelatin and mixtures thereof. These substances too have already been described in detail.

Preferred adhesion promoters which can be used as aqueous solution in the process according to the invention consist of a polymer having a molar mass between 5 000 and 500 000 daltons, preferably between 7 500 and 250 000 daltons and in particular between 10 000 and 100 000 daltons. The adhesion promoter layer present between the individual shaped body regions after drying of the adhesion promoter preferably has a thickness of from 1 to 150 $\mu$m, preferably from 2 to 100 $\mu$m, particularly preferably from 5 to 75 $\mu$m and in particular from 10 to 50 $\mu$m.

The present invention further provides both a process for the preparation of laundry detergent or cleaning product shaped bodies which involves the steps (a) preparation of a first noncompressed part (a) which comprises active substance and has at least one cavity, (b) preparation of a second noncompressed part (b) which contains active substance, (c) connecting of the two shaped body parts by at least propartate insertion of the shaped body part (b) into the cavity of the shaped body part (a), and also a process for the preparation of laundry detergent and cleaning product shaped bodies which comprises the steps (a) preparation of a first noncompressed part (a) which comprises active substance and has at least one cavity, (b) insertion of active substance into the cavity(ies) of the shaped body part (a) to form a shaped body part (b), (c) fixing of the shaped body part (b) in the cavity of the shaped body part (a).

With regard to noncompressed parts having one or more cavities, reference may be made to the details above. Preferred processes are those in which the insertion of the active substance in step (b) takes place by pouring in liquid to pasty media, by scattering in particulate media or by inserting preprepared noncompressed shaped body parts.

As already described in detail above, preference is given to processes in which the fixing in step (c) is carried out by coating the entire shaped body or the shaped body surfaces which have cavities.

Processes in which the fixing in step (c) is carried out by hardening, spraying with adhesion promoters, sintering, gelatinization or pasting-on of further shaped body constituents, are also preferred according to the invention.

Specifically, these are steps which have already been described in detail above, for which reason reference is made to the previous statements. Preferred processes are, on the one hand, processes in which process step (a) involves sintering, and on the other hand also processes in which process step (a) involves casting.

Processes in which process step (a) involves the solidification of solutions ("gelatinization") and processes in which process step (a) comprises hardening are also preferred according to the invention.

Entirely analogous statements can in turn be made for the preparation of noncompressed parts (b). Here too, preference is given to processes in which either process step (b) involves sintering, or in which process step (b) involves casting, or in which process step (b) involves the solidification of solutions ("gelatinization").

Last but not least, preference is also given to processes in which process step (b) involves hardening.

A special feature is then possible if the noncompressed part (a) has one or more cavities since then processes are possible in which the noncompressed part (b) is particulate.

These particles can then be introduced, for example, into the cavity(ies), where they are fixed using a coating layer or by spraying with adhesion promoters in the manner described above.

The present invention further provides a process for the preparation of laundry detergent or cleaning product shaped bodies having controlled active substance release which comprises coating an noncompressed shaped body washing- or cleaning-active preparation with a polymer and sticking it onto or into an noncompressed shaped body of a washing- or cleaning-active preparation.

Here too, preference is given to processes in which the coating materials used are polymers containing amino groups, preferably copolymers of basic monomers, such as dialkylaminoalkyl (meth)acrylates with acrylic esters. These polymers have been described in detail above.

Entirely in analogy with the statements above, in the case of this process variant too, preference is given to processes in which the coating materials used are amopholytic polymers, preferably copolymers of basic monomers, such as dialkylaminoalkyl (meth)acrylates with substituted or unsubstituted acrylic acids and/or (meth)acrylic acids.

Following production, the laundry detergent and cleaning product shaped bodies of the invention may be packed, the use of certain packaging systems having proven particularly useful since these packaging systems on the one hand increase the storage stability of the ingredients but on the other hand also, surprisingly, improve markedly the long-term adhesion of the cavity filling. The present invention therefore further provides a combination of (a) laundry detergent and/or cleaning product shaped body(s) of the invention and a packaging system containing the laundry detergent and/or cleaning product shaped body(s), said packaging system having a moisture vapor permeability rate of from 0.1 g/m$^2$/day up to less than 20 g/m$^2$/day if the packaging system is stored at 23° C. and a relative equilibrium humidity of 85%.

The packaging system of the combination of laundry detergent and cleaning product shaped body(s) and packaging system has, in accordance with the invention, a moisture vapor permeability rate of from 0.1 g/m$^2$/day to less than 20 g/m$^2$/day when the packaging system is stored at 23° C. and a relative equilibrium humidity of 85%. These temperature and humidity conditions are the test conditions specified in DIN Standard 53122, which allows minimal deviations (23±1° C., 85±2% relative humidity). The moisture vapor transmission rate of a given packaging system or material may be determined in accordance with further standard methods and is also described, for example, in ASTM Standard E-96-53T ("Test for measuring water vapor transmission of materials in sheet form") and in TAPPI Standard T464 m-45 ("Water vapor permeability of sheet materials at high temperature and humidity"). The measurement principle of common techniques is based on the water uptake of anhydrous calcium chloride which is stored in a container in the appropriate atmosphere, the container being closed at the top face with the material to be tested. From the surface area of the container closed with the material to be tested (permeation area), the weight gain of the calcium chloride, and the exposure time, the moisture vapor transmission rate may be calculated as follows:

$$FDDR = \frac{24 \cdot 10000}{A} \cdot \frac{x}{y} \quad [g/m^2/24\ h]$$

where A is the area of the material to be tested in $cm^2$, x is the weight gain of the calcium chloride in g, and y is the exposure time in h.

The relative equilibrium humidity, often referred to as "relative atmospheric humidity", is 85% at 23° C. when the moisture vapor transmission rate is measured in the context of the present invention. The ability of air to accommodate water vapor increases with temperature up to a particular maximum content, the so-called saturation content, and is specified in $g/m^3$. For example, 1 $m^3$ of air at 17° is saturated with 14.4 g of water vapor; at a temperature of 11°, saturation is reached with just 10 g of water vapor. The relative atmospheric humidity is the ratio, expressed as a percentage, of the actual water vapor content to the saturation content at the prevailing temperature. If, for example, air at 17° contains 12 $g/m^3$ water vapor, then the relative atmospheric humidity (RH)=(12/14.4).100=83%. If this air is cooled, then saturation (100% RH) is reached at the so-called dew point (in the example: 14°), i.e., on further cooling a precipitate is formed in the form of mist (dew). The humidity is determined quantitatively using hygrometers and psychrometers.

The relative equilibrium humidity of 85% at 23° C. can be established precisely, for example, in laboratory chambers with humidity control, to +/−2% RH depending on the type of apparatus. In addition, constant and well-defined relative atmospheric humidities are formed in closed systems at a given temperature over saturated solutions of certain salts, these humidities deriving from the phase equilibrium between water partial pressure, saturated solution, and sediment.

The combinations of the invention, comprising laundry detergent and cleaning product shaped bodies and packaging system, may of course in turn be packaged in secondary packaging, for example cartons or trays, there being no need to impose further requirements on the secondary packaging. The secondary packaging, accordingly, is possible but not necessary.

Packaging systems which are preferred in the context of the present invention have a moisture vapor transmission rate of from 0.5 $g/m^2$/day to less than 15 $g/m^2$/day.

Depending on the embodiment of the invention, the packaging system of the combination of the invention contains one or more laundry detergent and cleaning product shaped bodies. In accordance with the invention it is preferred either to design a shaped body such that it comprises one application unit of the laundry detergent and cleaning product, and to package this shaped body individually, or to pack into one packaging unit the number of shaped bodies which totals one application unit. In the case of an intended dose of 80 g of laundry detergent and cleaning product, therefore, it is possible in accordance with the invention to produce and package individually one laundry detergent and cleaning product shaped body weighing 80 g, but in accordance with the invention it is also possible to package two laundry detergent and cleaning product shaped bodies each weighing 40 g into one pack in order to arrive at a combination in accordance with the invention. This principle can of course be extended, so that, in accordance with the invention, combinations may also comprise three, four, five or even more laundry detergent and cleaning product shaped bodies in one packaging unit. Of course, two or more shaped bodies in a pack may have different compositions. In this way it is possible to separate certain components spatially from one another in order, for example, to avoid stability problems.

The packaging system of the combination of the invention may consist of a very wide variety of materials and may adopt any desired external forms. For cost reasons and for greater ease of processing, however, preference is given to packaging systems in which the packaging material has a low weight, is easy to process, and is cost-effective. In combinations which are preferred in accordance with the invention, the packaging system consists of a bag or pouch made of a single-layer or of laminated paper and/or plastic film.

The laundry detergent and cleaning product shaped bodies may be filled unsorted, i.e. as a loose heap, into a pouch made of said materials. However, for esthetic reasons and for the purpose of sorting the combinations into secondary packaging, it is preferred to fill the laundry detergent and cleaning product shaped bodies individually, or sorted into groups of two or more, into bags or pouches. For individual application units of the laundry detergent and cleaning product shaped bodies which are located in a bag or pouch, a term which has become established in the art is that of "flow pack". Flow packs of this kind may optionally then—again, preferably sorted—be packaged into outer packaging, which underscores the compact supply form of the shaped body.

The single-layer or laminated paper or polymer film bags or pouches preferred for use as packaging systems may be designed in a very wide variety of ways: for example, as inflated pouches without a center seam or as pouches with a center seam which are sealed by means of heat, adhesives, or adhesive tapes. Single-layer pouch and bag materials include the known papers, which may if appropriate be impregnated, and also polymer films, which may if appropriate be coextruded. Polymer films that can be used as a packaging system in the context of the present invention are specified, for example, in Hans Domininghaus, "*Die Kunststoffe und ihre Eigenschaften*", 3rd edition, VDI Verlag, Düsseldorf, 1988, page 193. FIG. 111 shown therein also gives indications of the water vapor permeability of the materials mentioned.

Combinations which are particularly preferred in the context of the present invention comprise as packaging system a bag or pouch made of a single-layer of or laminated plastic film having a thickness of from 10 to 200 μm, preferably from 20 to 100 μm and in particular from 25 to 50 μm.

Although it is possible in addition to the abovementioned films and papers to use wax-coated papers in the form of cartons as a packaging system for the laundry detergent and cleaning product shaped bodies, it is preferred in the context of the present invention for the packaging system not to comprise any cartons made of wax-coated paper. In the context of the present invention, the term "packaging system" always relates to the primary packaging of the shaped bodies, i.e., to the packaging whose inner face is in direct contact with the shaped body surface. No requirements whatsoever are imposed on any optional secondary packaging, meaning that all customary materials and systems can be used in this case.

As already mentioned above, the laundry detergent and cleaning product shaped bodies of the combination of the invention comprise further ingredients of laundry detergents and cleaning products, in varying amounts, depending on their intended use. Independently of the intended use of the shaped bodies, it is preferred in accordance with the invention for the laundry detergent and cleaning product shaped body(s) to have a relative equilibrium humidity of less than 30% at 35° C.

The relative equilibrium humidity of the laundry detergent and cleaning product shaped bodies may be determined in accordance with common methods, the following procedure having been chosen in the context of the present investigations: a water-impermeable 1 liter vessel with a lid which has a closable opening for the introduction of samples was filled with a total of 300 g of laundry detergent and cleaning product shaped bodies and held at a constant 23° C. for 24 h in order to ensure a uniform temperature of vessel and substance. The water vapor pressure in the space above the shaped bodies can then be determined using a hygrometer (Hygrotest 6100, Testoterm Limited, UK). The water vapor pressure is then measured every 10 minutes until two consecutive values show no deviation (equilibrium humidity). The abovementioned hygrometer permits direct display of the recorded values in % relative humidity.

Likewise preferred are embodiments of the combination of the invention wherein the packaging system is of resealable configuration. Combinations wherein the packaging system has a microperforation may also be realized advantageously in accordance with the invention.

What is claimed is:

1. A laundry detergent or cleaning product shaped body comprising:

(a) a first noncompressed part comprising an active substance; and (b) a further noncompressed part comprising an active substance, wherein the shaped body comprises one or more enzymes, said noncompressed parts being formed under pressures of no more than 0.1 kN/cm$^2$, and wherein (a) and (b) are not gelatinous at the same time, and wherein the noncompressed part (a) and the noncompressed part (b) each comprise a same active substance in different amounts.

2. The laundry detergent or cleaning product shaped body of claim 1, wherein the shaped body comprises one or more builders.

3. The laundry detergent or cleaning product shaped body of claim 2, wherein the noncompressed part (b) dissolves later or more slowly than the noncompressed part (a).

4. The laundry detergent or cleaning product shaped body of claim 2 wherein the noncompressed part (a) and the noncompressed part (b) have a weight ratio of (a) to (b) of 50:1 to 1:1.

5. The laundry detergent or cleaning product shaped body as claimed in claim 1, wherein the noncompressed part (b) does not completely surround the first noncompressed part (a).

6. The laundry detergent or cleaning product shaped body as claimed in claim 1, which further comprises, in addition to (a) and (b), one or more additional noncompressed parts.

7. The laundry detergent or cleaning product shaped body as claimed in claim 6, wherein the noncompressed part (a) has a plurality of cavities in which each other noncompressed part is present at least in part.

8. The laundry detergent or cleaning product shaped body as claimed in claim 1, wherein the noncompressed part (a) and the noncompressed part (b) each comprise at least one different active substance.

9. The laundry detergent or cleaning product shaped body as claimed in claim 1, wherein one of the noncompressed parts (a) or (b) comprises one or more bleaches, while the other part comprises one or more bleach activators.

10. The laundry detergent or cleaning product shaped body as claimed of claim 1, wherein one of the noncompressed parts (a) or (b) comprises one or more bleaches, while the other part comprises one or more enzymes.

11. The laundry detergent or cleaning product shaped body as claimed in claim 1, wherein one of the noncompressed parts (a) or (b) comprises one or more bleaches, while the ether part comprises one or more corrosion inhibitors.

12. The laundry detergent or cleaning product shaped body as claimed in claim 1, wherein one of the noncompressed parts (a) or (b) comprises one or more bleaches, while the other part comprises one or mere surfactants.

13. The laundry detergent or cleaning product shaped body as claimed in claim 12, wherein the surfactants comprise nonionic surfactants.

14. The laundry detergent or cleaning product shaped body as claimed in claim 13, wherein the nonionic surfactants comprise alkoxylated alcohols having 10 to 24 carbon atoms and 1 to 5 alkylene oxide units.

15. The laundry detergent or cleaning product shaped body as claimed in claim 1, wherein at least one noncompressed part is surrounded by a coating layer.

16. The laundry detergent or cleaning product shaped body as claimed in claim 15, wherein the noncompressed part (b) is attached to or within the noncompressed part (a) by the coating layer.

17. The laundry detergent or cleaning product shaped body as claimed in claim 15, wherein the coating layer comprises one or more substances selected from the group consisting of fatty acids, fatty alcohols, diols, esters, ethers, carboxylic acids, dicarboxylic acids, polyvinyl acetate (PVA), polyvinylpyrrolidone (PVP), polyvinyl alcohol (PVAl), polyethylene glycol (PEG), polypropylene glycol (PPG), and mixtures thereof.

18. The laundry detergent or cleaning product shaped body as claimed in claim 15, wherein the noncompressed part (b) is coated with a polymer containing amino groups.

19. The laundry detergent or cleaning product shaped body as claimed in claim 18, wherein the polymer comprises a copolymer of one or more basic monomers with acrylic esters.

20. The laundry detergent or cleaning product shaped body as claimed in claim 15, wherein the noncompressed part (b) is coated with an ampholytic polymer.

21. The laundry detergent or cleaning product shaped body as claimed in claim 20, wherein the ampholytic polymer comprises a copolymer of one or more basic monomers with substituted or unsubstituted acrylic acids and/or (meth) acrylic acids.

22. The laundry detergent or cleaning product shaped body as claimed in claim 18, wherein the coated noncompressed part (b) has a further coating comprising one or more polyvinyl acetates, one or more polyvinyl alcohols, or one or more substances melting at >50° C.

23. The laundry detergent or cleaning product shaped body as claimed in claim 22, wherein the one or more substances melting at >50° C. comprise one or more paraffins and/or polyethylene glycols.

24. The laundry detergent or cleaning product shaped body as claimed in claim 1, wherein the noncompressed part (b) has a coating that at a pH above 11 protects the noncompressed part (b) from dissolving in a washing or cleaning liquor.

25. The laundry detergent or cleaning product shaped body as claimed in claim 24, wherein the noncompressed part (b) has a coating that at a pH above 10 protects the noncompressed part (b) from dissolving in a washing or cleaning liquor.

26. The laundry detergent or cleaning product shaped body as claimed in claim 1, wherein the noncompressed part (b) has a coating that at a pH above 9 protects the noncompressed part (b) from dissolving in a washing or cleaning liquor.

27. The laundry detergent or cleaning product shaped body as claimed in claim 24, wherein the coating does not protect the noncompressed part (b) from dissolving in a washing or cleaning liquor at a pH below 6.

28. The laundry detergent or cleaning product shaped body as claimed in claim 27, wherein the coating does not protect the noncompressed part (b) from dissolving in a washing or cleaning liquor at a pH below 7.

29. The laundry detergent or cleaning product shaped body as claimed in claim 28, wherein the coating does not protect the noncompressed part (b) from dissolving in a washing or cleaning liquor at a pH below 8.

30. The laundry detergent or cleaning product shaped body as claimed in claim 1, wherein the noncompressed part (a) has been prepared by sintering.

31. The laundry detergent or cleaning product shaped body as claimed in claim 1, wherein the noncompressed part (a) has been prepared by casting.

32. The laundry detergent or cleaning product shaped body as claimed in claim 1, wherein the noncompressed part (a) has been prepared by solidification of a solution or by gelatinization.

33. The laundry detergent or cleaning product shaped body as claimed in claim 1, wherein the noncompressed part (a) has been prepared by hardening.

34. The laundry detergent or cleaning product shaped body as claimed in claim 1, wherein the noncompressed part (b) has been prepared by sintering.

35. The laundry detergent or cleaning product shaped body as claimed in claim 1, wherein the noncompressed part (b) has been prepared by casting.

36. The laundry detergent or cleaning product shaped body as claimed in claim 1, wherein the noncompressed part (b) has been prepared by solidification of a solution or gelatinization.

37. The laundry detergent or cleaning product shaped body as claimed in claim 1, wherein the noncompressed part (b) has been prepared by hardening.

38. The laundry detergent or cleaning product shaped body as claimed in claim 1, wherein the noncompressed part (b) is particulate.

39. The laundry detergent or cleaning product shaped body as claimed in claim 1, wherein the noncompressed part (a) comprises one or more builders in amounts of from 1% to 100% by weight, based on the weight of the noncompressed part (a).

40. The laundry detergent or cleaning product shaped body as claimed in claim 39, wherein the noncompressed part (a) comprises one or more builders in amounts of from 5% to 95% by weight, based on the weight of the noncompressed part (a).

41. The laundry detergent or cleaning product shaped body as claimed in claim 40, wherein the noncompressed part (a) comprises one or more builders in amounts of 10% to 90% by weight, based on the weight of the noncompressed part (a).

42. The laundry detergent or cleaning product shaped body as claimed in claim 41, wherein the noncompressed part (a) comprises one or more builders in amounts of 20% to 85% by weight, based on the weight of the noncompressed part (a).

43. The laundry detergent or cleaning product shaped body as claimed in claim 1, wherein the noncompressed part (a) comprises from 20% to 80% by weight of one or more phosphates.

44. The laundry detergent or cleaning product shaped body as claimed in claim 43, wherein the noncompressed part (a) comprises from 25% to 75% by weight of one or more phosphates.

45. The laundry detergent or cleaning product shaped body as claimed in claim 44, wherein the noncompressed part (a) comprises from 30% to 70% by weight of one or more phosphates.

46. The laundry detergent or cleaning product shaped body as claimed in claim 43, wherein the one or more phosphates comprise one or more alkali metal phosphates.

47. The laundry detergent or cleaning product shaped body as claimed in claim 46, wherein the alkali metal phosphates comprise pentasodium or pentapotassium triphosphate.

48. The laundry detergent or cleaning product shaped body as claimed in claim 1, wherein the noncompressed part (a) comprises 5% to 50% by weight of one or more carbonates and/or hydrogencarbonates.

49. The laundry detergent or cleaning product shaped body as claimed in claim 48, wherein the noncompressed part (a) comprises 7.5% to 40% by weight of one or more carbonates and/or hydrogencarbonates.

50. The laundry detergent or cleaning product shaped body as claimed in claim 49, wherein the noncompressed part (a) comprises 10% to 30% by weight of one or more carbonates and/or hydrogencarbonates.

51. The laundry detergent or cleaning product shaped body as claimed in claim 48, wherein the one or more carbonates and/or hydrogencarbonates comprise one or more alkali metal carbonates.

52. The laundry detergent or cleaning product shaped body as claimed in claim 51, wherein the one or more alkali metal carbonates comprise sodium carbonate.

53. The laundry detergent or cleaning product shaped body as claimed in claim 1, wherein the noncompressed part (a) comprises from 10% to 60% by weight of one or more silicates.

54. The laundry detergent or cleaning product shaped body as claimed in claim 53, wherein the noncompressed part (a) comprises, from 15% to 50% by weight of one or more silicates.

55. The laundry detergent or cleaning product shaped body as claimed in claim 54, wherein the noncompressed part (a) comprises from 20% to 40% by weight of one or more silicates.

56. The laundry detergent or cleaning product shaped body as claimed in claim 1, wherein the noncompressed part (a) has total surfactant contents below 5% by weight.

57. The laundry detergent or cleaning product shaped body as claimed in claim 56, wherein the noncompressed part (a) has total surfactant contents below 4% by weight.

58. The laundry detergent or cleaning product shaped body as claimed in claim 57, wherein the noncompressed part (a) has total surfactant contents below 3% by weight.

59. The laundry detergent or cleaning product shaped body as claimed in claim 58, wherein the noncompressed part (a) has total surfactant contents below 2% by weight.

60. The laundry detergent or cleaning product shaped body as claimed in claim 1, wherein the noncompressed part (a) comprises from 2% to 25% by weight of one or more oxygen or halogen bleaches.

61. The laundry detergent or cleaning product shaped body as claimed in claim 60, wherein the noncompressed part (a) comprises from 5% to 20% by weight of one or more oxygen or halogen bleaches.

62. The laundry detergent or cleaning product shaped body as claimed in claim 61, wherein the noncompressed part (a) comprises from 10% to 15% by weight of one or more oxygen or halogen bleaches.

63. The laundry detergent or cleaning product shaped body as claimed in claim 1, wherein the noncompressed part (a) comprises 0.25% to 15% by weight of one or more bleach activators selected from group consisting of polyacylated alkylenediamines, N-acylimides, and acylated phenolsulfonates.

64. The laundry detergent or cleaning product shaped body as claimed in claim 63, wherein the noncompressed part (a) comprises 0.5% to 10% by weight of one or more bleach activators selected from group consisting of polyacylated alkylenediamines, N-acylimides, and acylated phenolsulfonates.

65. The laundry detergent or cleaning product shaped body as claimed in claim 64, wherein the noncompressed part (a) comprises 1% to 5% by weight of one or more bleach activators selected from group consisting of polyacylated alkylenediamines, N-acylimides, and acylated phenolsulfonates.

66. The laundry detergent or cleaning product shaped body as claimed in claim 63, wherein the bleach activators are one or more selected from the group consisting of tetraacetylethylenediamine, N-nonanoyl-succinimide, n-nonanoyloxybenzenesulfonate, isononanoyloxybenzenesulfonate, and n-methylmorpholinium-acetonitrile methylsulfate.

67. The laundry detergent or cleaning product shaped body as claimed in claim 1, wherein the noncompressed part (a) comprises 0.01% to 5% by weight of one or more silver protectants selected from the group consisting of triazoles, benzotriazoles, bisbenzo-triazoles, aminotriazoles, alkylaminotriazoles, and transition metal salts or complexes.

68. The laundry detergent or cleaning product shaped body as claimed in claim 67, wherein the noncompressed part (a) comprises 0.05% to 4% by weight of the one or more silver protectants.

69. The laundry detergent or cleaning product shaped body as claimed in claim 68, wherein the noncompressed part (a) comprises 0.5% to 3% by weight of the one or more silver protectants.

70. The laundry detergent or cleaning product shaped body as claimed in claim 1, wherein the noncompressed part (a) comprises 6% to 30% by weight of one or more substances selected from the group consisting of enzymes, corrosion inhibitors, deposit inhibitors, cobuilders, dyes, and fragrances.

71. The laundry detergent or cleaning product shaped body as claimed in claim 70, wherein the noncompressed part (a) comprises 7.5% to 25% by weight of one or more substances selected from the group consisting of enzymes, corrosion inhibitors, deposit inhibitors, cobuilders, dyes, and fragrances.

72. The laundry detergent or cleaning product shaped body as claimed in claim 71, wherein the noncompressed part (a) comprises 10% to 20% by weight of one or more substances selected from the group consisting of enzymes, corrosion inhibitors, deposit inhibitors, cobuilders, dyes, and fragrances.

73. The laundry detergent or cleaning product shaped body as claimed in claim 1, wherein the noncompressed part (b) is a coated shaped body contained in a cavity formed in the noncompressed part (a).

74. A laundry detergent or cleaning product shaped body comprising:

(a) a first noncompressed part comprising an active substance; and (b) a further noncompressed part comprising an active substance, wherein the first noncompressed part (a) has one or more cavities in which the noncompressed part (b) is present at least in part, said noncompressed parts being formed under pressures of no more than 0.1 $kN/cm^2$, and wherein (a) and (b) are not gelatinous at the same time.

* * * * *

UNITED STATES PATENT AND TRADEMARK OFFICE

CERTIFICATE OF CORRECTION

PATENT NO. : 6,737,390 B2
DATED : May 18, 2004
INVENTOR(S) : Sunder et al.

It is certified that error appears in the above-identified patent and that said Letters Patent is hereby corrected as shown below:

Title page,
Item [56], References Cited, OTHER PUBLICATIONS, "Edward Smudgers" reference, "Smudgers" should read -- Smulders --.

Column 72,
Line 16, delete "ether" and insert -- other --.
Line 21, delete "mere" and insert -- more --.

Signed and Sealed this

Twenty-third Day of November, 2004

JON W. DUDAS
*Director of the United States Patent and Trademark Office*